US011555282B2

(12) United States Patent
Barker et al.

(10) Patent No.: US 11,555,282 B2
(45) **Date of Patent: *Jan. 17, 2023**

(54) SNOW PLOW AND MOUNT ASSEMBLY

(71) Applicant: Douglas Dynamics, LLC, Milwaukee, WI (US)

(72) Inventors: Chad Thomas Barker, Trevor, WI (US); David N. Bloxdorf, Hubertus, WI (US); Matthew Thoma Curran, Menomonee Falls, WI (US); Gerald L. Depies, Cedar Grove, WI (US); Christopher Aaron Horn, Menomonee Falls, WI (US); Bob Iverson, Menomonee Falls, WI (US); Matthew Terran Kaminecki, Whitefish Bay, WI (US); Leonard D. Morris, Holt, MI (US)

(73) Assignee: Douglas Dynamics, LLC, Milwaukee, WI (US)

( * ) Notice: Subject to any disclaimer, the term of this patent is extended or adjusted under 35 U.S.C. 154(b) by 341 days.

This patent is subject to a terminal disclaimer.

(21) Appl. No.: 16/705,632

(22) Filed: Dec. 6, 2019

(65) Prior Publication Data

US 2020/0407931 A1 Dec. 31, 2020

Related U.S. Application Data

(63) Continuation-in-part of application No. 16/452,799, filed on Jun. 26, 2019.

(51) Int. Cl.
*E01H 5/06* (2006.01)

(52) U.S. Cl.
CPC ..... *E01H 5/061* (2013.01)

(58) Field of Classification Search
CPC E01H 5/06; E01H 5/061; A01B 59/00; A01B 59/06; A01B 59/064; A01B 63/00;
(Continued)

(56) References Cited

U.S. PATENT DOCUMENTS 3,987,562 A 10/1976 Deen et al.
4,658,519 A 4/1987 Quenzi
(Continued)

FOREIGN PATENT DOCUMENTS

GB 1490087 A 10/1977

*Primary Examiner* — Jamie L McGowan
(74) *Attorney, Agent, or Firm* — Wood Herron & Evans LLP

(57) ABSTRACT

A snow plow and mount frame assembly permits an operator to attach and detach a snow plow to and from a mount frame secured to a vehicle, without the operator exiting a cab of the vehicle. The assembly comprises a mount frame, a snow plow frame, a plow blade, a first actuator for pivoting the A-frame relative to the lift frame, a latch mechanism, and a second actuator to either latch or unlatch the latch mechanism. When the vehicle is driven toward the snow plow the snow plow frame mates with the mount frame and an electrical connection is made between the vehicle electrical system and at least the first actuator without manual manipulation. The second actuator is energized to either latch the latch mechanism thereby securing the snow plow frame to the mount frame or unlatch the latch mechanism thereby freeing the snow plow frame from the mount frame.

33 Claims, 54 Drawing Sheets

(58) Field of Classification Search
CPC ..... E02F 3/7622; E02F 3/3604; E02F 3/3672; E02F 3/84; B60D 1/36
See application file for complete search history.

(56) References Cited

U.S. PATENT DOCUMENTS

| | | | | |
|---|---|---|---|---|
| 5,111,603 | A | 5/1992 | Knowlton et al. | |
| 5,195,261 | A | 3/1993 | Vachon | |
| 5,568,694 | A | 10/1996 | Capra et al. | |
| 5,692,855 | A * | 12/1997 | Burton | E02F 3/3631 172/272 |
| 5,829,174 | A | 11/1998 | Hadler et al. | |
| 6,138,388 | A * | 10/2000 | Kost | E01H 5/06 307/10.8 |
| 6,170,178 | B1 * | 1/2001 | Christy | E01H 5/06 172/272 |
| 6,209,231 | B1 * | 4/2001 | Curtis | E01H 5/06 37/231 |
| 6,256,909 | B1 | 7/2001 | Kost et al. | |
| 6,323,759 | B1 | 11/2001 | Menze | |
| 6,393,737 | B2 * | 5/2002 | Quenzi | E01H 5/06 37/231 |
| 6,557,275 | B2 | 5/2003 | Curtis | |
| 6,964,121 | B2 * | 11/2005 | Harris | E02F 3/7627 172/439 |
| 7,228,650 | B2 | 6/2007 | Curtis | |
| 7,526,883 | B2 * | 5/2009 | Musso, Jr. | E01H 5/06 172/275 |
| 7,562,718 | B1 * | 7/2009 | Moorman | E02F 3/3631 172/272 |
| 7,665,233 | B2 | 2/2010 | Lemieux et al. | |
| 7,841,110 | B2 * | 11/2010 | Koch | E01H 5/06 37/231 |
| 7,963,052 | B2 | 6/2011 | Koch et al. | |
| 8,127,471 | B2 | 3/2012 | Stevens et al. | |
| 8,287,226 | B1 | 10/2012 | Westendorf et al. | |
| 8,291,622 | B2 | 10/2012 | Gappy | |
| 8,935,862 | B1 * | 1/2015 | Koch | E01H 5/06 37/272 |
| 9,194,091 | B2 | 11/2015 | Moon, Jr. et al. | |
| 9,869,067 | B2 * | 1/2018 | Barker | E01H 5/06 |
| 2006/0055150 | A1 | 3/2006 | Curtis | |
| 2006/0270254 | A1 * | 11/2006 | Chiang | H01R 13/4538 439/137 |
| 2008/0073090 | A1 * | 3/2008 | Harris | E01H 5/06 172/275 |
| 2009/0090032 | A1 | 4/2009 | Yang et al. | |
| 2010/0101119 | A1 * | 4/2010 | Roberts | E01H 5/06 37/231 |
| 2013/0224978 | A1 * | 8/2013 | Arakelian | H01R 13/405 439/253 |
| 2013/0263480 | A1 | 10/2013 | Stevens et al. | |
| 2015/0105974 | A1 | 4/2015 | Kleve et al. | |
| 2017/0089021 | A1 | 3/2017 | Sankovic et al. | |
| 2018/0067001 | A1 * | 3/2018 | Thierbach | G01L 1/12 |
| 2018/0238015 | A1 | 8/2018 | Fey | |
| 2018/0238016 | A1 | 8/2018 | Seacat et al. | |

* cited by examiner

SNOW PLOW AND MOUNT ASSEMBLY

RELATED APPLICATIONS

This application is a continuation-in-part of U.S. patent application Ser. No. 16/452,799 filed Jun. 26, 2019, which is hereby incorporated by reference herein as if fully set forth in its entirety.

FIELD OF THE INVENTION

This invention relates generally to plows, and more particularly to improvements in snow plow and mount assemblies as well as to improvements in snow plows themselves.

BACKGROUND OF THE INVENTION

Conventional pickup truck mounted snow plow assemblies have a mount frame that attaches to the truck frame below and behind the front bumper, and a snow plow frame that removably attaches to the mount frame. When not in use the snow plow frame is detached from the mount frame and stored; the mount frame remains on the truck frame but is generally unobtrusive as it is below and behind the front bumper.

A conventional snow plow frame has a lift frame and an A-frame. The lift frame removably attaches at its lower ends to the mount frame, and generally extends forwardly and upwardly from the mount frame. The A-frame is pivoted at its rearward end to the lower ends of the lift frame for pivoting about a transverse horizontal lift axis. A plow blade is pivoted to the A-frame at its forward end for pivoting about a vertical axis. Hydraulic cylinders are attached on one end to the blade and on the other end to the A-frame to pivot the blade about the vertical axis. The plow blade may also be pivoted to the A-frame for pivoting about a transverse horizontal blade trip axis, in the event that the snow plow employs a blade trip, or alternatively, a lower edge of the blade may be pivoted to the balance of the blade for pivoting about a transverse horizontal edge trip axis, in the event that the snow plow employs an edge trip. A hydraulic cylinder is operable between the lift frame and the A-frame to pivot the A-frame about the transverse horizontal lift axis and hence raise and lower the blade. There are at least two different types of lift arrangements.

One type of lift arrangement has a hydraulic cylinder attached on one end to the lift frame and attached on the other end to the A-frame. In this arrangement, retracting the cylinder directly raises the A-frame and blade, and extending the cylinder directly lowers the A-frame and blade. The other type of lift arrangement has a lift arm pivoted to the lift frame, a chain or cable or other tethering device attached on one end to the free end of the lift arm and attached on the other end to the A-frame, and a hydraulic cylinder attached on one end to the lift frame and attached on the other end to the lift arm. In this arrangement, extending the cylinder raises the A-frame and blade via the lift arm and chain, and retracting the cylinder lowers the A-frame and blade via the lift arm and chain.

Over the years a number of different hitching mechanisms have been proposed to allow an operator to more quickly and easily hitch the snow plow frame to the mount frame. Some examples of hitch assemblies are shown in the assignee's U.S. Pat. Nos. Re. 35,700, 6,928,757, 6,711,837, 6,526,577, 5,353,530, 7,797,859, 7,681,334, 7,430,821, 6,944,978, 6,615,513, 6,393,737, 6,276,076, and 6,178,669, the disclosures of which are hereby incorporated by reference herein as if fully set forth in their entirety.

A more recent development in the area of hitching mechanisms to allow an operator to more quickly and easily hitch the snow plow frame to the mount frame is shown in the assignee's U.S. Pat. No. 9,869,067, which is hereby incorporated by reference herein as if fully set forth in its entirety.

Current snowplow mount designs require the user to exit the vehicle during the plow attachment process to confirm plow to vehicle mount alignment, engage the plow retention device (hitch pins, latch, etc.), make the electrical connections for plow and lighting, and operate the snowplow stand. This process is again repeated during the plow detachment process. Requiring the user to exit the vehicle to perform the manual attach/detach process has multiple disadvantages. Exiting the vehicle increases the time required to attach/detach the plow and physical effort. The sequence of operations is subject to the user following the instructions, and can result in malfunctioning of the plow or inability to correctly achieve plow to vehicle connections. The user is exposed to hazards such as ergonomic factors from bending down and exerting force at operation points to achieve attachment. It exposes the user to hazards of having body parts in proximity to moving components, as well as environmental exposure (low temperature, wind, precipitation), and possible traffic hazards. Impaired visibility due to darkness or snow covering plow parts can make operation difficult and more time consuming, and affect the ability of the user to confirm correct connection has been established.

Despite the advances made in the area of hitching mechanisms over the years, further improvement is nevertheless desired to improve the speed, convenience, ergonomics, safety, and reliability of attaching/detaching the snow plow to/from the vehicle.

SUMMARY OF THE INVENTION

In one aspect, a snow plow and mount assembly comprises a mount frame adapted to be secured to a vehicle, a snow plow frame having an A-frame and a lift frame pivotally connected relative to one another for pivoting movement about a generally transverse horizontal axis, a plow blade pivotally connected relative to the A-frame for pivoting movement about a generally vertical axis, and a first actuator operably associated with the A-frame and lift frame for imparting relative pivoting movement between the A-frame and lift frame, the first actuator powered by an electrical system of the vehicle. One of the mount frame and lift frame has first and second arms and the other of the mount frame and lift frame has first and second receivers, the first and second arms received in respective ones of the first and second receivers upon relative movement therebetween towards one another. The lift frame has a latch mechanism and a second actuator for moving the latch mechanism to a latched position for securing the arms in the receivers and for moving the latch mechanism to an unlatched position for freeing the arms to move out of the receivers, the second actuator powered by the electrical system of the vehicle. The assembly is operable such that when the vehicle is driven toward the snow plow the arms are received in the receivers and an electrical connection is made between the vehicle electrical system and the first and second actuators without manual manipulation, when the first actuator is energized the lift frame pivots relative to the A-frame in a first direction to align the arms with the receivers, and when the second actuator is energized the latch mechanism is moved to the latched position thereby removably securing the snow plow frame to the mount frame.

Each arm can have a recess therein, and each receiver can have a hitch pin therein, the hitch pins received in respective ones of the recesses upon relative movement therebetween towards one another. The latch mechanism can comprise first and second latch pins, a hole in each arm and a corresponding hole in each receiver, for each latch pin. The assembly can be operable such that when the first actuator is energized the lift frame pivots relative to the A-frame in the first direction and the hitch pins are received in the recesses, the lift frame further pivots relative to the A-frame in the first direction and the arm holes are aligned with the receiver holes, and when the second actuator is energized the latch pins are moved to the latched position thereby positioning the latch pins in the arm holes and in the receiver holes.

The assembly can further comprise a sensor for sensing the latch pins are in the unlatched position and for sensing the latch pins are in the latched position. The sensor can directly or indirectly sense the position of the latch pins. If configured to directly sense the position of the latch pins, the sensor can be a contact sensor or a non-contact sensor.

The assembly can further comprise a support stand pivotally connected to the A-frame for pivoting movement to an extended ground contacting and snow plow frame supporting position and to a retracted position at which the support stand does not contact the ground and does not support the snow plow frame, and a mechanism for moving the support stand to the retracted position when the latch pins are in the latched position and for moving the support stand to the extended position when the latch pins are in the unlatched position.

The assembly can further comprise a support stand pivotally connected to the A-frame for pivoting movement to an extended ground contacting and snow plow frame supporting position and to a retracted position at which the support stand does not contact the ground and does not support the snow plow frame, the support stand biased toward the retracted position, the support stand having a cam surface thereon, and a cam actuating pin connected to the lift frame for translational movement between an extended position and a retracted position. The cam actuating pin can be operably associated with the support stand cam surface, and the second actuator can be operably associated with the cam actuating pin, such that when the second actuator is energized to move the latch pins to the unlatched position the cam actuating pin moves to the extended position, and when the first actuator is energized to pivot the lift frame relative to the A-frame in a second direction the cam actuating pin contacts the support stand cam surface whereupon further pivoting of the lift frame relative to the A-frame in the second direction moves the support stand to the extended position, and when the first actuator is energized to pivot the lift frame relative to the A-frame in the first direction the support stand returns to the retracted position, and when the second actuator is energized to move the latch pins to the latched position the cam actuating pin moves to the retracted position. The assembly can further comprise a link interconnecting the second actuator and the cam actuating pin.

The arms can be on the lift frame and the receivers can be on the mount frame.

The first actuator can be a hydraulic cylinder operably connected to the A-frame and to the lift frame, and the second actuator can be an electric linear actuator operably connected to the latch pins.

The mount frame can have one of a male connector and a female connector in electrical communication with the vehicle electrical system, and the lift frame can have the other of the male connector and the female connector in operable electrical communication with the first actuator and the second actuator; when the arms are received in the receivers the male and female connectors connect to make electrical contact. The connectors can be matingly tapered to facilitate connection in the event of misalignment. Each connector can include a permanent magnet to maintain connection of the connectors during shock and vibration of operation. The connectors can be mounted to the mount frame and lift frame in such a way to permit a degree of relative motion between the connectors and the mount frame and lift frame without breaking the electrical circuit established between the connectors. The female connector can be located on the mount frame, and further include a pair of pivoting covers which, when closed, prohibit entry of contaminates into the female connector, and when open, permit the female connector to connect to the male connector. The assembly can include a third actuator, energized by the electrical system of the vehicle, for opening the covers prior to attachment of the snow plow to the vehicle and for closing the covers subsequent to detachment of the snow plow from the vehicle.

The assembly can further include a sensor associated with the second actuator and a controller associated with the first actuator, the second actuator, and the sensor, the controller configured to prevent energization of the first actuator upon receiving a signal from the sensor that the second actuator is not fully extended. The sensor can be a linear encoder or a potentiometer providing a position signal of the second actuator to the controller.

The assembly can further include a sensor associated with the latch pins and a controller associated with the first actuator, the second actuator, and the sensor, the controller configured to energize the first actuator upon receiving a signal from the sensor that the arm holes and the receiver holes are not aligned so as to align the arm holes and the receiver holes. The sensor can sense a resistance force on at least one of the latch pins to determine that the arm holes and the receiver holes are not aligned. The second actuator can be an electric linear actuator connected to the latch pins, and the sensor can comprise a telescoping link assembly connected to the linear actuator and to one of the pins.

The telescoping link assembly can comprise a bracket mounted to the linear actuator and having first and second spaced apart ends and first and second limit switches mounted to the first and second ends, respectively, a telescoping link connected to the one pin, the link and bracket operable to telescope into and out of one another so as to shorten and lengthen, respectively, a collar mounted to the telescoping link, a first compression spring positioned between the first end of the bracket and the collar and a second compression spring positioned between the second end of the bracket and the collar, the compression springs normally biasing the collar to a nominal centered position between the first and second ends of the bracket, a first washer positioned between the collar and the first compression spring and a second washer positioned between the collar and the second compression spring. When the actuator is energized to extend and move the pins outwardly through the arm holes and the receiver holes, if one of the pins encounters a large enough resistance force due to misalignment of a respective arm hole and a respective receiver hole, the telescoping link assembly telescopes and the collar compresses a respective one of the first and second springs until a respective one of the first and second washers contacts a respective one of the first and second limit switches, activating the respective limit switch which deenergizes the linear actuator. At this time the first actuator is energized to pivot the lift frame relative to the A-frame so as to align the misaligned respective arm and receiver holes. Upon alignment of the misaligned respective arm and receiver holes, the compressed respective spring moves the one pin partially through the respective arm and receiver holes. At this time the one of the first and second washers moves out of contact with the respective one of the first and second limit switches, deactivating the respective limit switch which energizes the linear actuator to move the one pin to a fully engaged position.

The pins can be confirmed to both be in the fully engaged position when the linear actuator is fully extended, the first limit switch is not activated by the first washer, and the second limit switch is not activated by the second washer.

Alternatively, the sensor can sense a velocity or a current of the linear actuator to determine that the arm holes and the receiver holes are not aligned.

In another aspect, a snow plow and mount assembly comprises a mount frame adapted to be secured to a vehicle, a snow plow frame having an A-frame and a lift frame pivotally connected relative to one another for pivoting movement about a generally transverse horizontal axis, a plow blade pivotally connected relative to the A-frame for pivoting movement about a generally vertical axis, and a first actuator operably associated with the A-frame and the lift frame for imparting relative pivoting movement between the A-frame and the lift frame, the first actuator powered by an electrical system of the vehicle. One of the mount frame and the lift frame has at least a first arm and the other of the mount frame and the lift frame has at least a first receiver, the arm received in the receiver upon relative movement therebetween towards one another. The arm has one of a recess and a hitch pin therein, the receiver has the other of the recess and the hitch pin therein, the hitch pin received in the recess upon relative movement therebetween towards one another. The lift frame has a latch mechanism and a second actuator for moving the latch mechanism to a latched position for securing the arm in the receiver and for moving the latch mechanism to an unlatched position for freeing the arm to move out of the receiver, the second actuator powered by the electrical system of the vehicle. The latch mechanism comprises at least a first latch pin, a hole in the arm and a corresponding hole in the receiver. The assembly is operable such that driving the vehicle toward the snow plow causes the arm to be received in the receiver and an electrical connection to be made between the vehicle electrical system and the first and second actuators without manual manipulation, energization of the first actuator causes the lift frame to pivot relative to the A-frame in a first direction and the hitch pin to be received in the recess, further energization of the first actuator causes the lift frame to further pivot relative to the A-frame in the first direction to align the arm hole and the receiver hole, and energization of the second actuator causes the latch pin to move to the latched position thereby positioning the latch pin in the arm hole and in the receiver hole thereby removably securing the snow plow frame to the mount frame.

In another aspect, a snow plow and mount frame assembly permits an operator to attach a snow plow to a mount frame secured to a vehicle, without the operator exiting a cab of the vehicle. The assembly comprises first and second connectors on the mount frame and the snow plow, respectively, that connect during mating of the mount frame with the snow plow as the vehicle is driven toward the snow plow, to provide power to the snow plow from an electrical system of the vehicle, a first actuator powered by the vehicle electrical system to pivot a lift frame of the snow plow upwardly relative to an A-frame of the snow plow to align holes in the lift frame with holes in the mount frame, a second actuator powered by the vehicle electrical system to extend latch pins through the lift frame and mount frame holes to a latched position, a first sensor powered by the vehicle electrical system to determine that the lift frame and mount frame holes are aligned, a second sensor powered by the vehicle electrical system to determine that the second actuator is fully extended, and a controller that receives signals from the first and second sensors and sends signals to the first and second actuators in response to the signals received from the first and second sensors.

The assembly can further comprise a snow plow support stand operable to move from an extended position to a retracted position and from the retracted position to the extended position during energization of the first actuator to pivot the lift frame upwardly and downwardly relative to the A-frame, respectively, when the second actuator has the latch pins retracted in an unlatched position, and operable to not move from the retracted position to the extended position during energization of the first actuator to pivot the A-frame upwardly relative to the lift frame when the second actuator has the latch pins in the latched position.

The first actuator can be a hydraulic cylinder and the second actuator can be an electric linear actuator.

The first sensor can be a telescoping link assembly connected to the linear actuator and one of the pins. The telescoping link assembly can have first and second limit switches, wherein when if one of the pins encounters a large enough resistance force due to misalignment of a respective arm hole and a respective receiver hole, the telescoping link assembly telescopes and one of the first and second limit switches is activated deenergizing the second actuator, whereupon the first actuator is energized to align the misaligned respective arm and receiver holes, and upon alignment thereof the second actuator is energized to extend the one pin to a fully engaged position.

Alternatively, the first sensor can sense a velocity or a current of the linear actuator to determine that the arm holes and the receiver holes are not aligned.

The second sensor can be a linear encoder or a potentiometer.

When the first sensor senses that the arm holes and the receiver holes are aligned and when the second sensor senses that the linear actuator is fully extended, the hydraulic cylinder can be energized to pivot the A-frame upwardly relative to the lift frame. The first sensor senses that the arm holes and the receiver holes are aligned when neither of the first and second limit switches are activated.

In another aspect, a method permitting an operator to attach a snow plow to a mount frame secured to a vehicle, without the operator exiting a cab of the vehicle, comprises driving the vehicle towards the snow plow to mate the mount frame with a lift frame of the snow plow, establishing an electrical connection between an electrical system of the vehicle and the snow plow upon mating the mount frame with the lift frame, energizing a first actuator powered by the vehicle electrical system to pivot the lift frame upwardly relative to an A-frame of the snow plow to align holes in the lift frame with holes in the mount frame, energizing a second actuator powered by the vehicle electrical system to extend latch pins through the lift frame and mount frame holes to a latched position, and energizing the first actuator by the vehicle electrical system to pivot the A-frame upwardly relative to the lift frame.

The method can further comprise determining that the lift frame holes and the mount frame holes are aligned and that the latch pins are fully engaged in the lift frame holes and the mount frame holes, by one or more sensors powered by the vehicle electrical system, prior to energizing the first actuator to pivot the A-frame upwardly relative to the lift frame.

The method can further comprise raising a snow plow support stand from an extended position to a retracted position during energization of the first actuator to pivot the lift frame upwardly relative to the A-frame to align holes in the lift frame with holes in the mount frame.

The method can further comprise decoupling support stand movement from relative pivoting movement between the lift frame and the A-frame during energization of the second actuator to extend the latch pins through the lift frame and mount frame holes such that energizing the first actuator to pivot the A-frame upwardly relative to the lift frame does not cause the support stand to move from the retracted position to the extended position.

The method can further comprise lowering the support stand from the retracted position to the extended position during energization of the first actuator to pivot the lift frame downwardly relative to the A-frame.

The method can further comprise coupling support stand movement to relative pivoting movement between the lift frame and the A-frame during energization of the second actuator to retract the latch pins from the lift frame and mount frame holes.

In another aspect, a method permitting an operator to attach a snow plow to a mount frame secured to a vehicle, without the operator exiting a cab of the vehicle, comprises driving the vehicle towards the snow plow to mate the mount frame with a lift frame of the snow plow, establishing an electrical connection between an electrical system of the vehicle and the snow plow upon mating the mount frame with the lift frame, and energizing an actuator powered by the vehicle electrical system to actuate a latching mechanism to latch the lift frame to the mount frame.

In another aspect, a snow plow and mount assembly comprises a mount frame adapted to be secured to a vehicle, a snow plow frame having an A-frame and a lift frame pivotally connected relative to one another for pivoting movement about a generally transverse horizontal axis, a plow blade pivotally connected relative to the A-frame for pivoting movement about a generally vertical axis, a first actuator operably associated with the A-frame and the lift frame for imparting relative pivoting movement between the A-frame and the lift frame, the first actuator powered by an electrical system of the vehicle, one of the mount frame and the lift frame having first and second arms and the other of the mount frame and the lift frame having first and second receivers, the first and second arms received in respective ones of the first and second receivers upon relative movement therebetween towards one another, and the lift frame having a latch mechanism and a second actuator for moving the latch mechanism to a latched position for securing the arms in the receivers and for moving the latch mechanism to an unlatched position for freeing the arms to move out of the receivers, the second actuator powered by the electrical system of the vehicle. The assembly is operable such that when the vehicle is driven toward the snow plow the arms are received in the receivers and an electrical connection is made between the vehicle electrical system and the first and second actuators without manual manipulation, and when the second actuator is energized the latch mechanism is moved to the latched position thereby removably securing the snow plow frame to the mount frame.

In another aspect, a snow plow and mount assembly comprises a mount frame adapted to be secured to a vehicle, a snow plow frame having an A-frame and a lift frame pivotally connected relative to one another for pivoting movement about a generally transverse horizontal axis, a plow blade pivotally connected relative to the A-frame for pivoting movement about a generally vertical axis, a first actuator operably associated with the A-frame and the lift frame for imparting relative pivoting movement between the A-frame and the lift frame, the first actuator powered by an electrical system of the vehicle, and the lift frame having a latch mechanism and a second actuator for moving the latch mechanism to a latched position for securing the snow plow frame to the mount frame, the second actuator powered by the electrical system of the vehicle. The assembly is operable such that when the vehicle is driven toward the snow plow the snow plow frame mates with the mount frame and an electrical connection is made between the vehicle electrical system and the first and second actuators without manual manipulation, and when the second actuator is energized the latch mechanism is moved to the latched position thereby removably securing the snow plow frame to the mount frame.

The lift frame of the snow plow frame can mate with the mount frame.

In another aspect, a snow plow and mount assembly comprises a mount frame adapted to be secured to a vehicle, a snow plow frame having an A-frame and a lift frame pivotally connected relative to one another for pivoting movement about a generally transverse horizontal axis, a plow blade pivotally connected relative to the A-frame for pivoting movement about a generally vertical axis, and a first actuator operably associated with the A-frame and the lift frame for imparting relative pivoting movement between the A-frame and the lift frame, the first actuator powered by an electrical system of the vehicle. One of the lift frame and the mount frame has a latch mechanism and a second actuator for at least one of moving the latch mechanism to a latched position for securing the snow plow frame to the mount frame and moving the latch mechanism to an unlatched position freeing the snow plow frame to move away from the mount frame, the second actuator powered by the electrical system of the vehicle. The assembly is operable such that when the vehicle is driven toward the snow plow the snow plow frame mates with the mount frame and an electrical connection is made between the vehicle electrical system and at least the first actuator without manual manipulation. When the second actuator is energized the latch mechanism is either moved to the latched position thereby removably securing the snow plow frame to the mount frame or is moved to the unlatched position thereby freeing the snow plow frame from the mount frame.

The lift frame of the snow plow frame can mate with the mount frame. The latch mechanism and the second actuator can be on the lift frame, in which case when the snow plow frame mates with the mount frame an electrical connection is also made between the vehicle electrical system and the second actuator without manual manipulation. Alternatively the latch mechanism and the second actuator can be on the mount frame.

One of the lift frame and the mount frame can have at least a first arm and the other of the lift frame and the mount frame can have at least a first receiver; the arm is received in the receiver upon relative movement therebetween towards one another.

The lift frame can include first and second said arms and the mount frame can include first and second said receivers; the first and second arms are received in respective ones of the first and second receivers upon relative movement therebetween towards one another. Each receiver can include a latch mechanism and a second actuator. Each arm can include a latch pin and each receiver can include a pair of side plates. Each latch mechanism can include a latch hook pivotally connected between the side plates and a latch pawl pivotally connected between the side plates. The latch hook can be spring biased to an unlatched position, and the latch pawl can be spring biased to an engaged position. The latch pawl can have a notch that engages the latch hook when rotated to the engaged position to prevent rotation of the latch hook. The latch hook can have a recess adapted to receive a respective latch pin. When the lift frame is moved to a raised position by the first actuator the latch pins are received in respective ones of the latch hook recesses and the latch pawl notches engage with respective ones of the latch hooks to prevent rotation of the latch hooks thereby removably securing the snow plow frame to the mount frame. When the second actuators are energized the latch pawls are rotated to a disengaged position, and the latch pins move out of respective ones of the latch hook recesses when the lift frame is moved to a lowered position by the first actuator thereby freeing the snow plow frame from said mount frame.

The assembly can further comprise a support stand pivotally connected to the A-frame for pivoting movement to an extended ground contacting and snow plow frame supporting position and to a retracted position at which the support stand does not contact the ground and does not support the snow plow frame. The support stand can be biased toward the retracted position. A third actuator can be operably associated with the support stand and powered by the electrical system of the vehicle. The assembly can be operable such that when the vehicle is driven toward the snow plow the snow plow frame mates with the mount frame and an electrical connection is also made between the vehicle electrical system and the third actuator without manual manipulation. When the third actuator is energized in a first direction, and when the first actuator is energized to pivot the lift frame relative to the A-frame in a downward direction, pivoting of the lift frame relative to the A-frame in the downward direction moves the support stand from the retracted position to the extended position. When the first actuator is energized to pivot the lift frame relative to the A-frame in an upward direction, the support stand returns to the retracted position. When the third actuator is energized in a second opposite direction pivoting of the A-frame relative to the lift frame in the upward direction does not cause the support stand to move from the retracted position to the extended position.

More particularly, the assembly can further comprise a support stand pivotally connected to the A-frame for pivoting movement to an extended ground contacting and snow plow frame supporting position and to a retracted position at which the support stand does not contact the ground and does not support the snow plow frame, the support stand biased toward the retracted position, the support stand having a cam surface thereon. A cam actuating pin can be connected to the lift frame for translational movement between an extended position and a retracted position. A third actuator can be included for moving the cam actuating pin between the extended and retracted positions, the third actuator powered by the electrical system of the vehicle. The assembly is operable such that when the vehicle is driven toward the snow plow the snow plow frame mates with the mount frame and an electrical connection is also made between the vehicle electrical system and the third actuator without manual manipulation. The cam actuating pin can be operably associated with the support stand cam surface such that when the third actuator is energized in a first direction the cam actuating pin moves to the extended position. When the first actuator is energized to pivot the lift frame relative to the A-frame in a downward direction, the cam actuating pin contacts the support stand cam surface whereupon further pivoting of the lift frame relative to the A-frame in the downward direction moves the support stand from the retracted position to the extended position. When the first actuator is energized to pivot the lift frame relative to the A-frame in an upward direction the support stand returns to the retracted position. When the third actuator is energized in a second opposite direction the cam actuating pin moves to the retracted position where the cam actuating pin cannot contact the support stand cam surface during relative pivoting of the lift frame and A-frame.

Each arm can have a recess therein and each receiver can have a hitch pin therein. The hitch pins are received in respective ones of the recesses upon relative movement therebetween towards one another.

The first actuator can be a hydraulic cylinder operably connected to the A-frame and to the lift frame, the second actuators can be electric linear actuators operably connected to the latch pawls and the mount frame, and the third actuator can be an electric linear actuator operably connected to the cam actuating pin and the lift frame.

The mount frame can have one of a male connector and a female connector in electrical communication with the vehicle electrical system, and the lift frame can have the other of the male connector and the female connector in operable electrical communication with the first actuator and the third actuator. When the snow plow frame mates with the mount frame the male and female connectors connect to make electrical contact.

In another aspect, a snow plow and mount assembly comprises a mount frame adapted to be secured to a vehicle, a snow plow frame having an A-frame and a lift frame pivotally connected relative to one another for pivoting movement about a generally transverse horizontal axis, a plow blade pivotally connected relative to the A-frame for pivoting movement about a generally vertical axis, a first actuator operably associated with the A-frame and the lift frame for imparting relative pivoting movement between the A-frame and the lift frame, the first actuator powered by an electrical system of the vehicle, one of the mount frame and the lift frame having first and second arms and the other of the mount frame and the lift frame having first and second receivers, the first and second arms received in respective ones of the first and second receivers upon relative movement therebetween towards one another, and the mount frame having at least one latch mechanism and at least one second actuator for either moving the latch mechanism to a latched position for securing the snow plow frame to the mount frame or for moving the latch mechanism to an unlatched position freeing the snow plow frame to move away from the mount frame, the second actuator powered by the electrical system of the vehicle. The assembly is operable such that when the vehicle is driven toward the snow plow, the first and second arms are received in respective ones of the first and second receivers and an electrical connection is made between the vehicle electrical system and the first actuator without manual manipulation, and when the second actuator is energized the latch mechanism is either moved to the latched position thereby removably securing the snow plow frame to the mount frame or is moved to the unlatched position thereby freeing the snow plow frame from the mount frame.

In another aspect, a method permitting an operator to attach a snow plow frame to, and detach the snow plow frame from, a mount frame secured to a vehicle, without the operator exiting a cab of the vehicle, comprises driving the vehicle towards the snow plow frame to mate the mount frame with a lift frame of the snow plow frame, establishing an electrical connection between an electrical system of the vehicle and the snow plow frame upon mating the mount frame with the lift frame, energizing a first actuator mounted on the snow plow frame and powered by the vehicle electrical system to pivot the lift frame upwardly relative to the A-frame to engage the lift frame with a latch mechanism on the mount frame and to latch the latch mechanism thereby removably securing the snow plow frame to the mount frame, energizing a second actuator mounted on the mount frame and powered by the vehicle electrical system to unlatch the latch mechanism, and energizing the first actuator to pivot the lift frame downwardly relative to the A-frame to disengage the lift frame from the latch mechanism thereby freeing the snow plow frame from the mount frame.

The method can further comprise coupling movement of a snow plow frame support stand to relative pivoting movement between the lift frame and the A-frame to raise the support stand from an extended position to a retracted position during energization of the first actuator to pivot the lift frame upwardly relative to the A-frame and to lower the support stand from the retracted position to the extended position during energization of the first actuator to pivot the lift frame downwardly relative to the A-frame.

The method can further comprise decoupling support stand movement from relative pivoting movement between the lift frame and the A-frame such that the support stand remains in the retracted position during energization of the first actuator to pivot the A-frame upwardly relative to the lift frame and to pivot the A-frame downwardly relative to the lift frame.

The method can further comprise energizing a third actuator mounted on the snow plow frame and powered by the vehicle electrical system to couple support stand movement to and decouple support stand movement from relative pivoting movement between the lift frame and the A-frame.

In another aspect, a snow plow and mount frame assembly that permits an operator to attach and detach a snow plow to and from a mount frame secured to a vehicle, without the operator exiting a cab of the vehicle, comprises a mount frame adapted to be secured to the vehicle, a snow plow frame having an A-frame and a lift frame pivotally connected to one another, a plow blade on the A-frame, a first actuator on the snow plow frame for pivoting said A-frame and said lift frame relative to one another, the first actuator adapted to be powered by an electrical system of the vehicle, a latch mechanism on either the mount frame or the snow plow frame for latching the snow plow frame to the mount frame, and a second actuator on either the mount frame or the snow plow frame to either latch or unlatch the latch mechanism, the second actuator adapted to be powered by the electrical system of the vehicle. When the vehicle is driven toward the snow plow the snow plow frame mates with the mount frame and an electrical connection is made between the vehicle electrical system and at least the first actuator without manual manipulation, and when the second actuator is energized the latch mechanism either latches thereby securing the snow plow frame to the mount frame or unlatches thereby freeing the snow plow frame from the mount frame.

The latch mechanism and second actuator can be on the snow plow frame, and when the vehicle is driven toward the snow plow the snow plow frame mates with the mount frame and an electrical connection is made between the vehicle electrical system and the first and second actuators without manual manipulation.

The latch mechanism and the second actuator can be on the mount frame, and when the second actuator is energized the latch mechanism unlatches.

The snow plow frame can include a support stand and a third actuator adapted to be powered by the electrical system of the vehicle, the third actuator operable to couple and decouple upward and downward movement of the support stand with and from relative pivoting movement of the A-frame and the lift frame. When the vehicle is driven toward the snow plow the snow plow frame mates with the mount frame and an electrical connection is made between the vehicle electrical system and the first and third actuators without manual manipulation.

The accompanying drawings, which are incorporated in and constitute a part of this specification, illustrate embodiments of the invention and, together with the summary of the invention given above, and the detailed description of the drawings given below, serve to explain the principles of the present invention.

BRIEF DESCRIPTION OF THE DRAWINGS

FIGS. 10A-11D are enlarged top cross-sectional views of the assembly of FIG. 1, in various stages of hitching the snow plow frame to the mount frame.

DETAILED DESCRIPTION OF THE DRAWINGS

Figure 1:
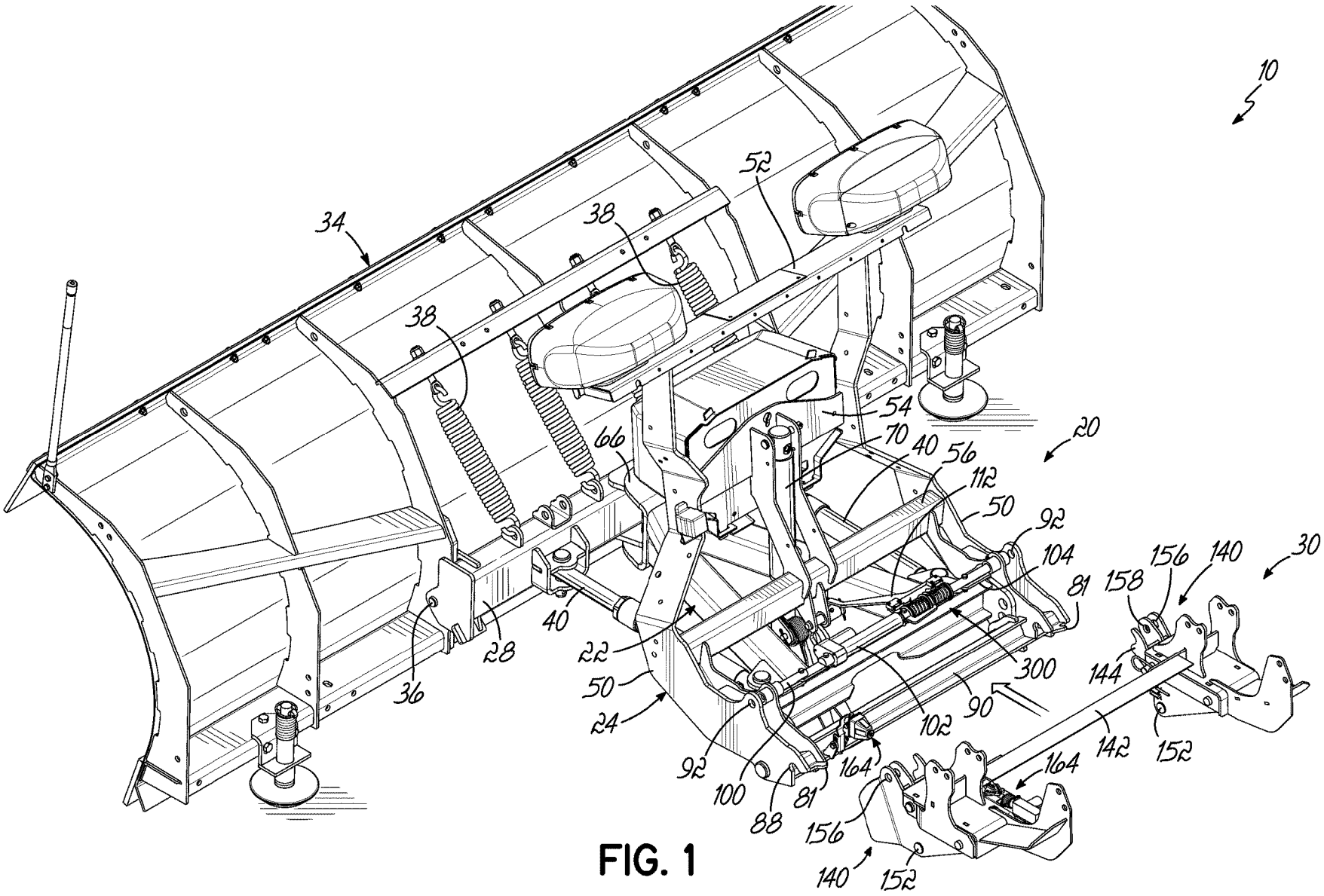
FIG. 1 is a rear left top perspective view of the snow plow and mount assembly of the present invention.
Figure 2A:
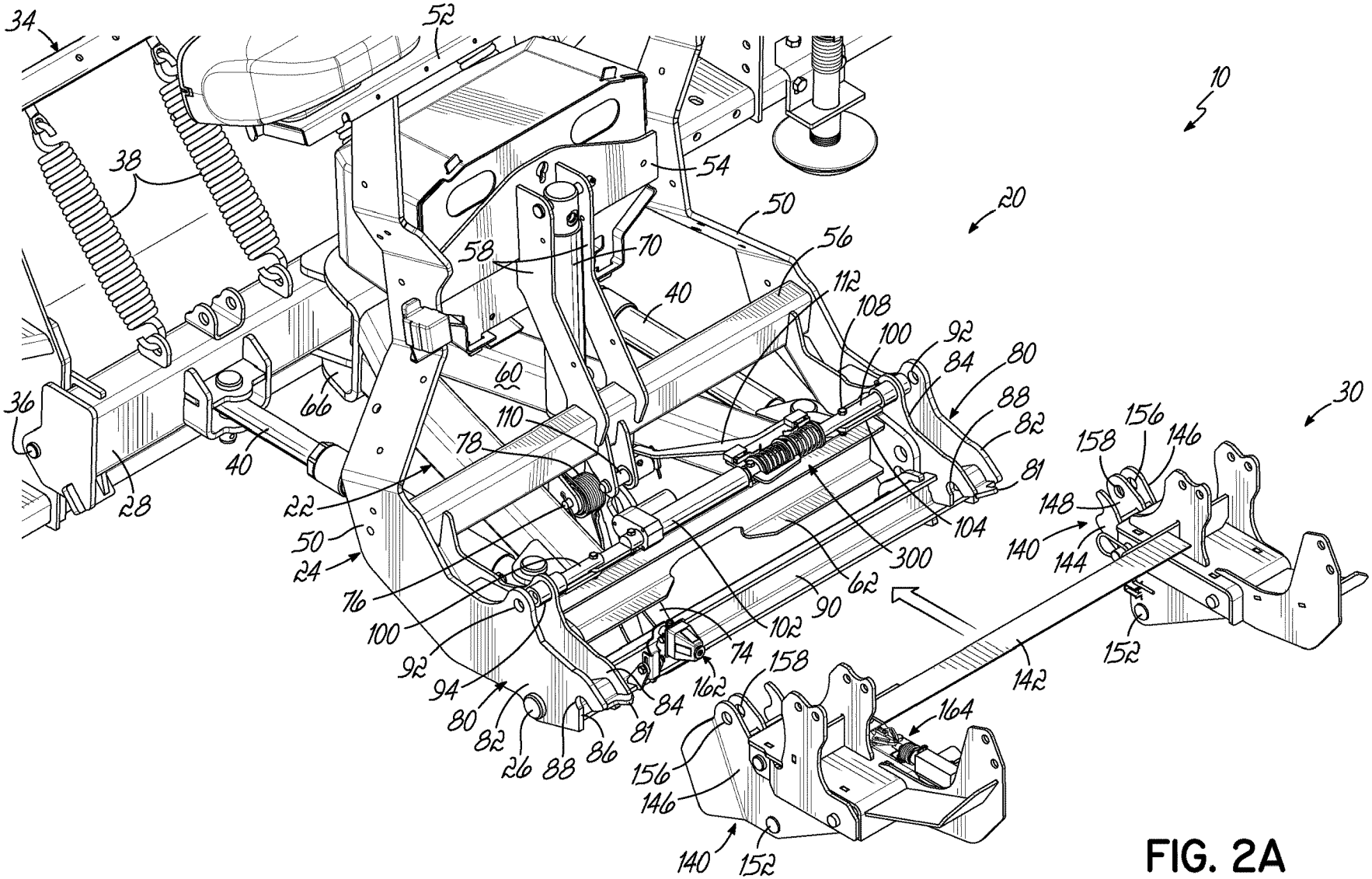
FIGS. 2A-2D are enlarged rear left top perspective views of the assembly of FIG. 1 in various stages of hitching the snow plow frame to the mount frame.
Figure 2B:
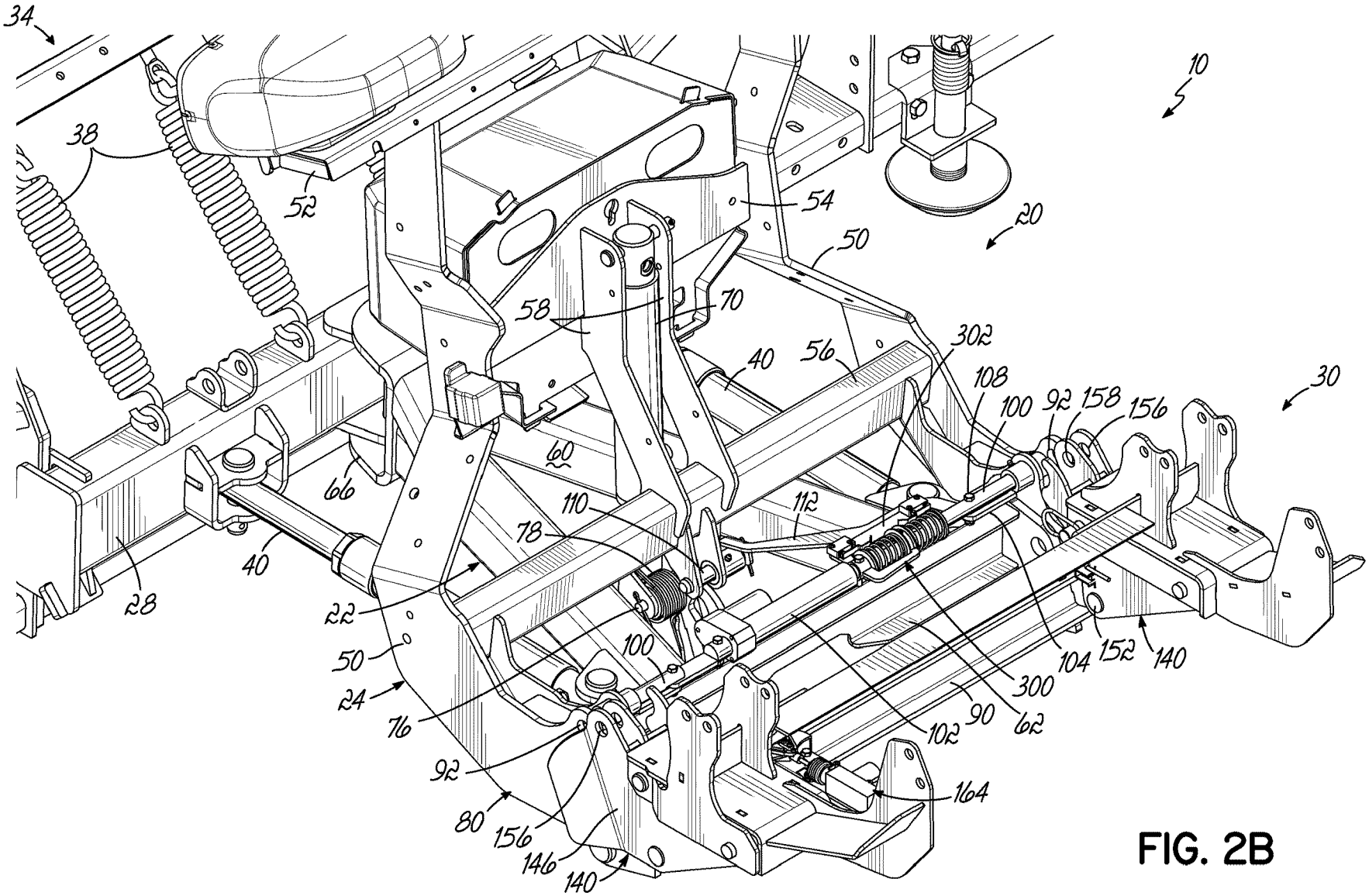
Figure 2C:
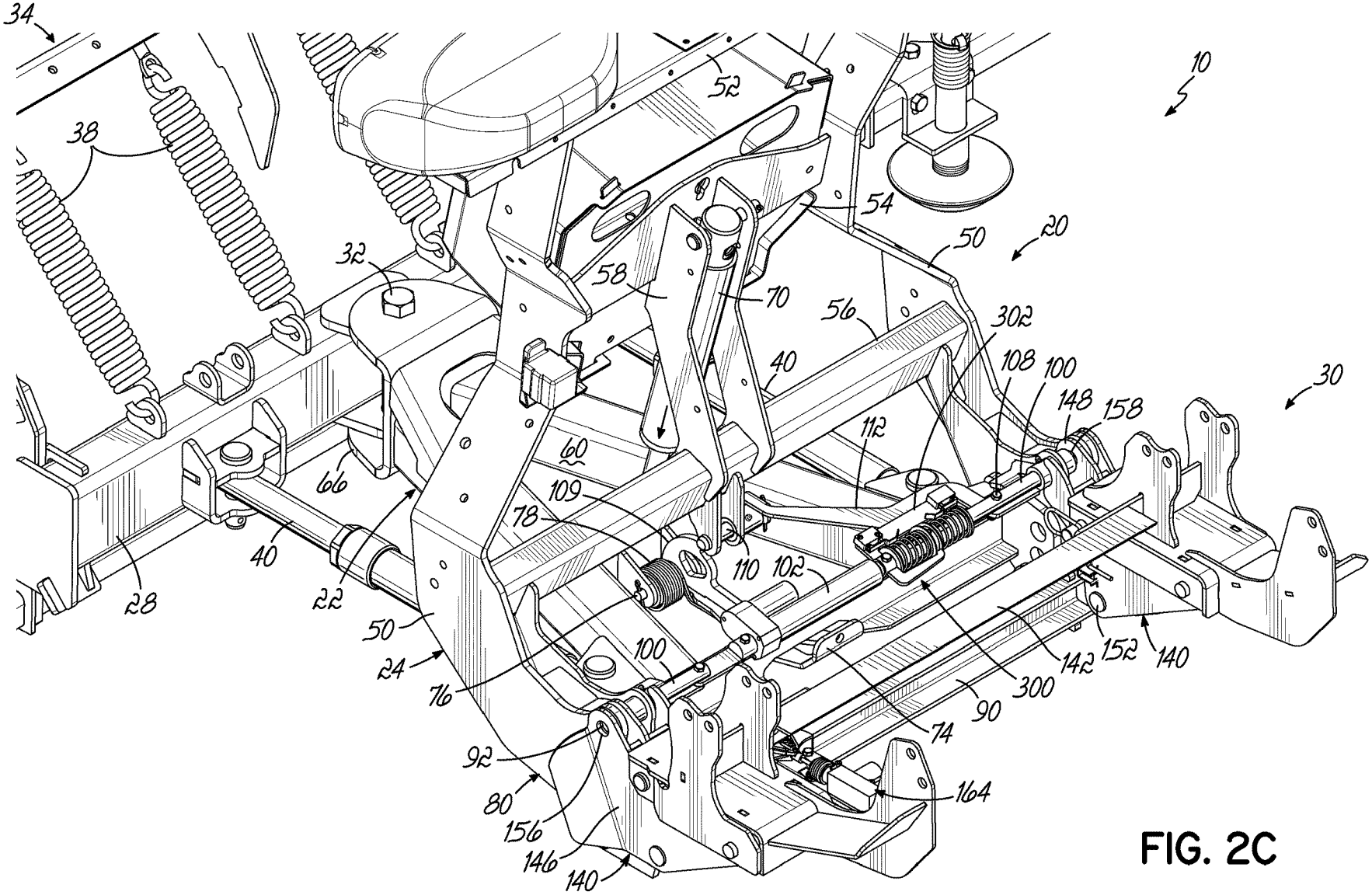

Referring first to FIG. 1, a snow plow and mount assembly 10 of the present invention is illustrated. The assembly 10 comprises a snow plow frame 20 and a mount frame 30. Snow plow frame 20 comprises an A-frame 22 and a lift frame 24 pivoted to one another at 26 for pivoting movement about a generally transverse horizontal lift axis. While the term "A-frame" has been used herein, it is to be understood that other configurations or shapes of frames other than "A's" may be substituted therefore in the practice of the present invention and yet still be within the scope thereof. Accordingly, the term "A-frame" shall be deemed to embrace all such configurations and shapes. A forward end of A-frame 22 is pivoted to a push beam 28 at 32 (FIGS. 2C and 2D, for example) for pivoting movement about a generally vertical axis. Plow blade 34, comprised of a blade moldboard and supporting frame and rib structure, is pivoted to push beam 28 at 36 for pivoting movement about a generally transverse horizontal trip axis. Trip return springs 38 are mounted to the rear side of the blade 34 and to the push beam 28 to return the plow blade 34 to proper plowing orientation after tripping over an obstacle. Hydraulic cylinders 40 are mounted to the push beam 28 and to the A-frame 22 and are for angling the plow blade 34 about the generally vertical axis.

Referring now to FIGS. 1 and 2A-3, lift frame 24 comprises a pair of upstanding frame members 50, and an upper transverse frame member 52 interconnecting the frame members 50, an intermediate transverse frame member 54 interconnecting the frame members 50, and a lower transverse frame member 56 interconnecting the frame members 50. A pair of vertical frame members 58 interconnect the intermediate and lower frame members 54, 56.

Figure 8A:
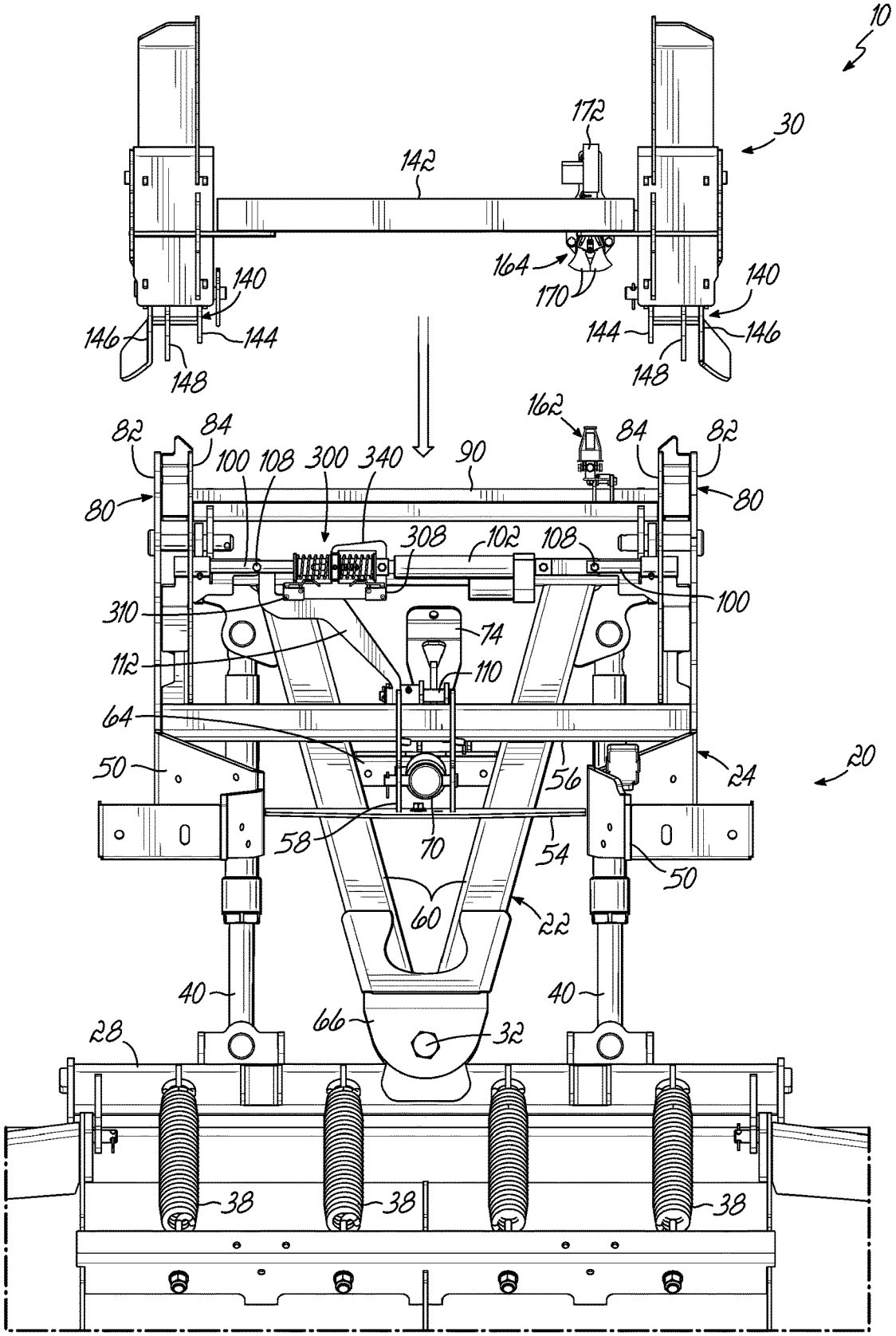
FIGS. 8A-8E are top views of the assembly of FIG. 1 in various stages of hitching the snow plow frame to the mount frame.
Figure 8B:
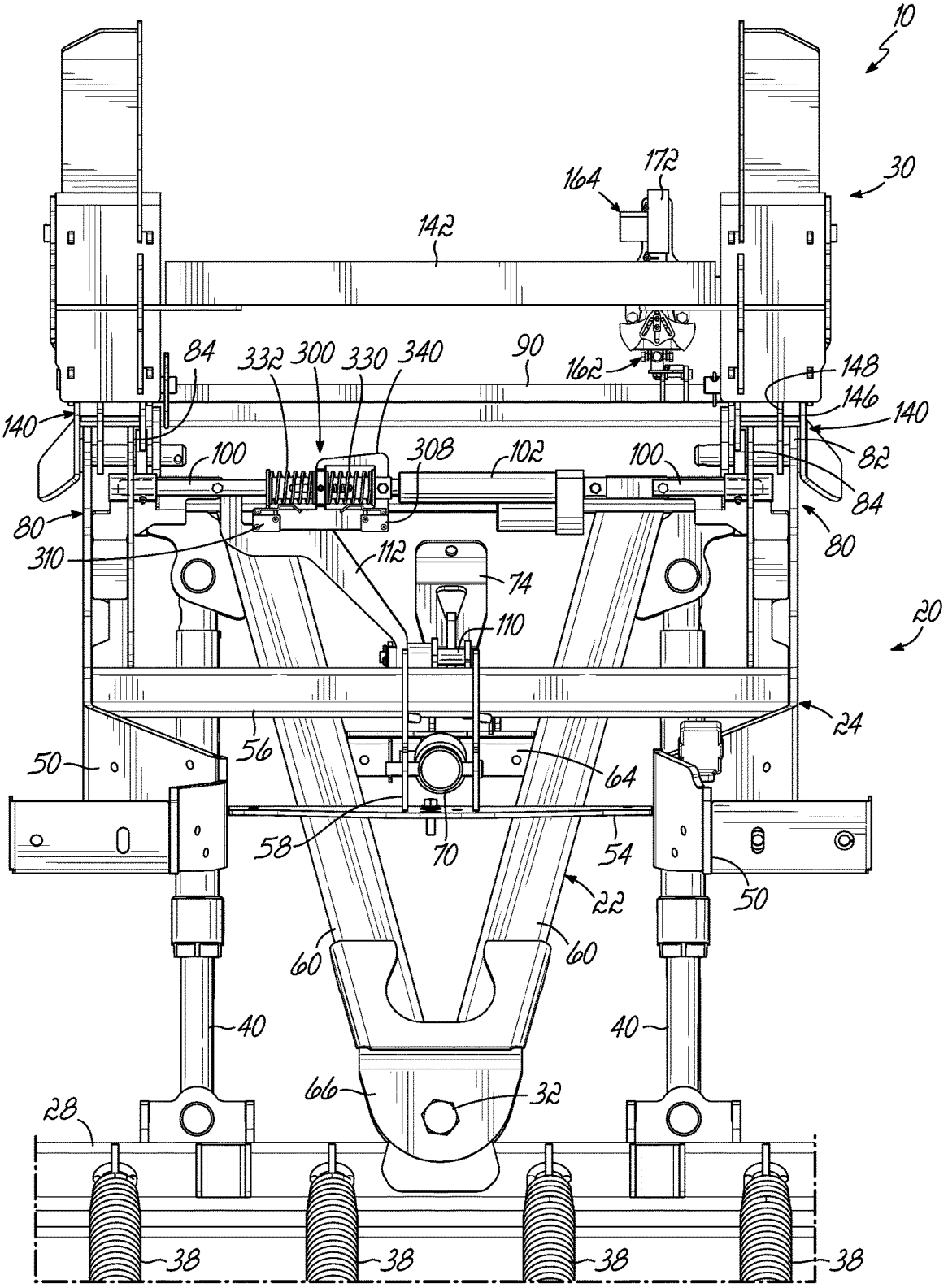
Figure 8C:
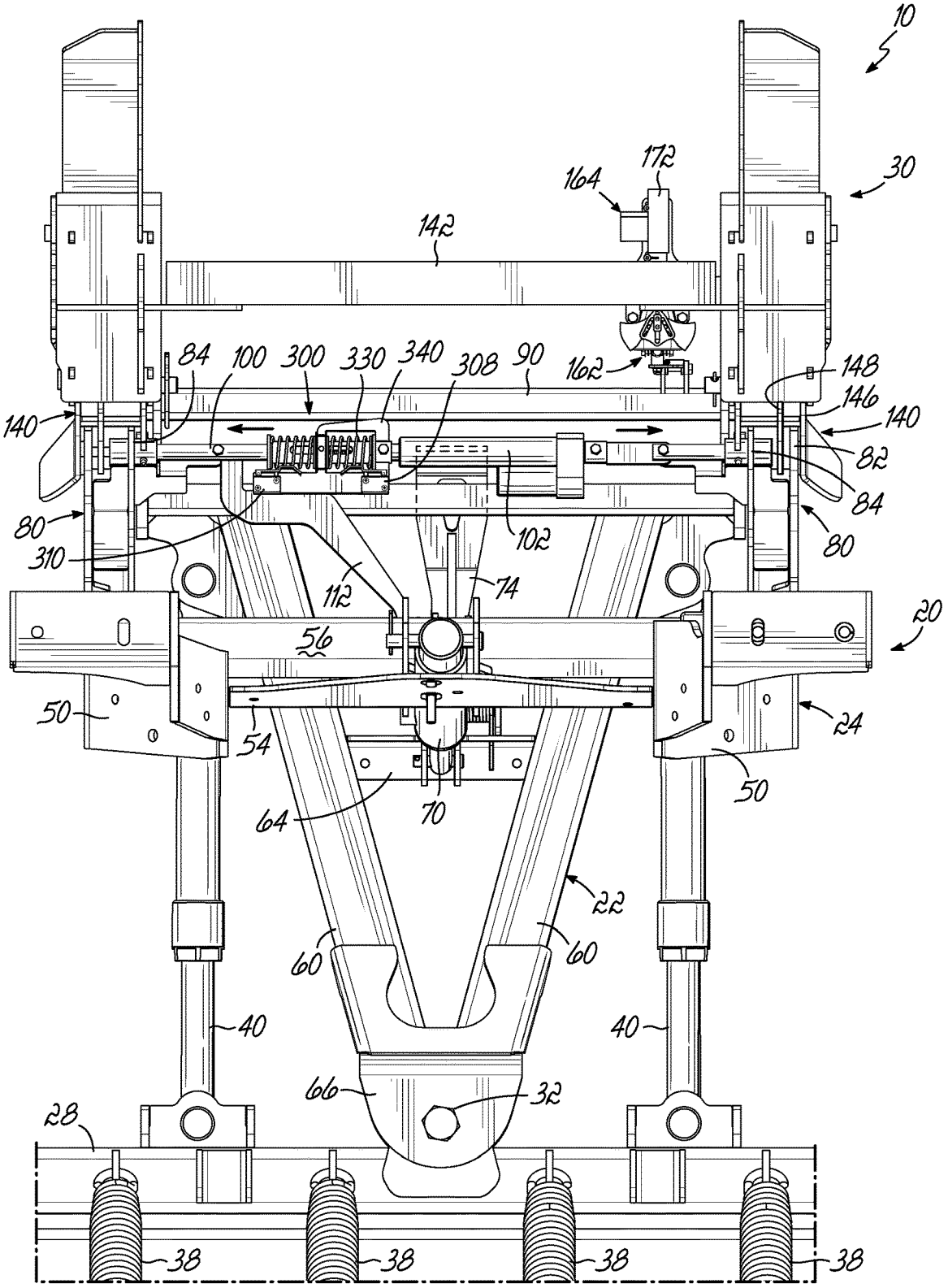
Figure 8D:
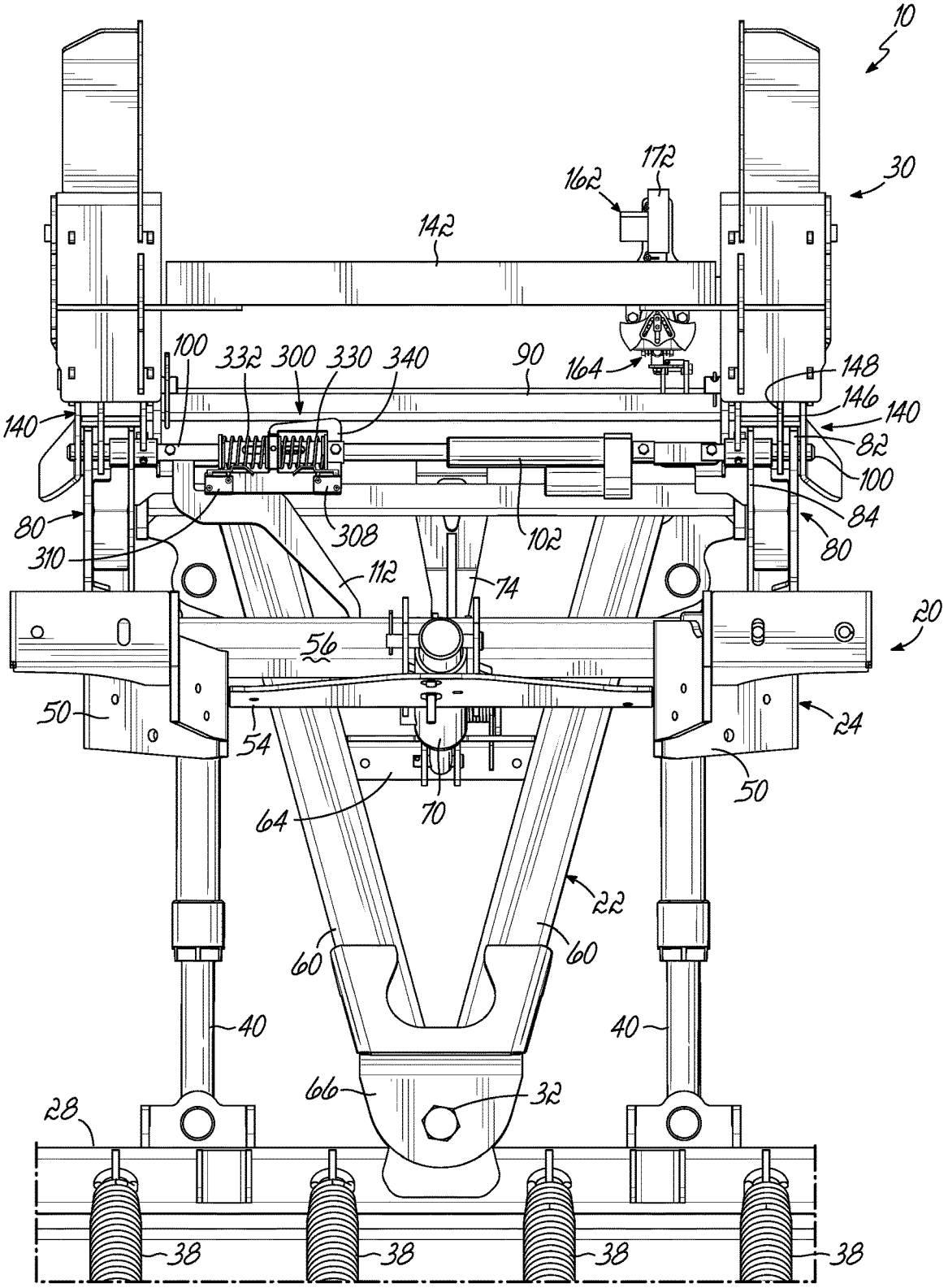
Figure 8E:
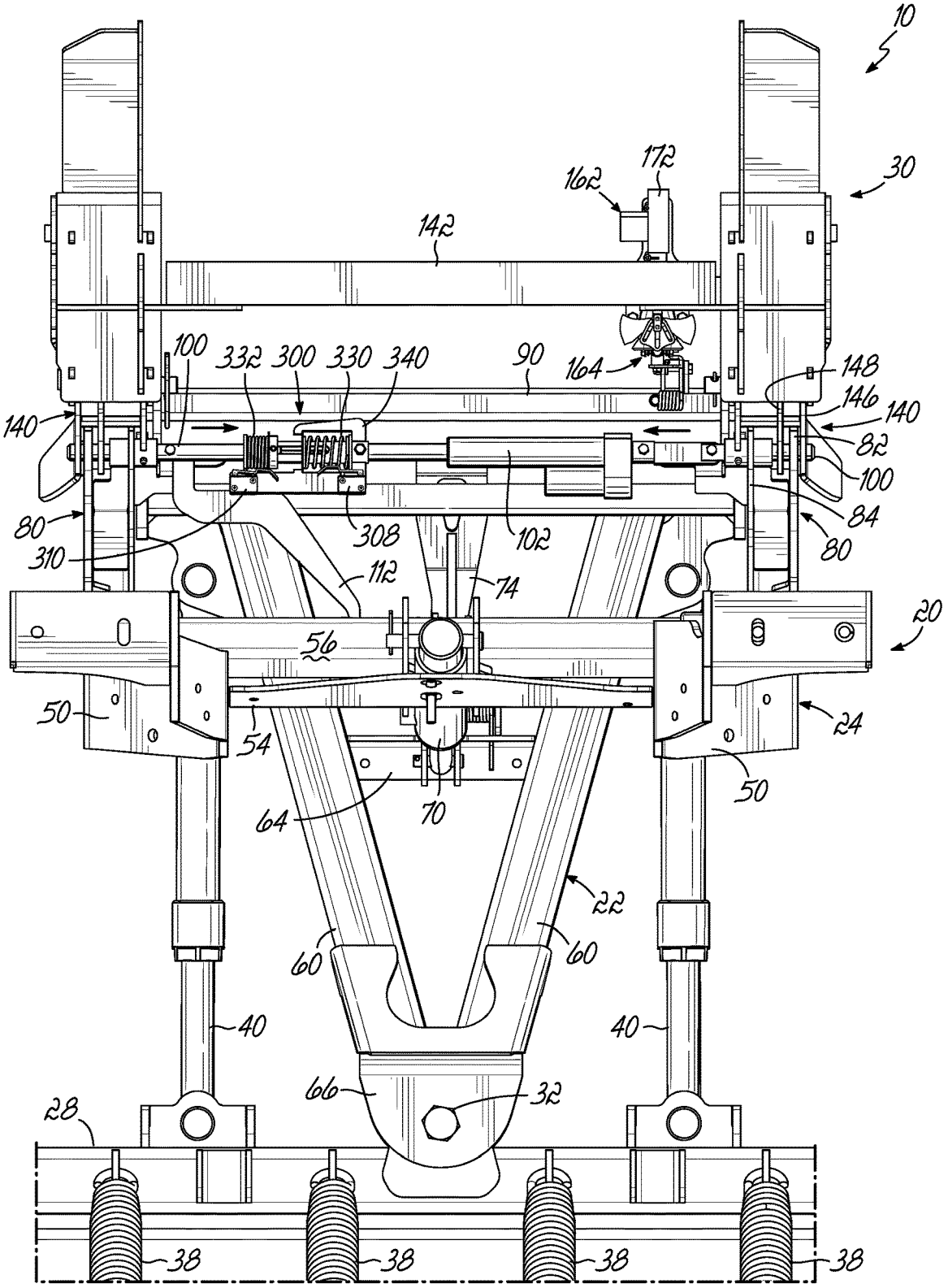

A-frame 22 comprises a pair of side frame members 60 connected together at their forward ends via a clevis 66 and a transverse frame member 62 interconnecting the side frame members 60 at their rearward ends. An angle section 64 (FIG. 8A) interconnects the side frame members 60 between their forward and rearward ends.

A hydraulic cylinder 70 has one end mounted to the angle section 64 of the A-frame 22 and the other end mounted between the vertical frame members 58 of the lift frame 24. A hydraulic motor and pump assembly 72 for powering the hydraulic cylinders 40 and 70 is mounted to the side frame members 50 and the intermediate frame member 54 of the lift frame 24.

A support stand 74 is movably mounted to the A-frame 22, for example for pivoting movement or translational movement or both. As one example, the stand 74 can be pivotally mounted to the angle 64 at 76. Stand 74 pivots to an extended ground or pavement contacting and snow plow frame 20 supporting position and to a retracted position at which the stand 74 does not contact the ground or pavement and does not support the plow frame 20. The stand 74 is biased, for example spring biased, to the retracted position by a torsion spring 78. As used herein, the terms "ground" and "pavement" shall be deemed to be interchangeable and shall be deemed to embrace such surfaces whether the surfaces are snow and/or ice covered or bare.

The lower end of each upstanding frame member 50 of the lift frame 24 has a rearwardly extending arm 80. Each arm 80 can be, but is not necessarily required to be, comprised of a pair of spaced apart plates 82, 84. The end of each arm 80, and as illustrated the end of each plate 82, 84, has a flat 86 formed thereon and a forwardly extending recess 88 formed therein above the flat 86. The inner plates 84 of the arms 80 are interconnected with a transverse frame member 90. The plates 82, 84 making up each arm 80 have holes 92, 94, respectively. The holes 92, 94 have a latch pin 100 that travels in them from an inward unlatched position to an outward latched position.

The latch pins 100 are connected to opposite ends of an electric linear actuator 102. Each latch pin 100 has a guide bracket 104 associated therewith cantilevered off of its respective plate 84. Each guide bracket 104 includes a transversely oriented guide slot 106 therein. Each guide slot 106 guides the lower end of a connecting bolt or pin 108 connecting one of the latch pins 100 to a respective end of the linear actuator 102, to guide and assist the latch pins 100 in moving through the various latch holes.

The support stand 74 has a cam surface 109 thereon. A cam actuating pin 110 is mounted to the lift frame 24 for translational movement in a transverse direction between an extend position and a retracted position. A link 112 has one end connected to an end of the pin 110 and the other end connected to the linear actuator 102.

Mount frame 30 is adapted to be mounted to the frame of a pickup truck generally below and generally behind the front bumper, and has a pair of spaced apart receivers 140 interconnected by transverse frame member 142. Each receiver 140 has an inner plate 144, an outer plate 146, and an intermediate plate 148. Each receiver 140 has a hitch pin 152 positioned in a lower region and interconnecting the three plates 144, 146, 148 making up the receiver 140. The outer plates 146 have a latch hole 156 therein, and the intermediate plates 148 have a latch hole 158 therein. Each inner plate 144 has a recess 150 therein which partially encircles its respective latch pin 100 when latched.

Note that while the lift frame 24 has been described as having the arms 80 and the mount frame 30 has been described as having the receivers 140, it is within the scope of the invention that the lift frame 24 has the receivers 140 and the mount frame 30 has the arms 80. Note also that while the lift frame 24 has been described as having a pair of arms 80 and the mount frame 30 has been described as having a pair of receivers 140, it is within the scope of the invention that the snow plow and mount assembly has a single arm and a single receiver. For example, the single arm could be a plate spanning the width of the lift frame 24 and the receiver could be a box section or a pair of facing C-sections, etc. spanning the width of the mount frame 30, and sized for receiving the plate. As well, the single arm could be on either the lift frame 24 or the mount frame 30, and the receiver could be on the other of lift frame 24 and the mount frame 30.

Figure 4A:
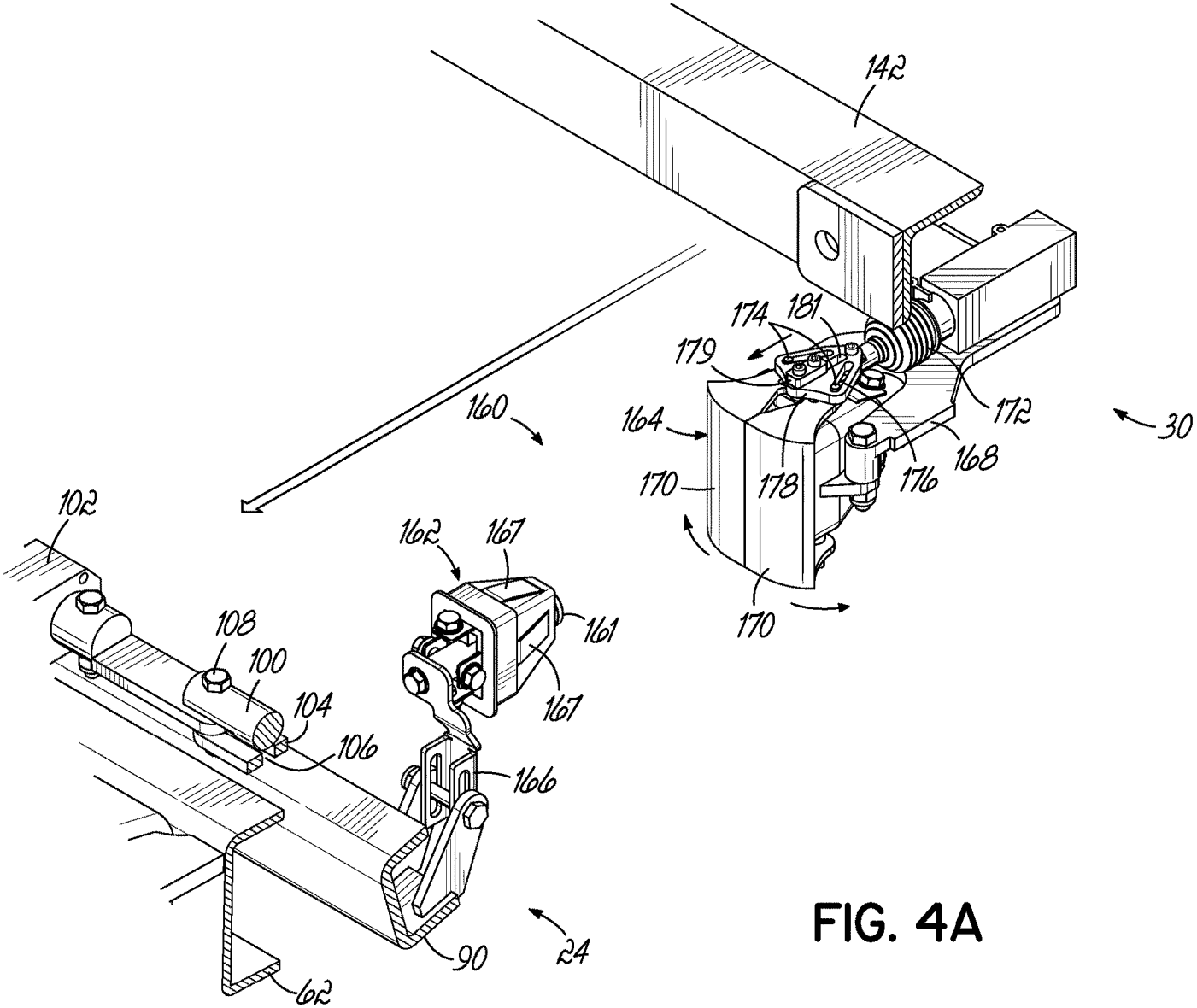
FIGS. 4A-4C are front left top perspective views of the vehicle to snow plow electrical connector in various states of connection.
Figure 4B:
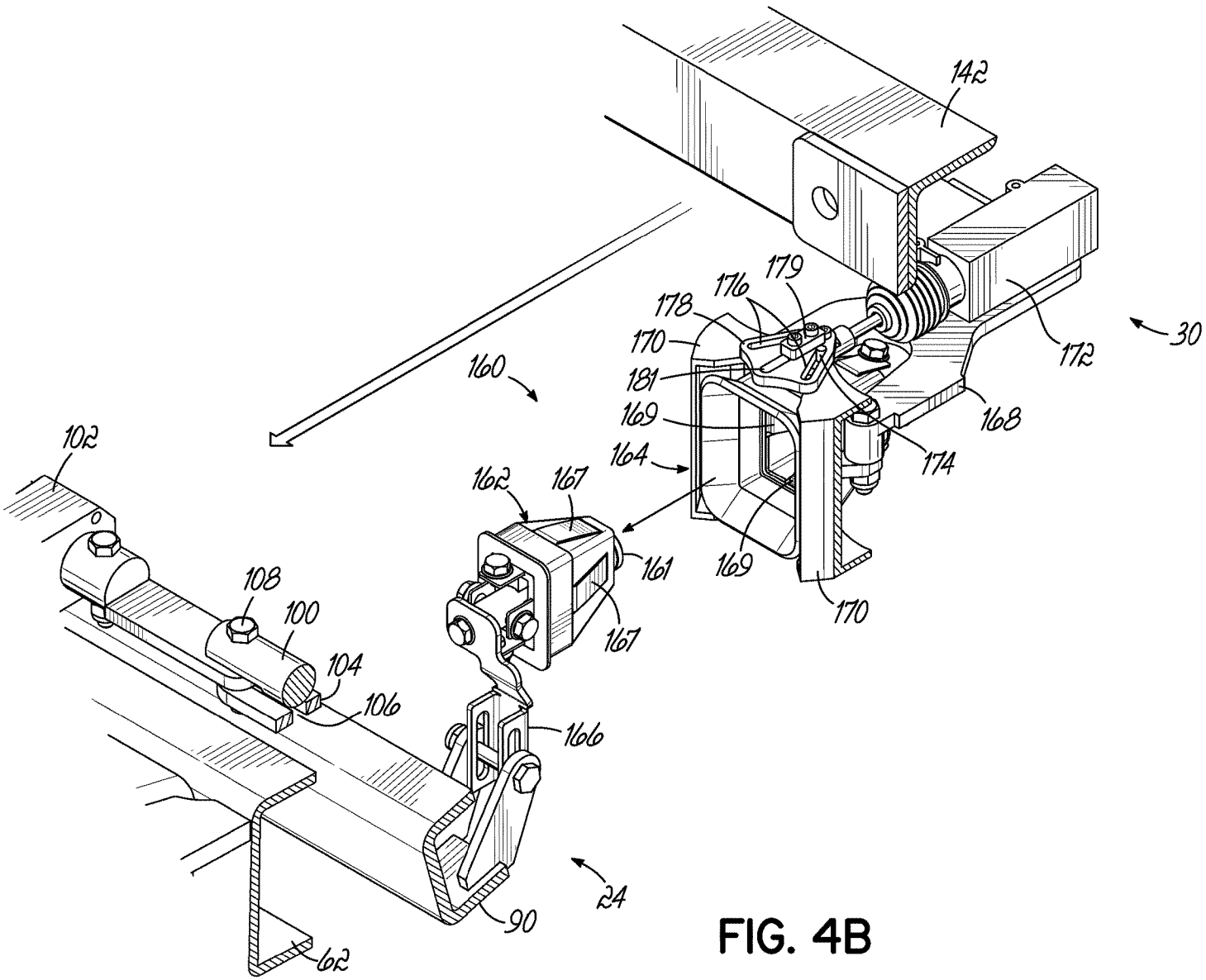
Figure 4C:
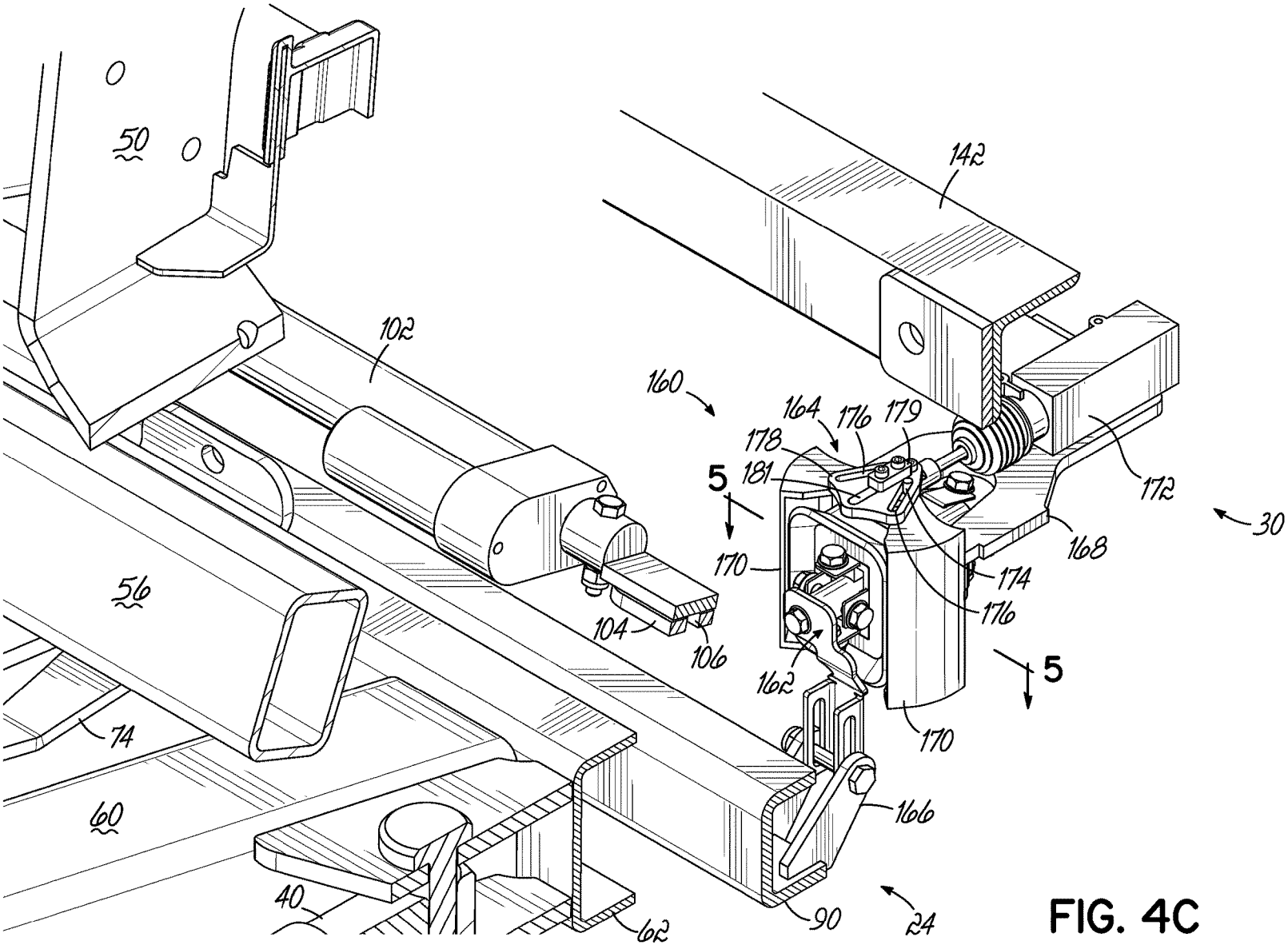
Figure 5:
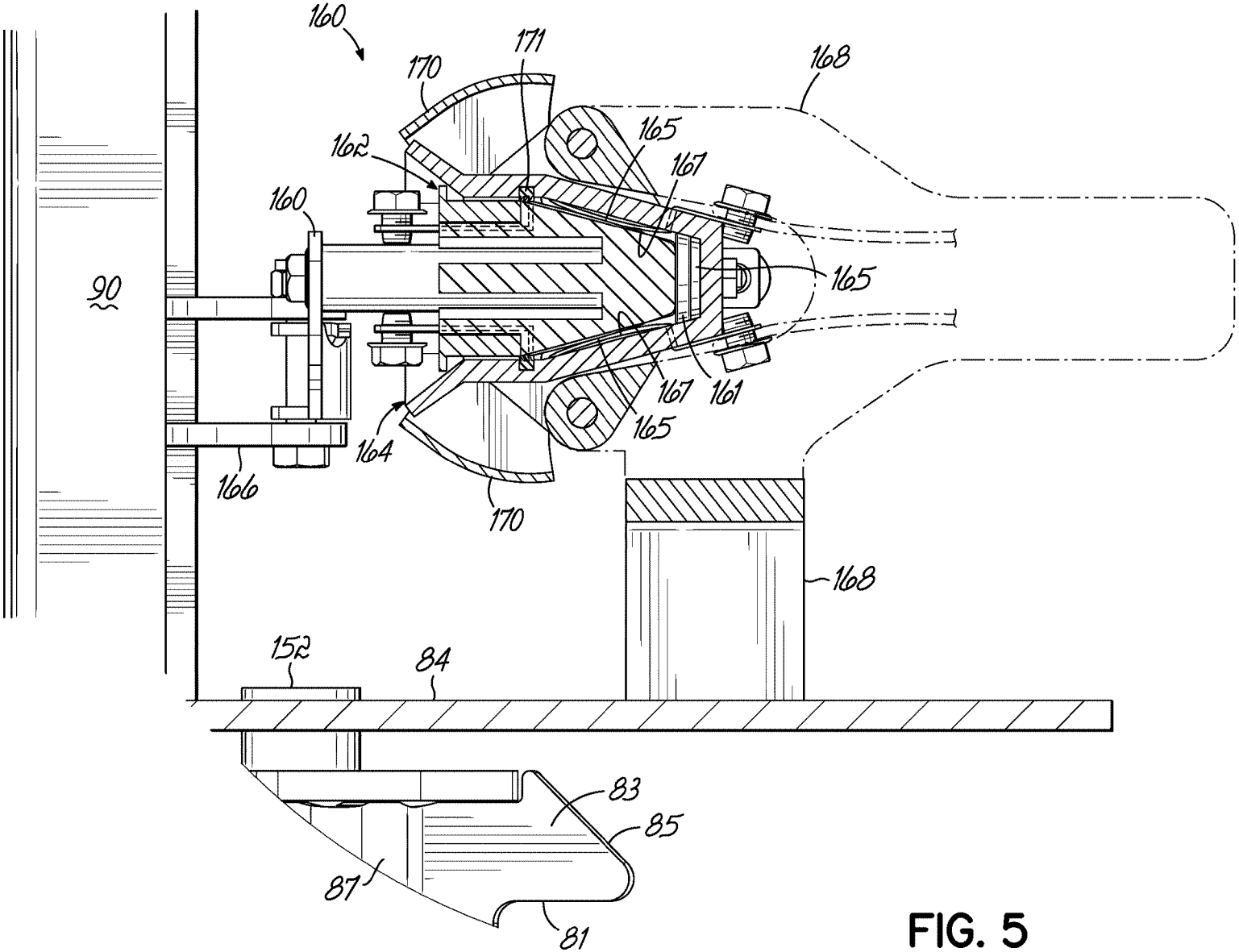
FIG. 5 is a cross-sectional view taken along line 5-5 in FIG. 4C.
Figure 6:
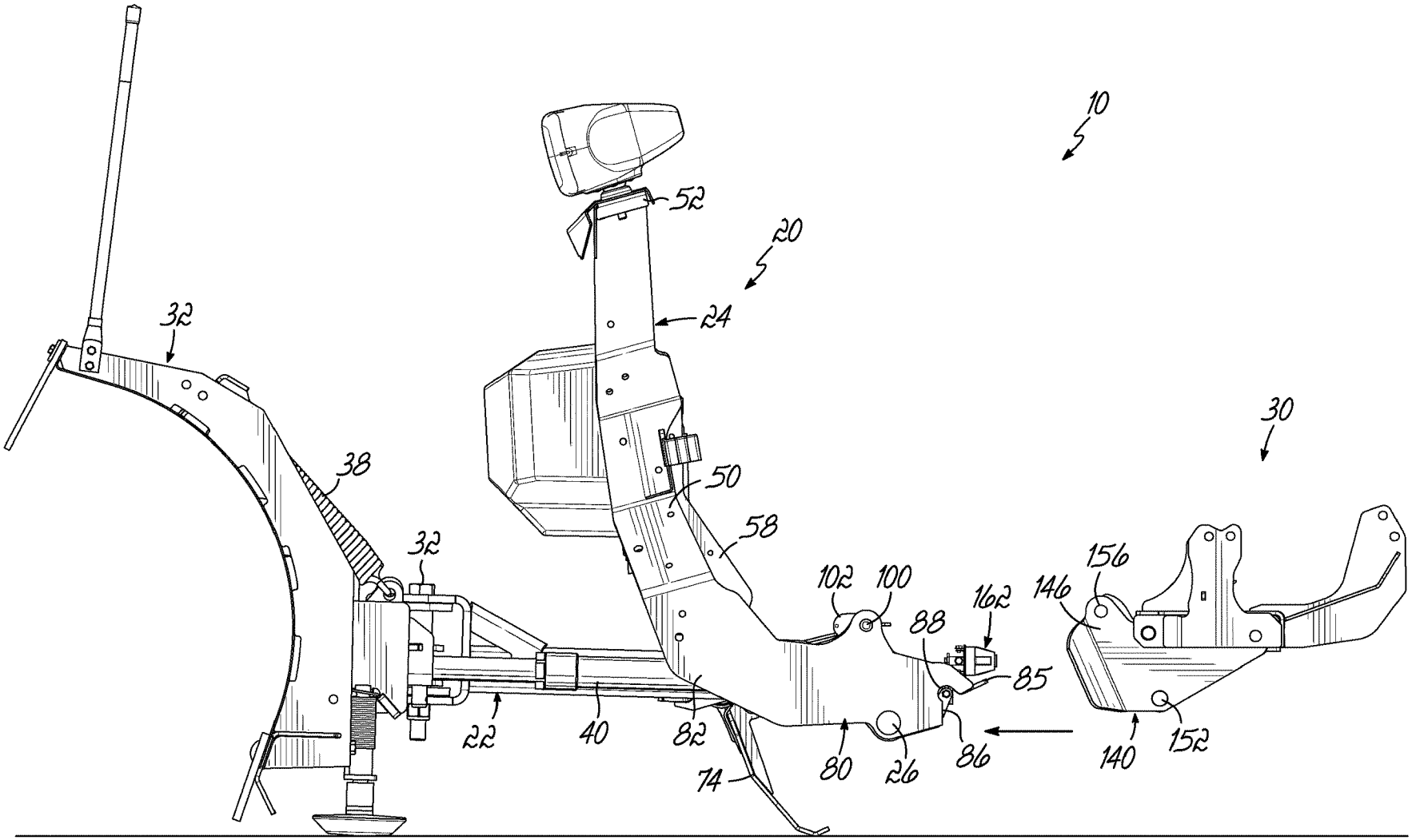
FIG. 6 is a left side view of the assembly of FIG. 1.
Figure 7A:
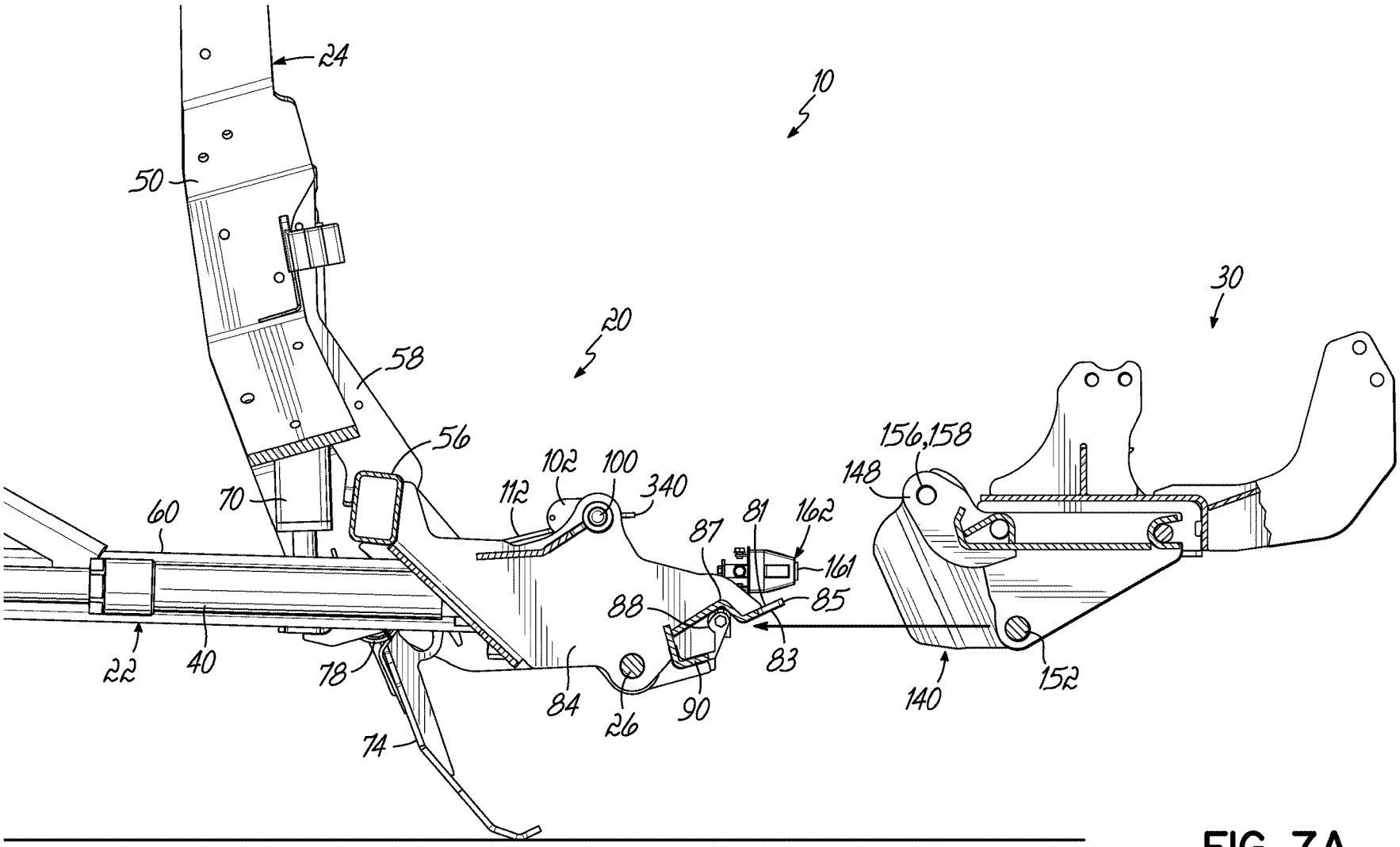
FIGS. 7A-7C are enlarged left side views of the assembly of FIG. 1 in various stages of hitching the snow plow frame to the mount frame.
Figure 7B:
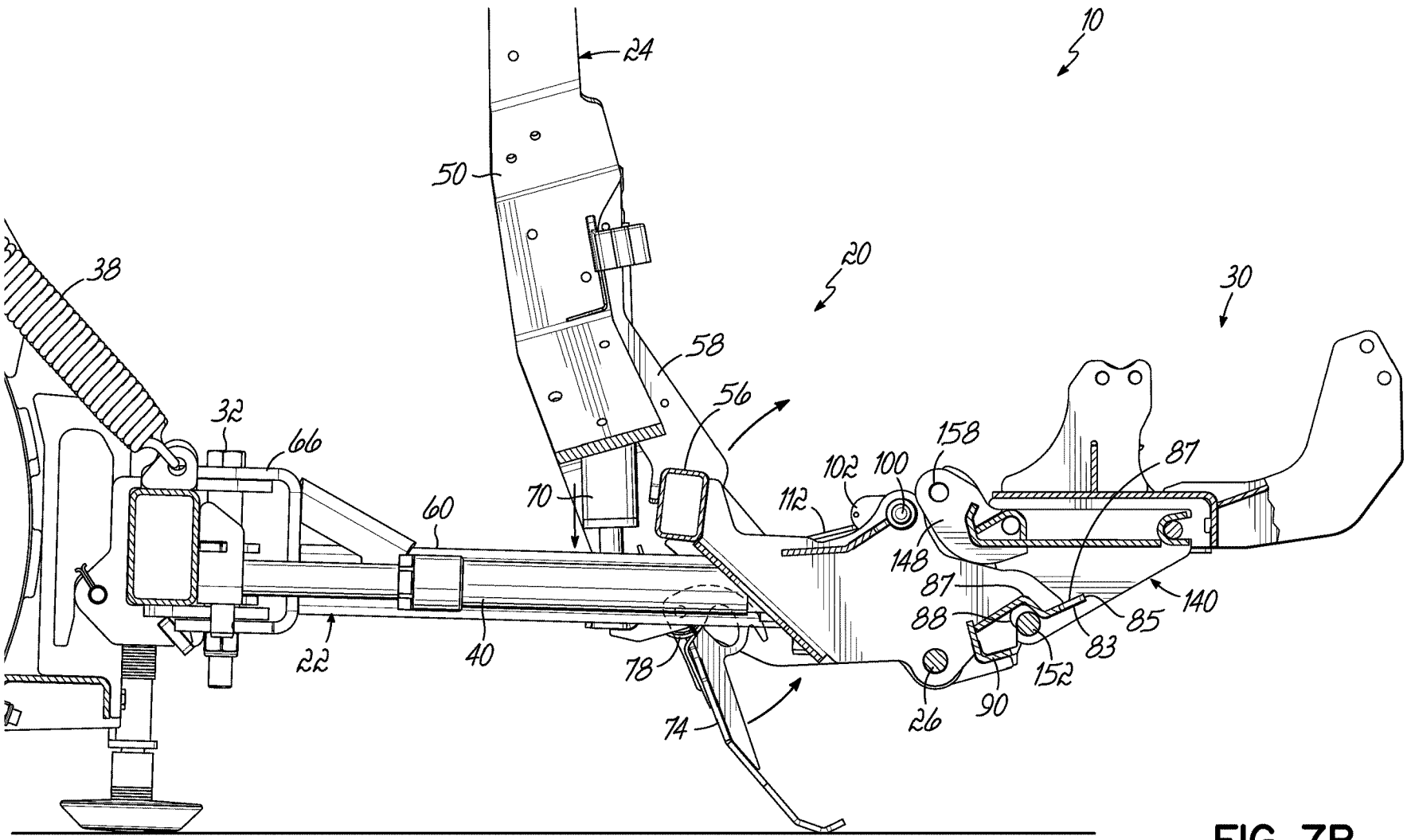
Figure 7C:
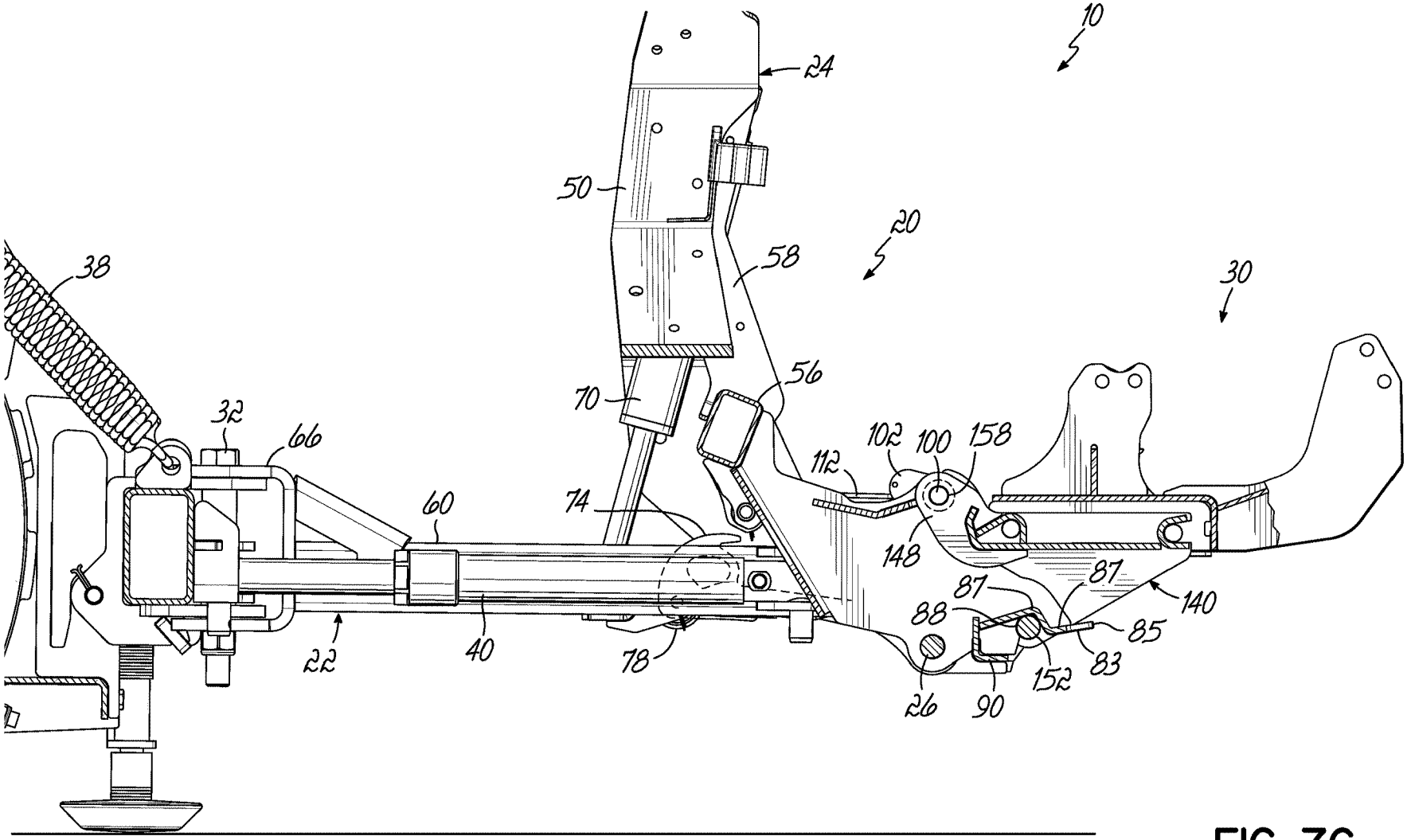

Referring to FIGS. 4A-5, a connector 160 has a male portion 162 mounted on transverse frame member 90 of lift frame 24 and a female portion 164 mounted on transverse frame member 142 of mount frame 30 (though the male and female portions 160 and 162 could be reversed on the transverse members 90 and 142). Connection of the male and female portions 162 and 164 and their respective electrical contacts 167 and 169 supplies electrical power to the hydraulic motor and pump assembly 72 and electric linear actuator 102 from the vehicle electrical system.

When the arms 80 are received in the receivers 140 the male and female connector portions 162, 164 connect to establish the electrical circuit via contacts 167, 169. As illustrated, the connector portions 162, 164 can be matingly tapered to facilitate connection in the event of misalignment. Each connector portion 162, 164 can include a respective permanent magnet 163, 165 to maintain connection of the connector portions 162, 164 during the shock and vibration of operation. A sealing element 171 helps to keep debris from entering the interior of the connector 160 and assists in keeping the contacts 167, 169 clean so as to establish and maintain electrical connectivity. The connector portions 162, 164 can be mounted to the lift frame 24 and the mount frame 30 in such a way to permit a degree of relative motion between the connector portions 162, 164 and the lift frame 24 and the mount frame 30 without breaking the electrical circuit established between the connector portions 162, 164. For example, a bracket 166 can be used to mount the male connector portion 162 to transverse member 90, which bracket 166 can include as many as six degrees-of-freedom of relative movement between the connector 162 and transverse member 90. Similarly, a bracket 168 can be used to mount the female connector portion 164 to transverse member 142, which bracket 168 can also include as many as six degrees-of-freedom of relative movement between the connector 164 and the transverse member 90. The relative movement of each connector portion 162, 164 relative to its respective transverse frame member 90, 142 can be supplied via the use of bolts riding in slots, springs, resilient material (such as elastomeric material, etc.), and the like.

The female connector portion 164 can further include a pair of pivoting covers 170 which, when closed, prohibit entry of contaminates into the female connector portion 164, and when open, permit the female connector portion 164 to connect to the male connector portion 162. An electric linear actuator 172, energized by the electrical system of the vehicle and activated from inside the cab of the vehicle, opens the covers 170 prior to attachment of the snow plow frame 20 to the mount frame 30, and closes the covers 170 subsequent to detachment of the snow plow frame 20 from the mount frame 30. Each cover 170 includes a pin 174 that rides in a respective angled guide slot 176 in a plate 178 connecting the actuator 172 to the covers 170. A retaining guide block 179 is attached to a forward end of the linear actuator 172 via fasteners. The plate 178 also has a centrally located and longitudinally oriented guide slot 181. Guide block 179 slides longitudinally relative to the guide slot 181. Retraction of the actuator 172 causes closing of the covers 170 as pins 174 ride forwardly in slots 176; extension of the actuator 172 causes opening of the covers 170 as pins 174 ride rearwardly in slots 176.

Referring now to FIGS. 2A-2D, 6, 7A-7C, and 8A-8D, hitching of the mount frame 30 to the snow plow frame 20 will be explained. With the plow frame 20 supported by stand 74 and with the mount frame 30 mounted on the truck, an operator activates a connector cover switch from inside the cab to energize actuator 172 to open the covers 170 on female connector portion 164 and drives the truck towards the plow frame 20. As the arms 80 are received in receivers 140, the connectors 162 and 164 connect, and the hitch pins 152 in receivers 140 strike the flats 86 on the arms 80. The operator then activates a lift switch from inside the cab to energize the hydraulic cylinder 70 pivoting the lift frame 24 clockwise (as viewed in FIGS. 7B and 7C) raising the lift frame 24 until the hitch pins 152 in the receivers 140 are received in the recesses 88 in the arms 80, and further until the holes 92, 94 in the plates 82, 84 of the arms 80 are aligned with the holes 156, 158 in the plates 146, 148 of the receivers 140. Alternatively, the hydraulic cylinder 70 could be automatically energized without the operator activating a lift switch. Once the holes 92, 94 in the plates 82, 84 of the arms 80 are aligned with the holes 156, 158 in the plates 146, 148 of the receivers 140, the hydraulic cylinder 70 is de-energized. The hydraulic cylinder 70 can be de-energized either manually by the operator activating the lift switch again, or automatically when the arms 80 reach their rotational limit within the receivers 140 thus stalling the hydraulic cylinder 70 (and coinciding with alignment of the holes 92, 94 in the plates 82, 84 of the arms 80 with the holes 156, 158 in the plates 146, 148 of the receivers 140).

Initially, cam actuating pin 110 is in its deployed position, and in contact with the cam surface 109 on the stand 74. As the lift frame 24 pivots, upward movement of the cam actuating pin 110 allows the bias of the spring 78 on the stand 74 to pivot the stand 74 counterclockwise (as viewed in FIGS. 7B and 7C) to the retracted position.

Figure 2D:
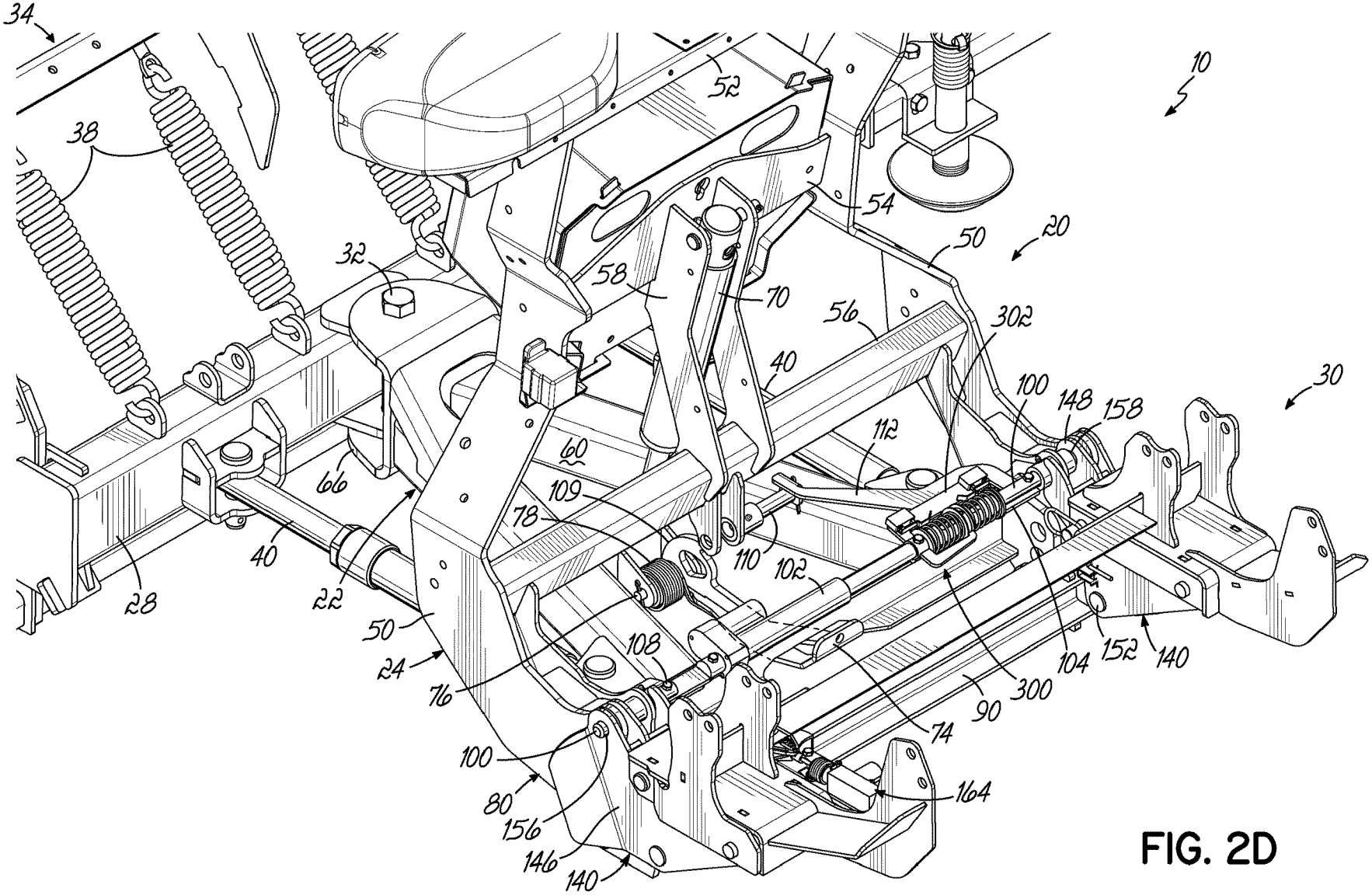
Figure 3:
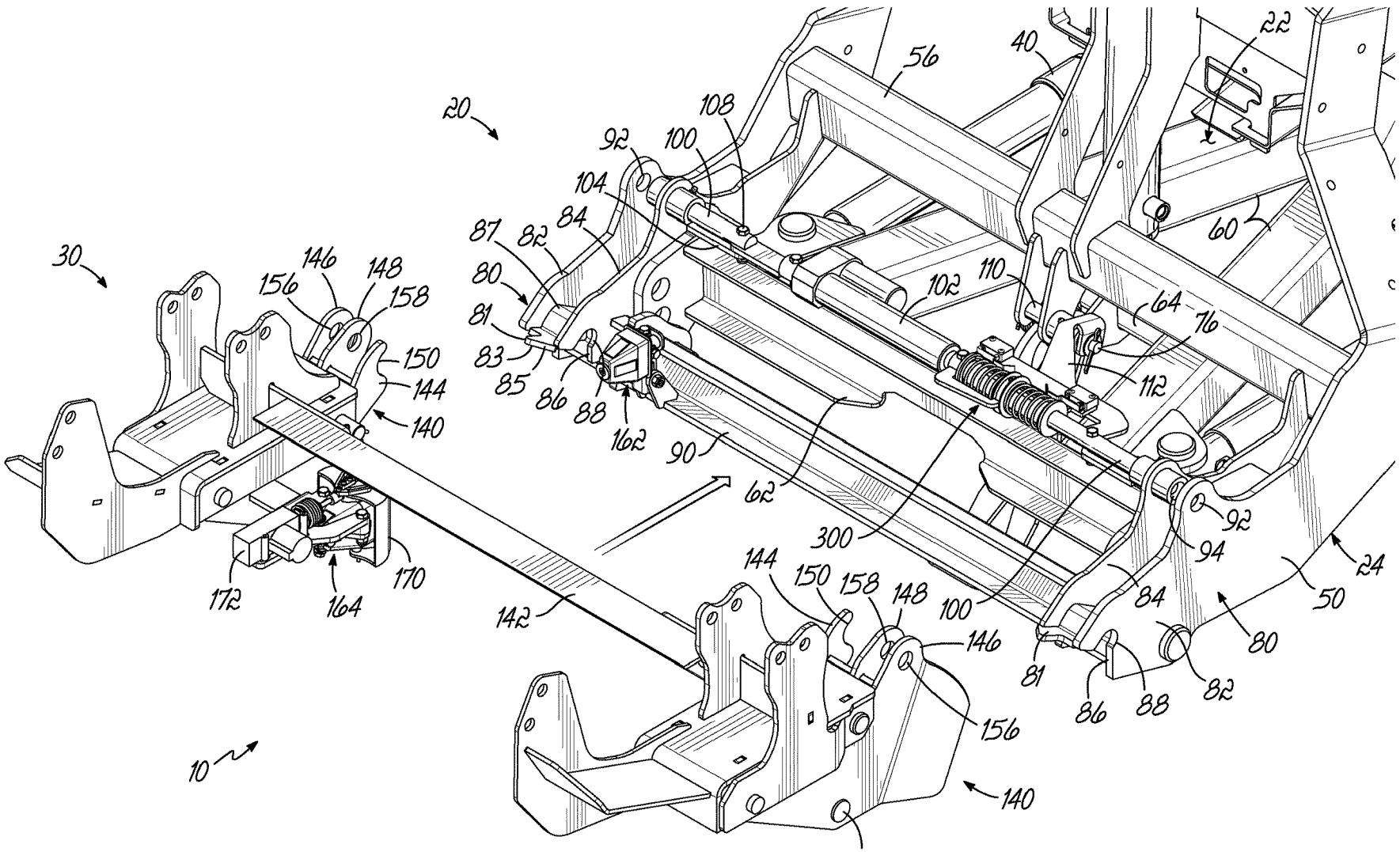
FIG. 3 is a rear right top perspective view similar to FIG. 2A.

With the holes 92, 94, 156, 158 aligned, the operator activates a latch switch from inside the cab to energize and extend the electric linear actuator 102 to move the latch pins 100 outwardly through holes 94, 148, 92, and 146 in that order to the latched position, thereby removably securing the plow frame 20 to the mount frame 30 (FIG. 2D). As the actuator 102 moves the latch pins 100 to the latched position, the actuator 102 also moves the link 112 which moves the pin 110 to the retracted position (FIG. 2D). This prevents the pin 110 from contacting the stand 74 during upward pivoting of the A-frame 22 and blade 34 thus preventing inadvertent movement of stand 74 to the extended position during plowing.

Unhitching the plow frame 20 from the mount frame 30 is essentially the reverse of the above. The truck is parked. The operator activates the lift switch to retract the hydraulic cylinder 70 to lower the plow blade 34 until it is supported on the ground or pavement. The operator activates the latch switch to retract the linear actuator 102 thereby moving the latch pins 100 inwardly through holes 146, 92, 148, and 94 in that order to the unlatched position. Retraction of the actuator 102 to the unlatched position moves the pin 110 to its extended position. The operator again activates the lift switch to further retract the hydraulic cylinder 70 pivoting the lift frame 24 counterclockwise (as viewed in FIGS. 7B and 7C) until the hitch pins 152 in the receivers 140 are clear of the recesses 88 in the arms 80. As the lift frame 24 pivots, the cam actuating pin 110 moves downwardly and contacts the cam surface 109 of the stand 74, whereupon further pivoting of lift frame 24 causes the pin 110 to pivot the stand 74 clockwise (as viewed in FIGS. 7B and 7C) to the extended position against the bias of the spring 78. Once the stand 74 is supporting the plow frame 20 on the ground or pavement, the operator again activates the lift switch to de-energize the hydraulic cylinder 70. The operator then backs the vehicle away from the plow frame 20, which disconnects the connector 160. Finally, the operator activates the connector cover switch to close the covers 170 on the female connector portion 164 of the connector 160.

As shown in FIGS. 1, 2A-2D, 6, and 7A-7C, the plow frame 20 and mount frame 30 are generally aligned vertically relative to one another in that hitch pins 152 are generally the same height as flats 86. In the event that the plow frame 20 is lower than the mount frame 30, structure is provided to raise the plow frame 20 relative to the mount frame 30 during initial contact of mount frame 30 with plow frame 20 so that hitch pins 152 are nonetheless received in recesses 88. More particularly, and referring to FIGS. 1, 2A, 3, 6, and 7A-7C, each arm 80 includes a guide plate 81 positioned between plates 82, 84. Each guide plate 81 includes a downwardly and forwardly sloping generally planar section 83 having a transversely tapered free end 85, and a curved section 87 that generally matches the curvature of recess 88 and which curves above and partially forwardly around recess 88. In the event that the plow frame 20 is lower than the mount frame 30, hitch pins 152 will strike planar sections 83 and as the vehicle moves forwardly, continued forward movement of pins 152 will cam plates 83 upwardly until the pins 152 reach the recesses 88 at which time the plow frame 20 will drop such that the pins 152 are received in the recesses 88. In addition, the transversely tapered free end 85 of each guide plate 81 helps to position the plates 81 between their respective receiver plates 144, 146 in the event that there is any transverse misalignment between the plow frame 20 and mount frame 30.

The above description generally assumes that the holes 92, 94 in the plates 82, 84 of the arms 80 are aligned with the holes 156, 158 in the plates 146, 148 of the receivers 140 during latching and unlatching, i.e. the best-case scenario. In all likelihood, there will be some misalignment between the arms 80 and receivers 140, the result being that the latch pins 100 will bind up during extension by the actuator 102 to the latched position or during retraction by the actuator 102 to the unlatched position. Accordingly, the assembly preferably includes various sensors working in tandem with the actuators, and a controller which receives signals from the sensors and which controls the actuators based on those signals, to accomplish latching and unlatching.

Figure 12:
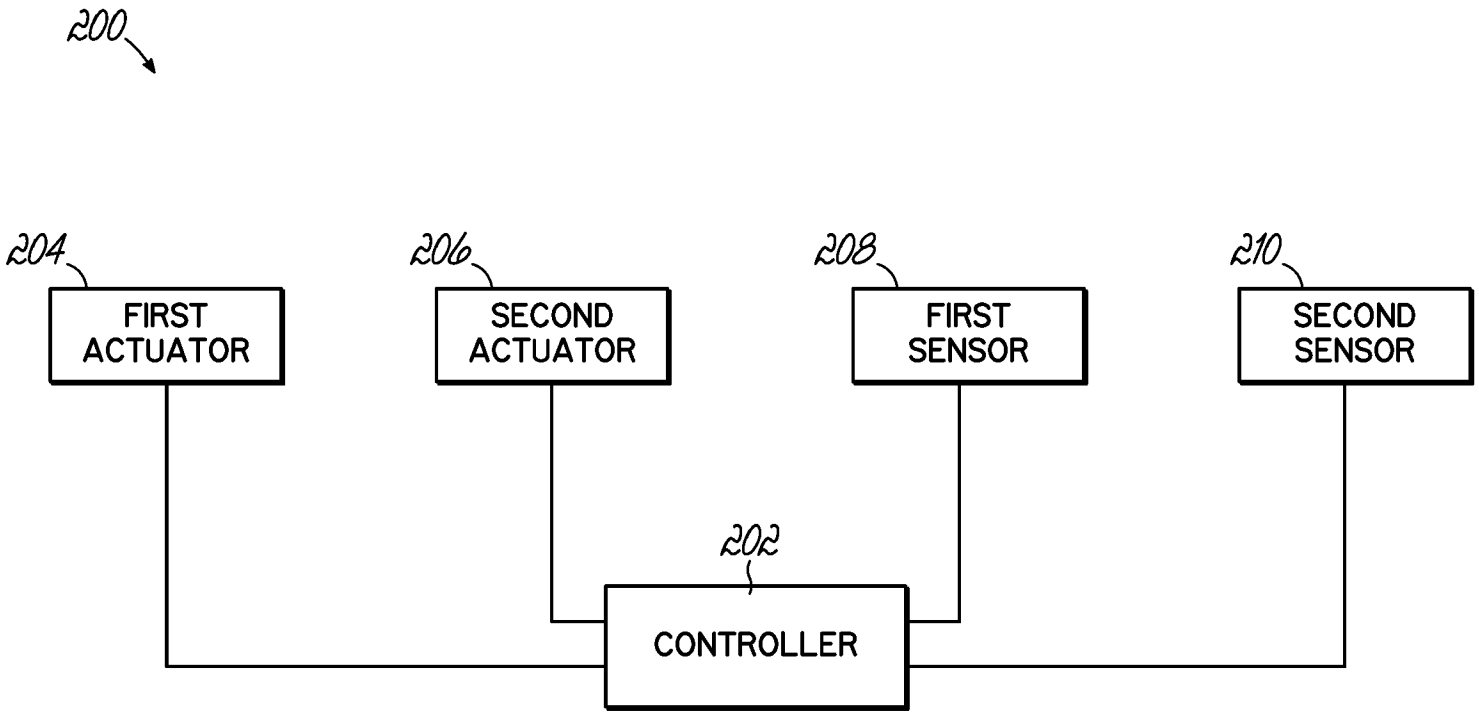
FIG. 12 is a block diagram of the control system of the snow plow and mount assembly.
Figure 13:
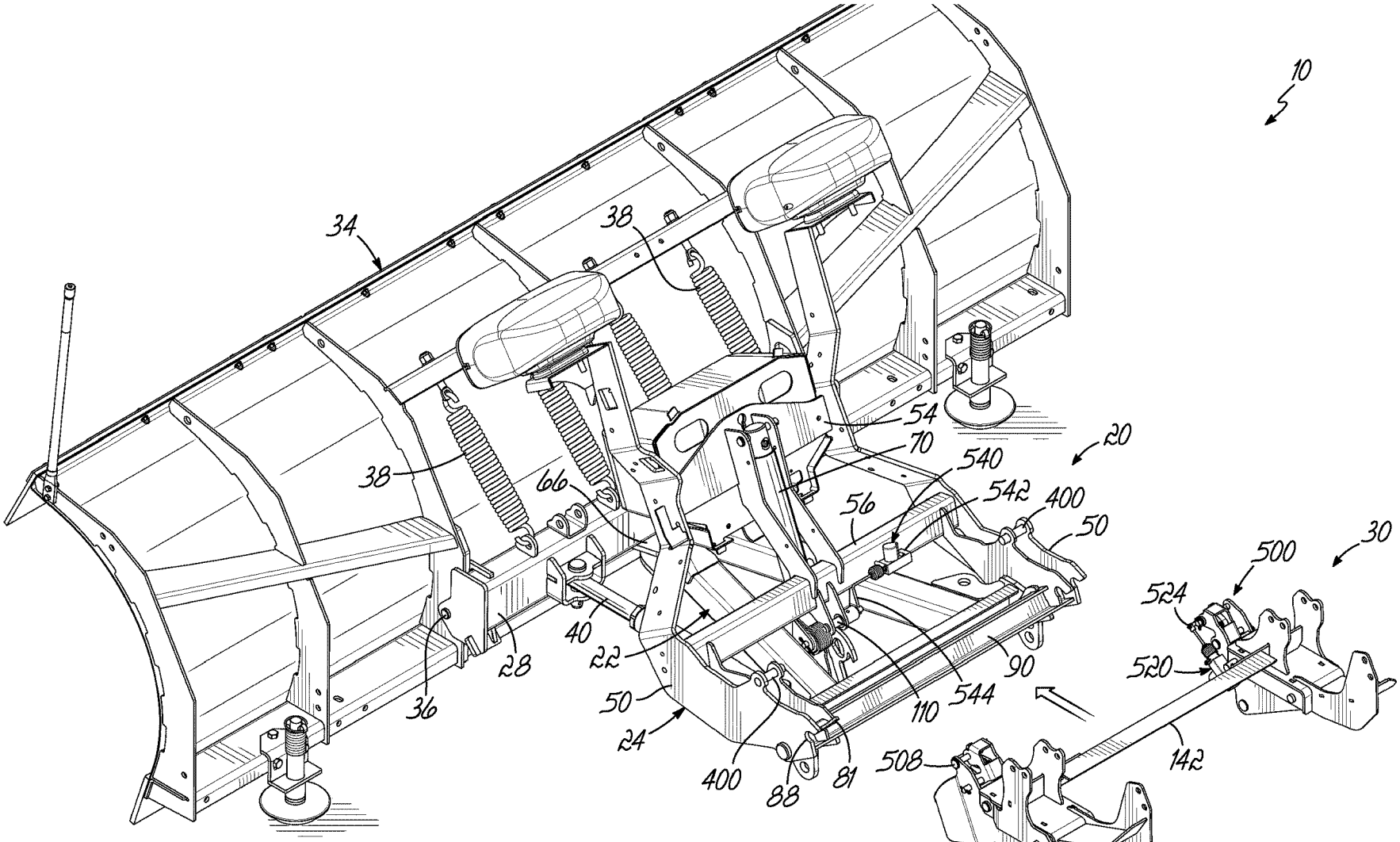
FIG. 13 is a rear left top perspective view of an alternative embodiment of the snow plow and mount assembly of the present invention.
Figure 14:
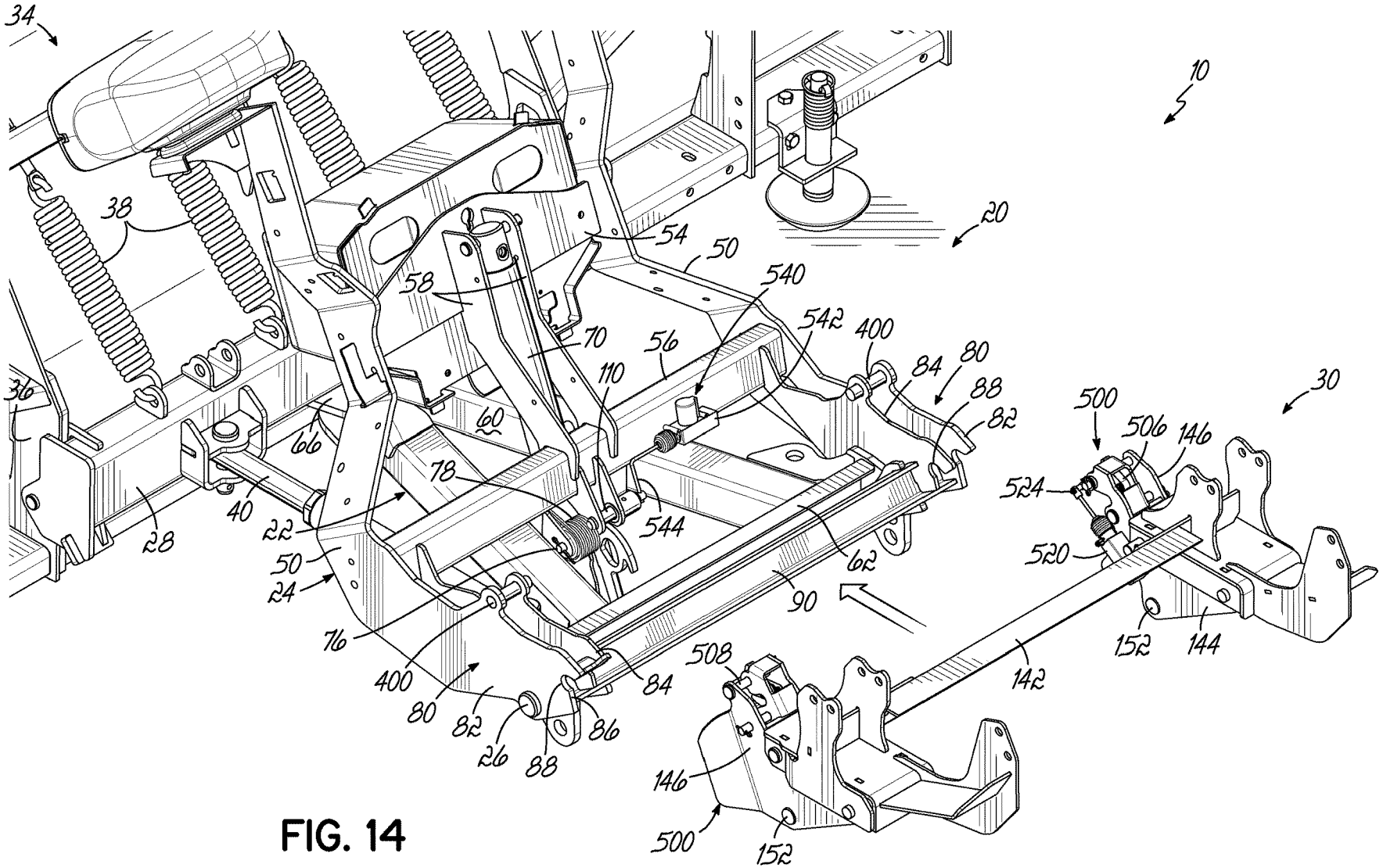
FIG. 14 is an enlarged rear left top perspective view of the assembly of FIG. 13.
Figure 15A:
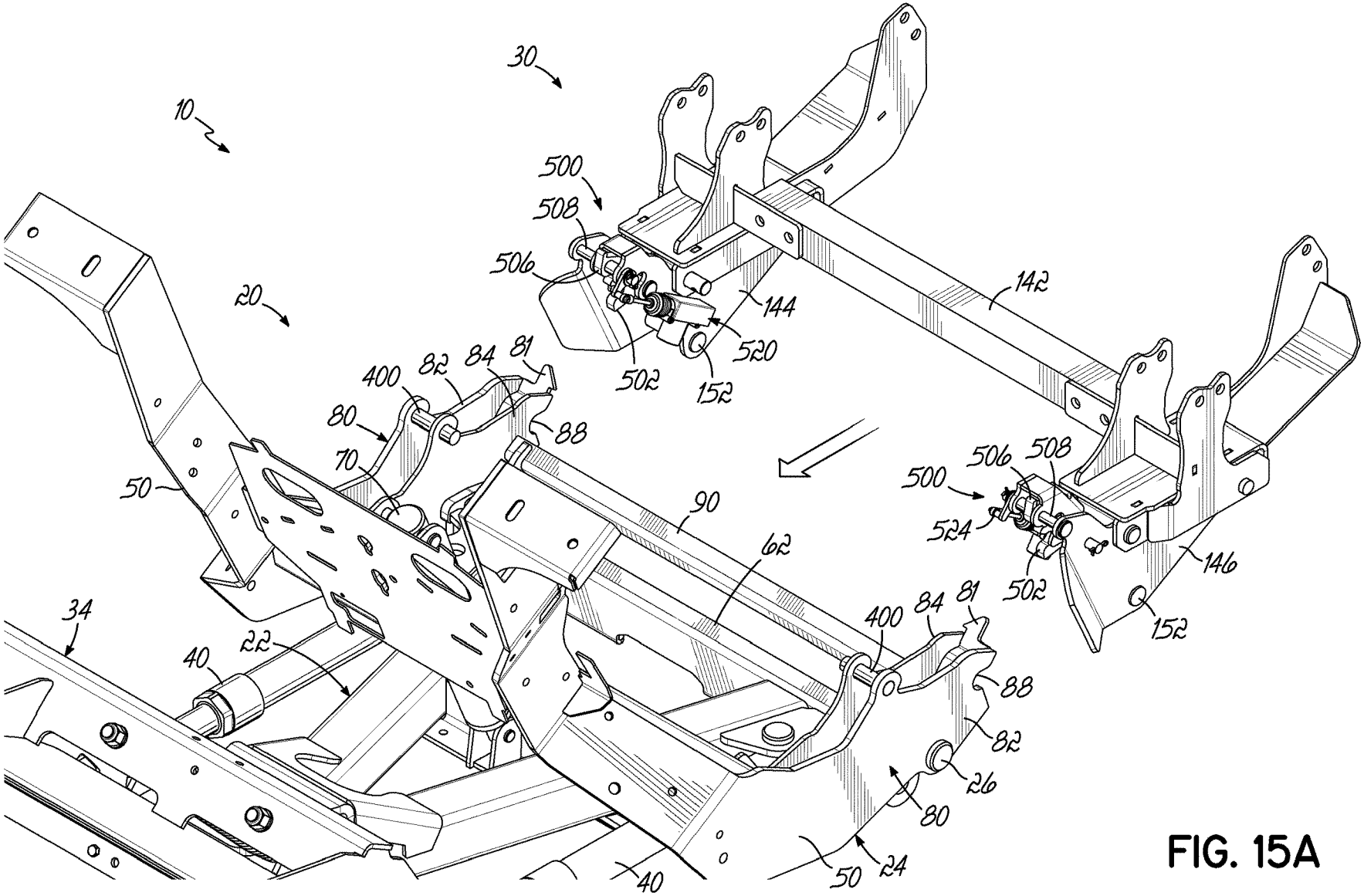
FIGS. 15A-15G are enlarged front left top perspective views of the assembly of FIG. 13 in various stages of hitching the snow plow frame to the mount frame.
Figure 15B:
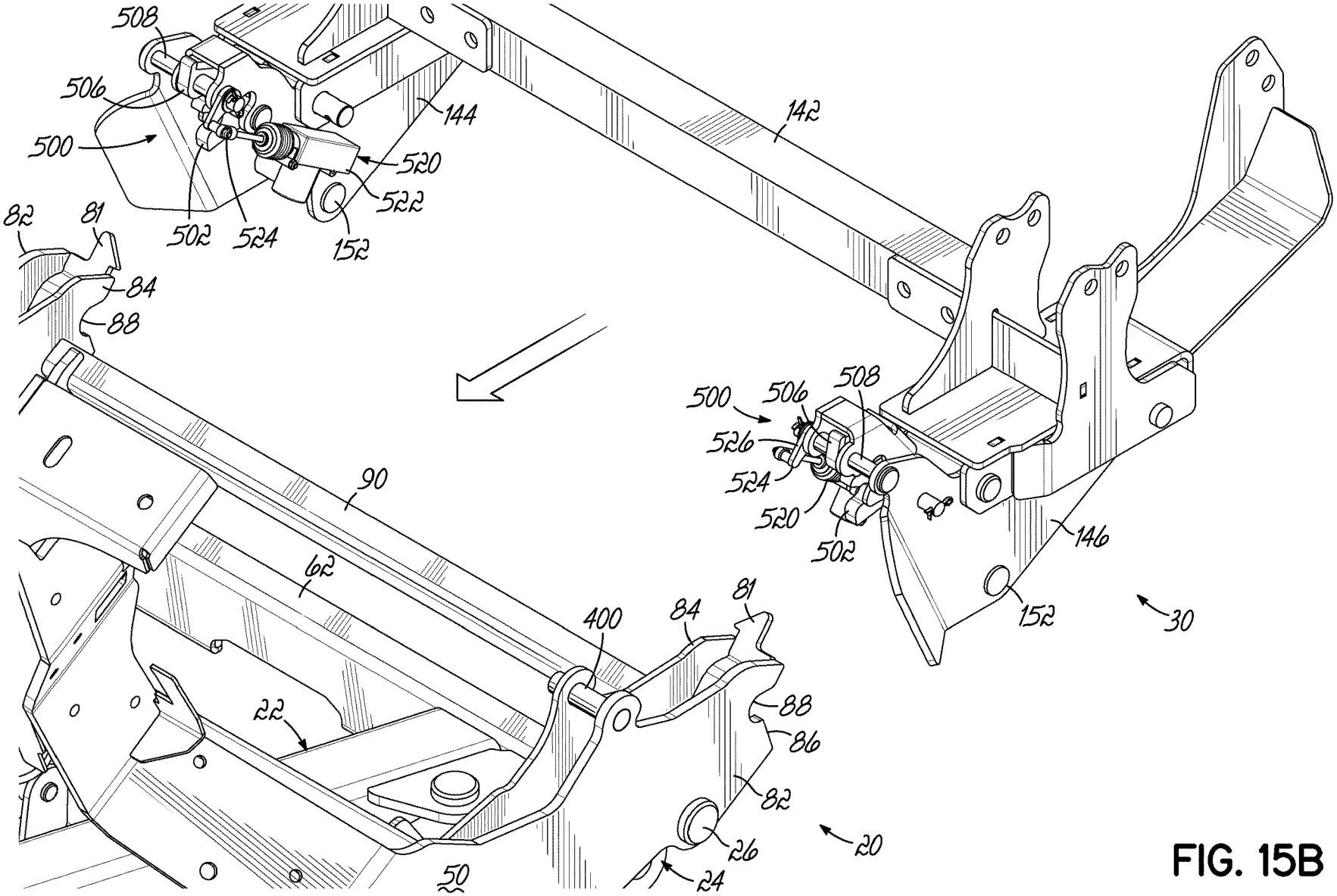
Figure 15C:
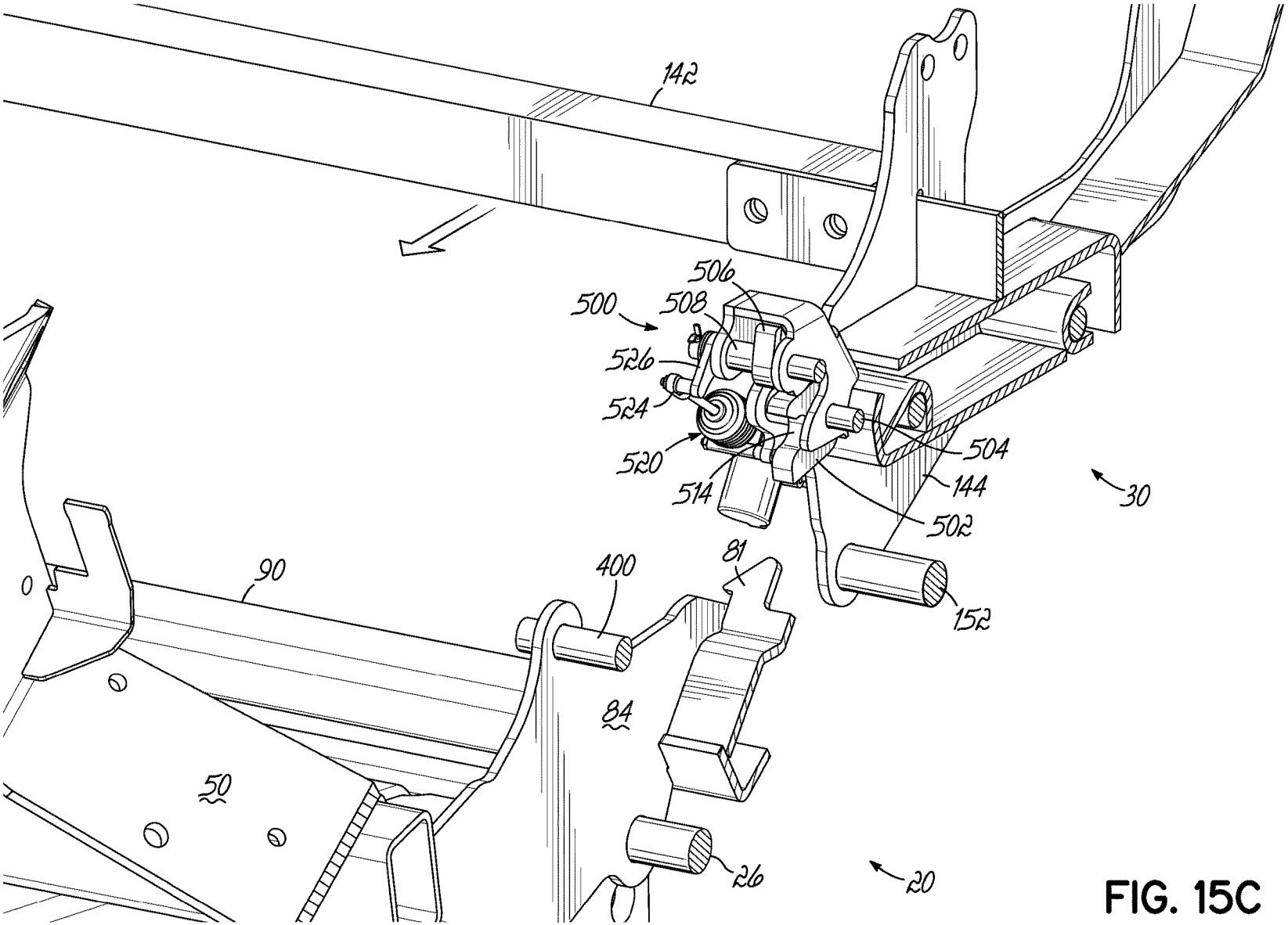
Figure 15D:
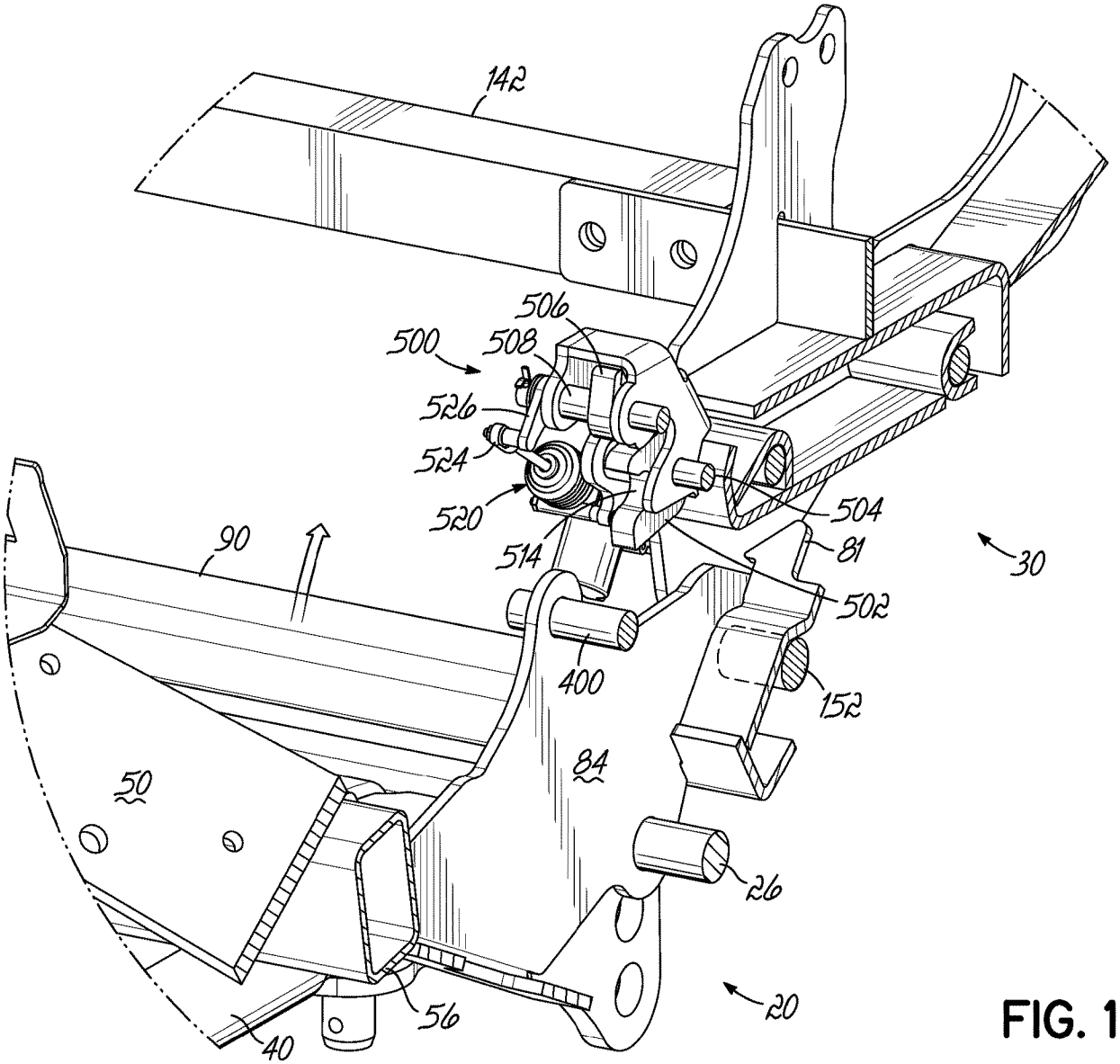
Figure 15E:
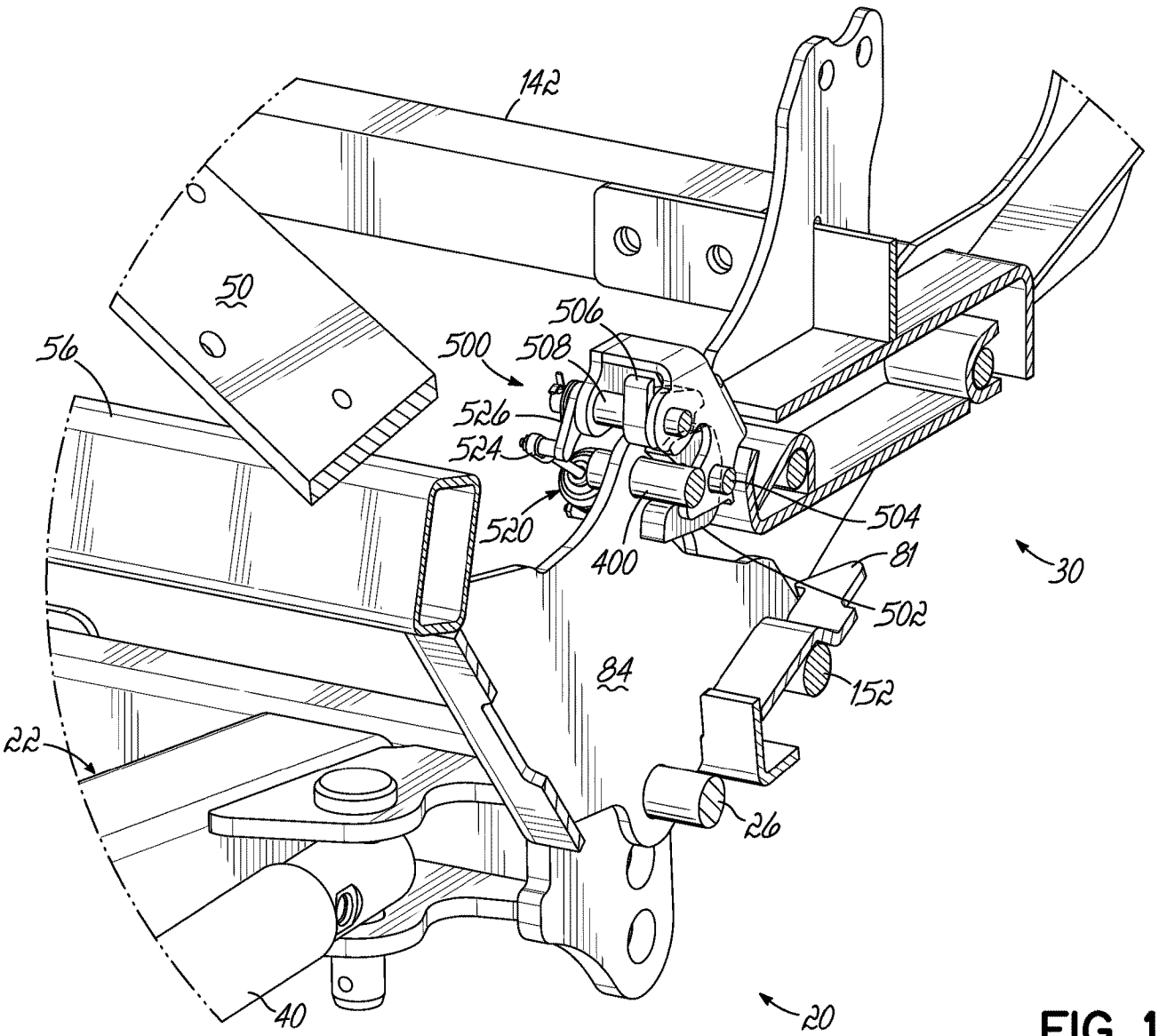
Figure 15F:
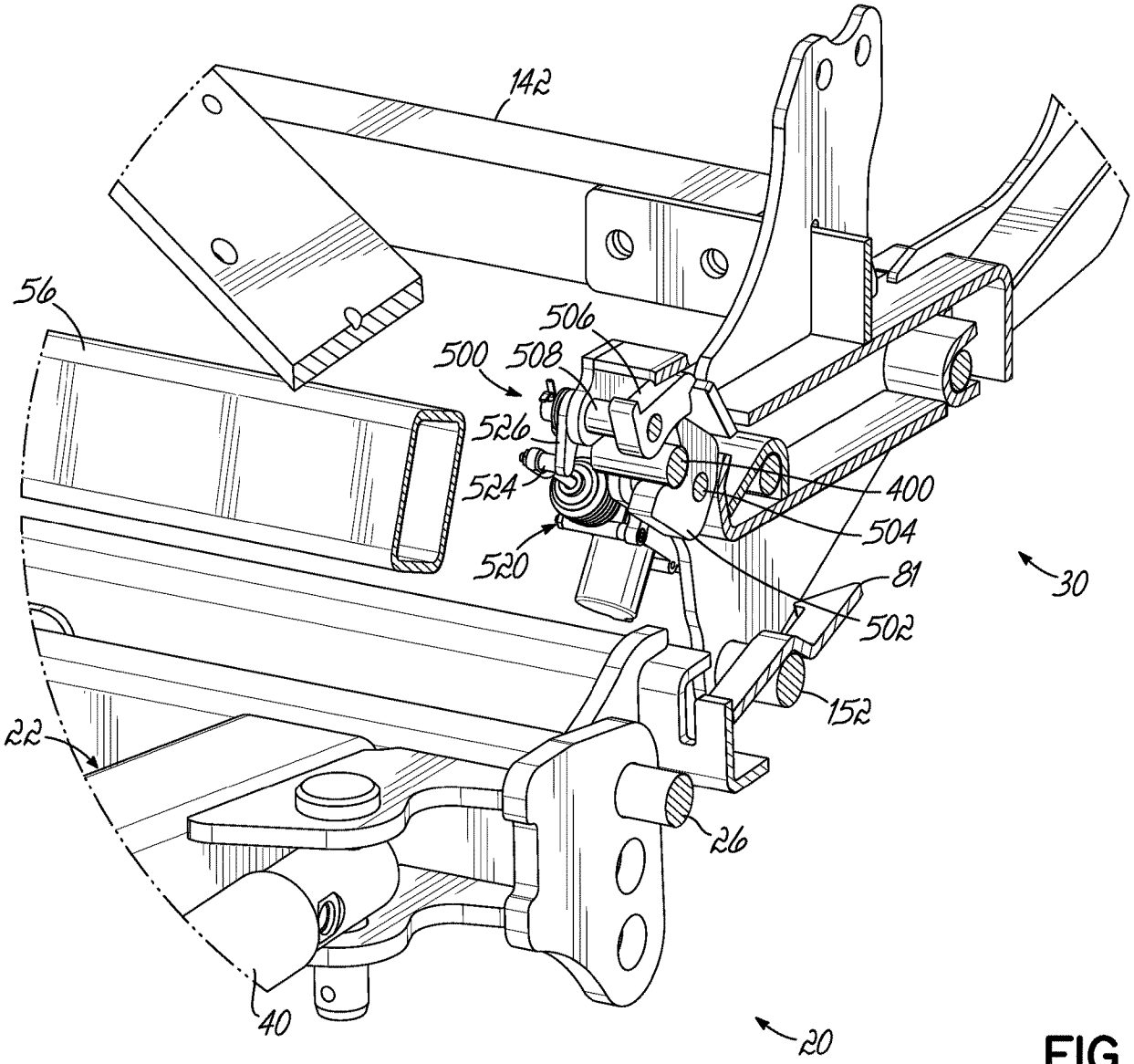
Figure 15G:
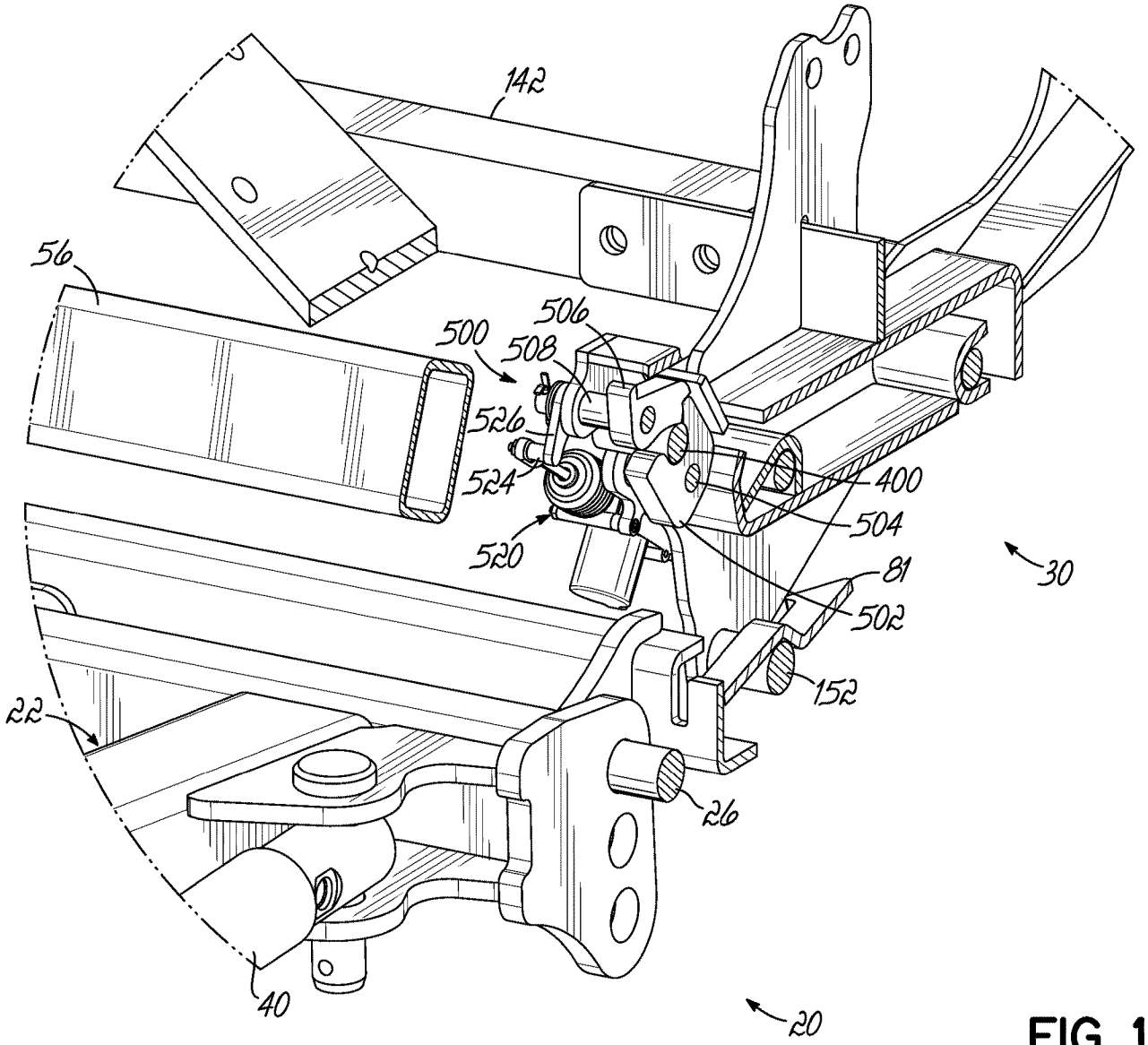
Figure 16:
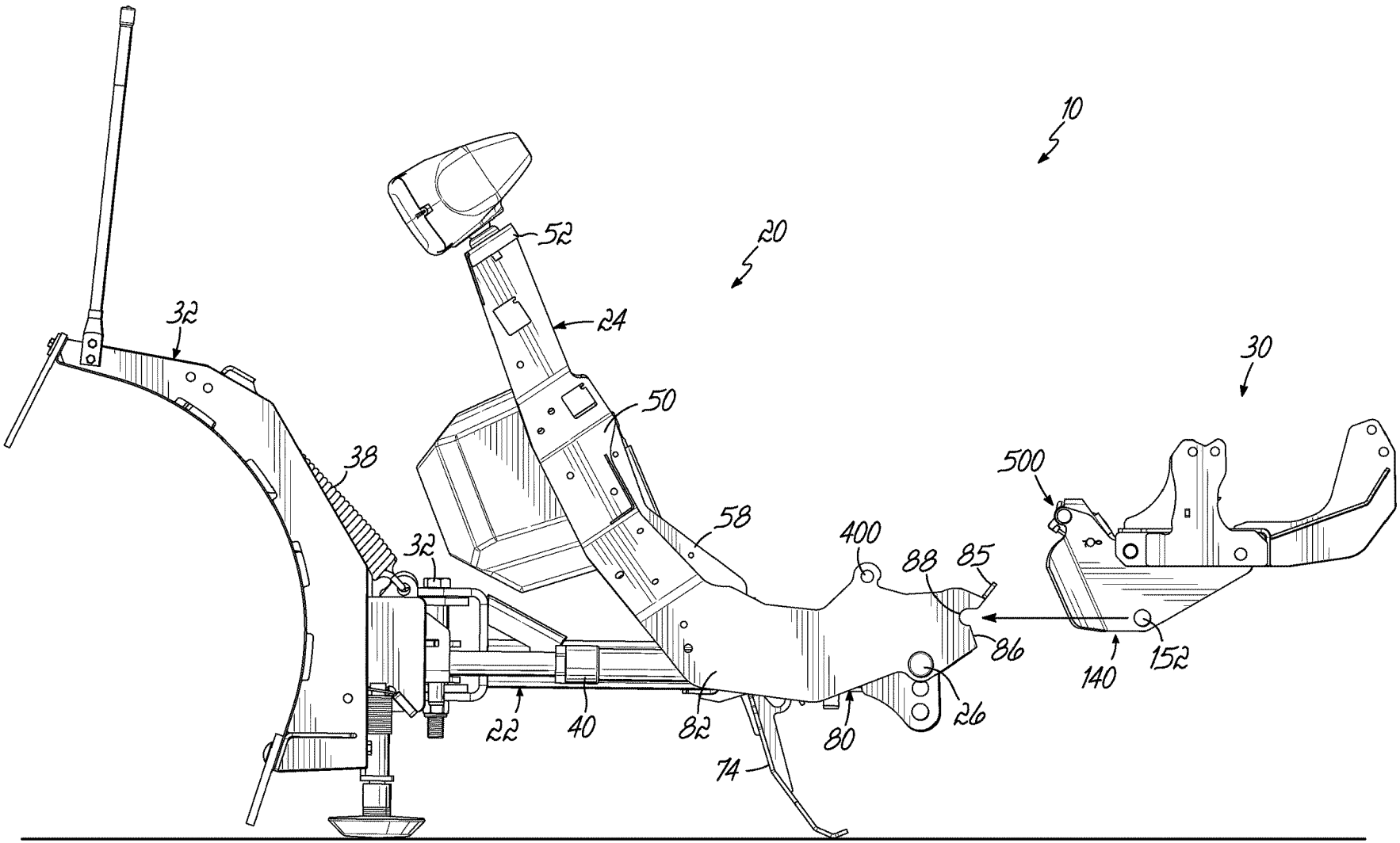
FIG. 16 is a left side view of the assembly of FIG. 13.
Figure 17A:
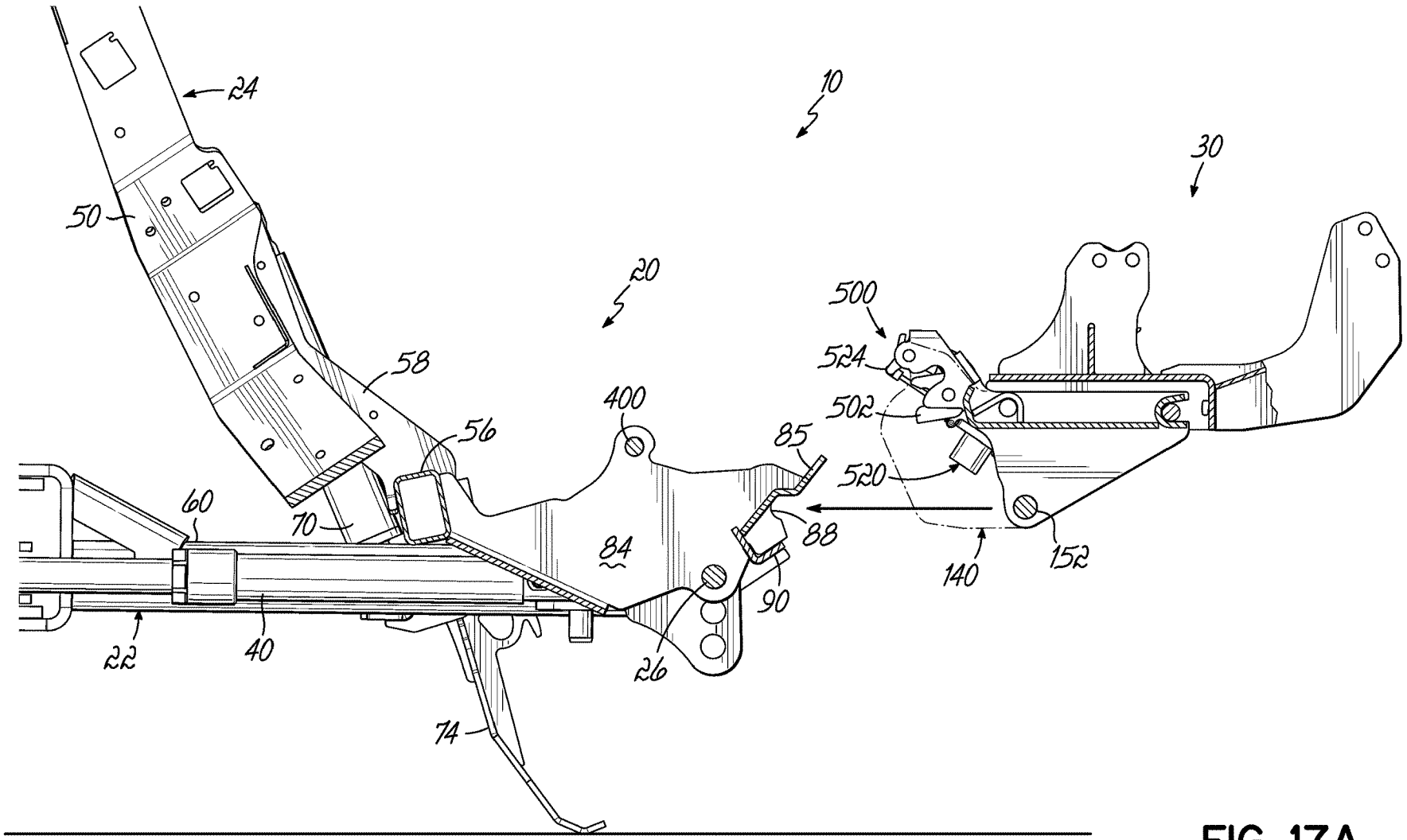
FIGS. 17A-17D are enlarged left side views of the assembly of FIG. 13 in various stages of hitching the snow plow frame to the mount frame.
Figure 17B:
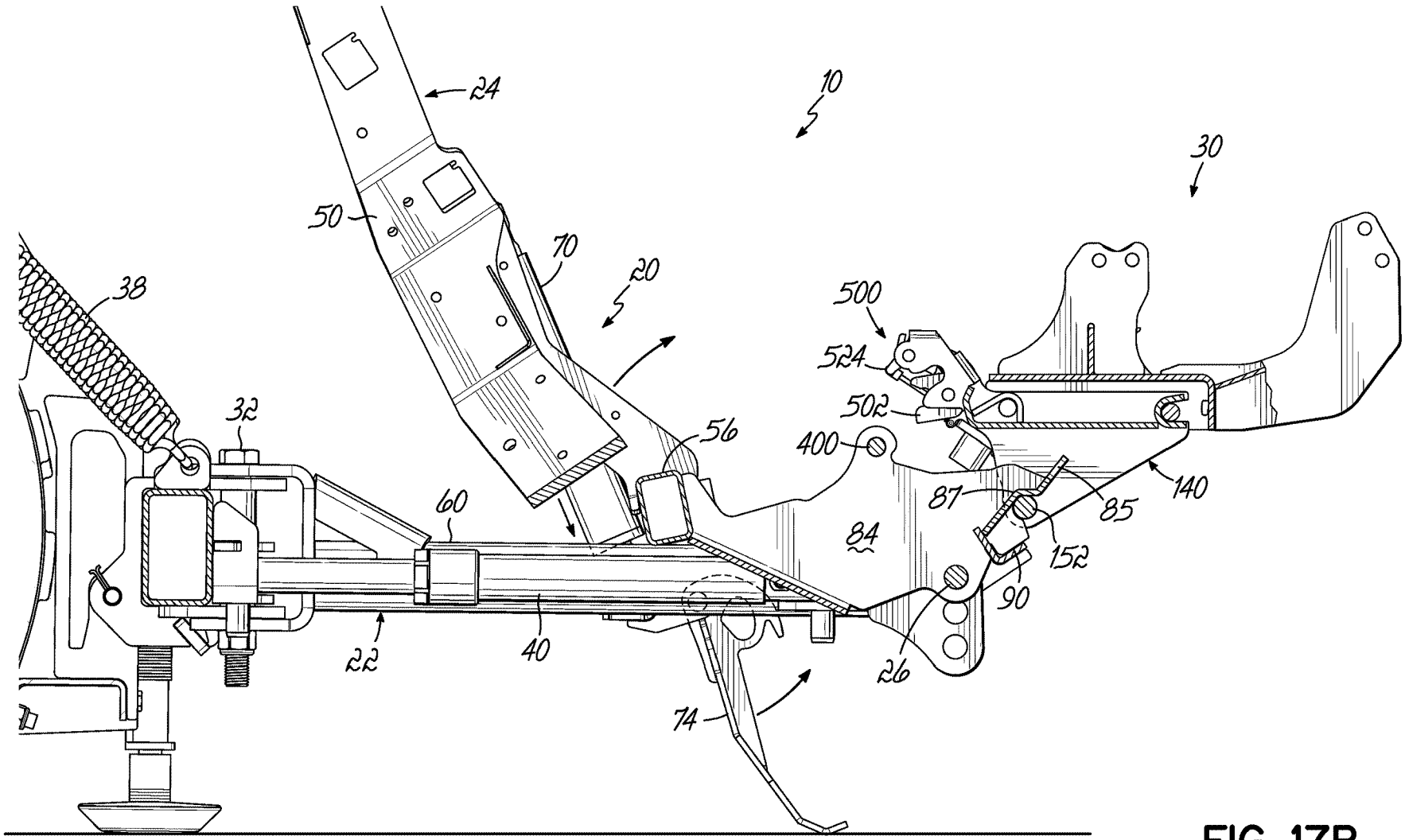
Figure 17C:
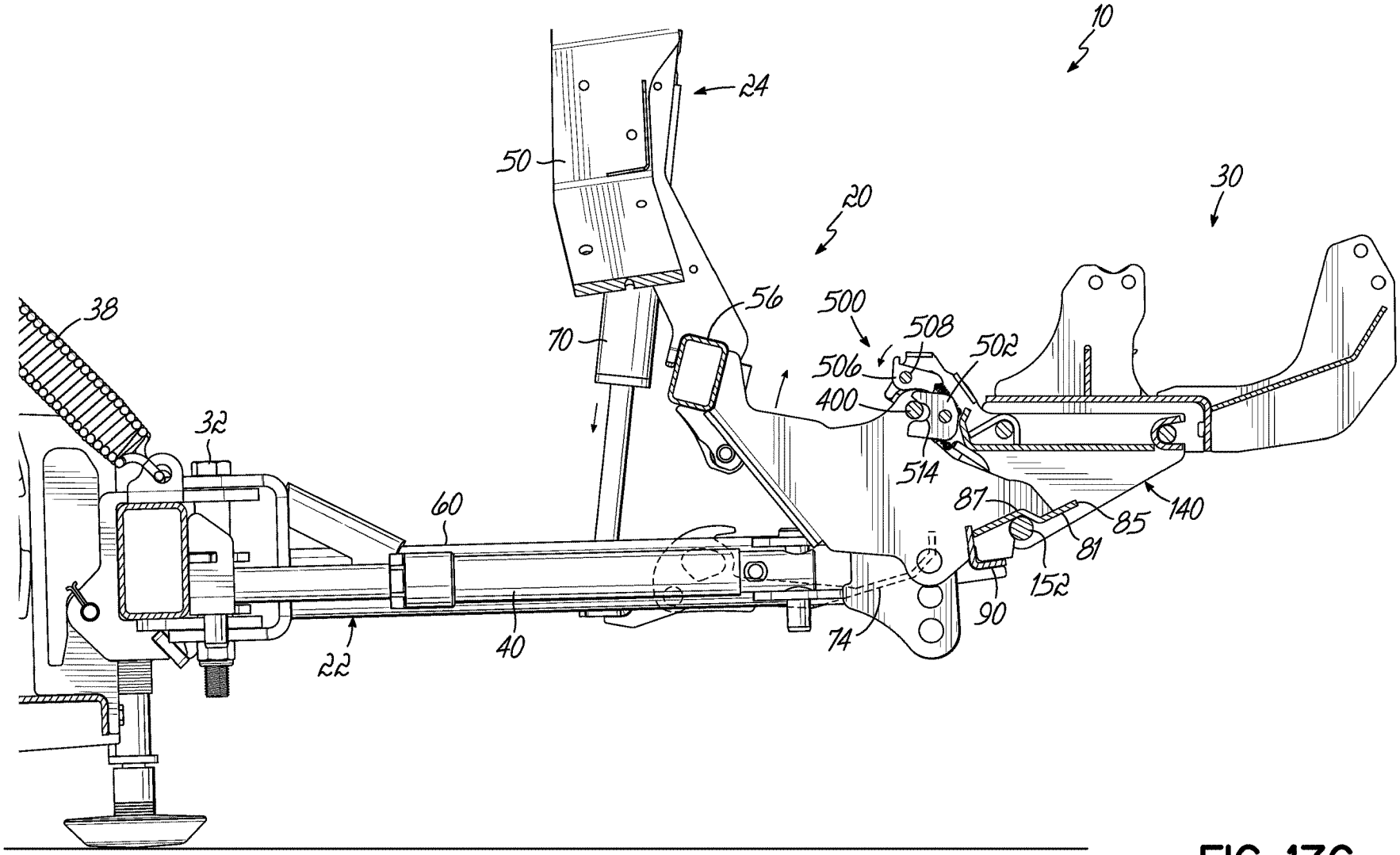
Figure 17D:
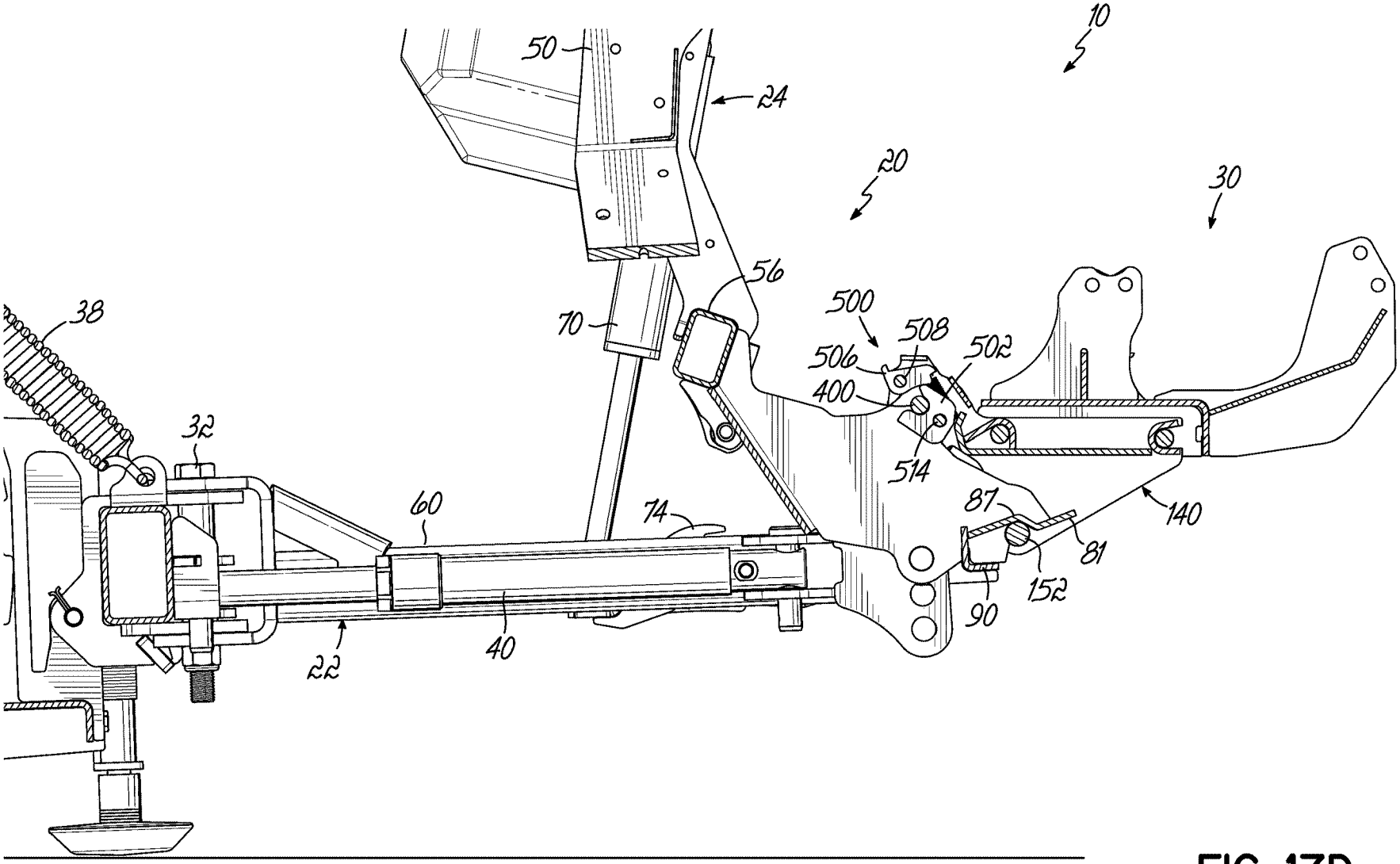
Figure 18A:
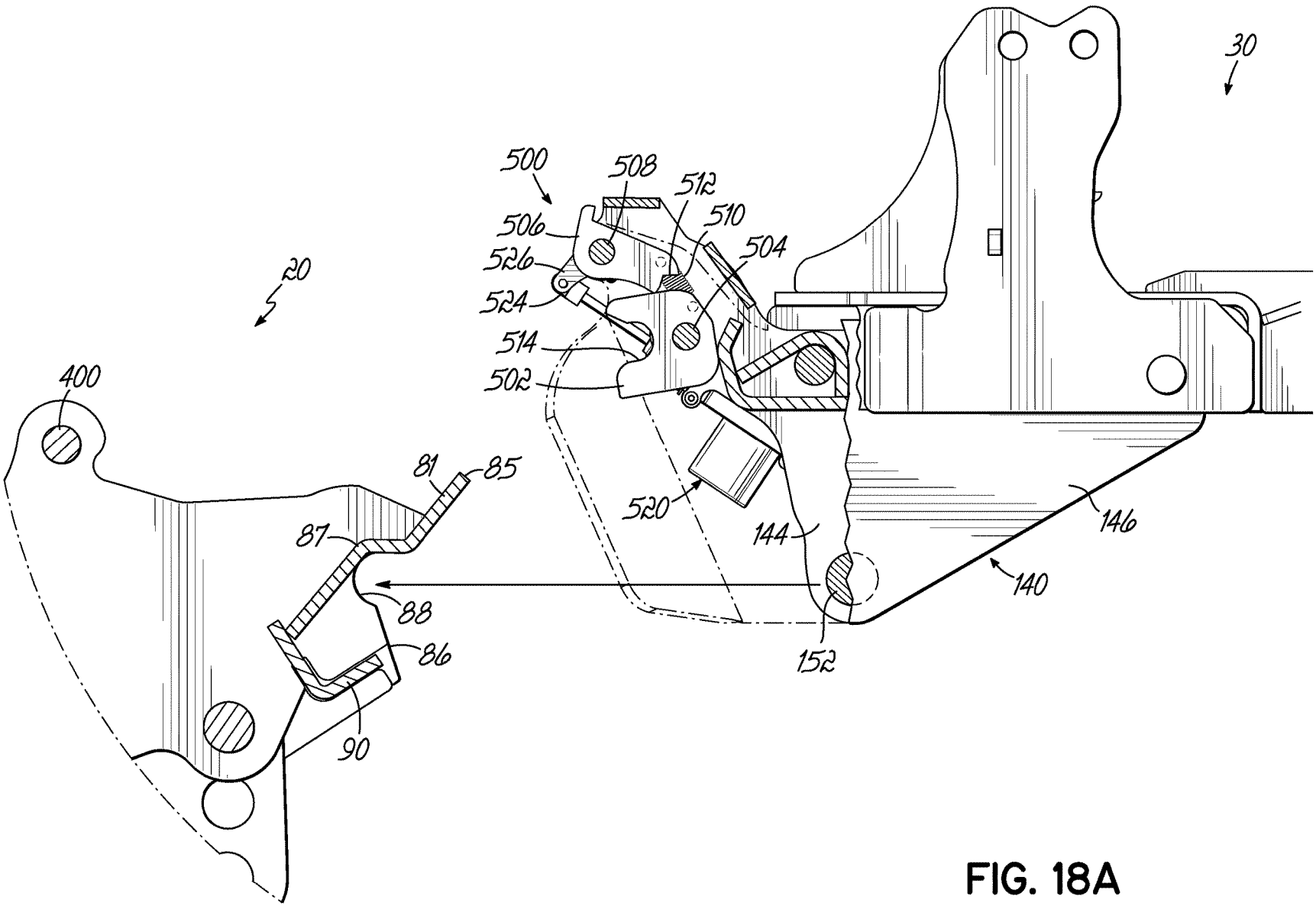
FIGS. 18A-18G are further enlarged left side views of the assembly of FIG. 13 in various stages of hitching the snow plow frame to the mount frame.
Figure 18B:
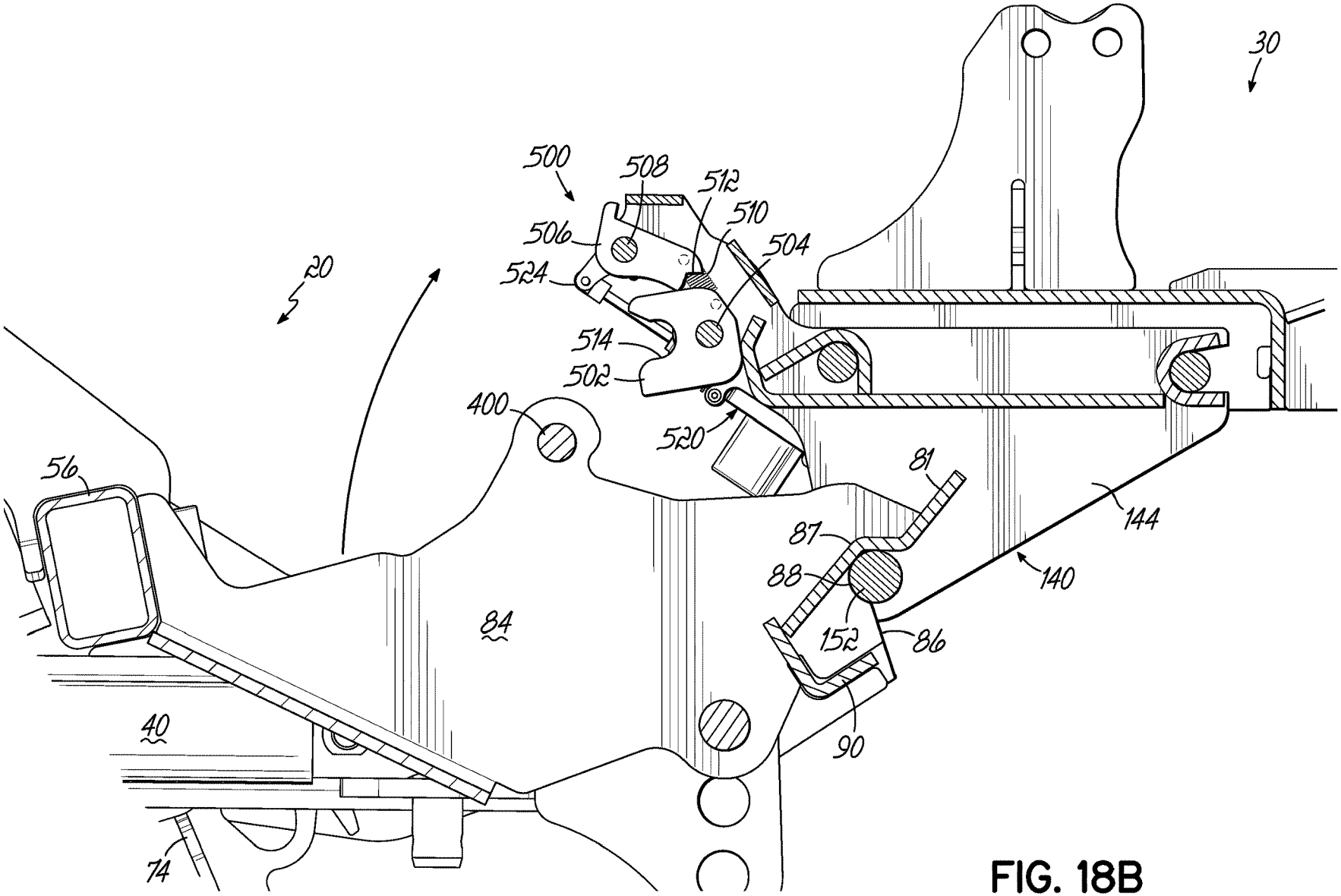
Figure 18C:
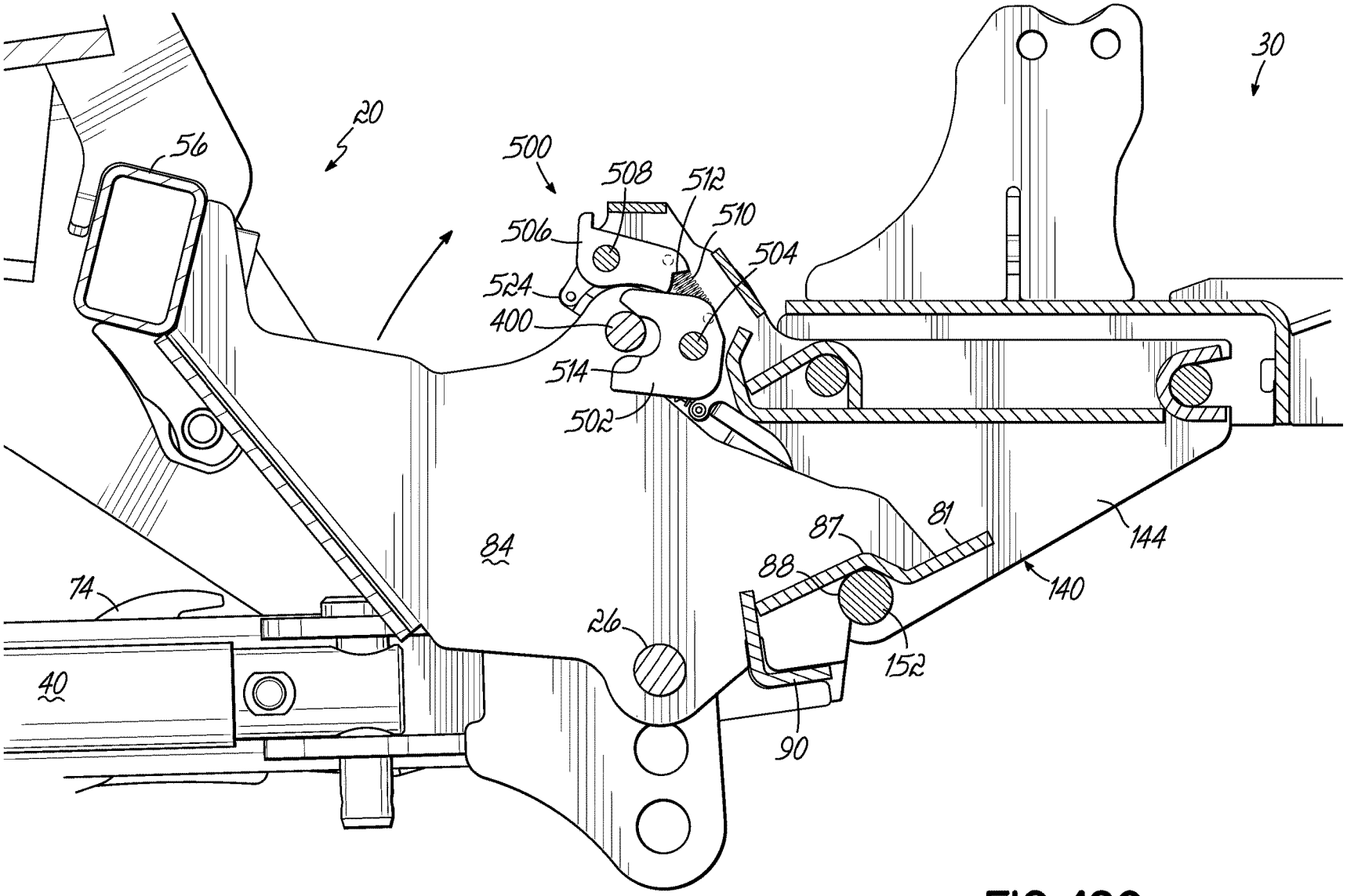
Figure 18D:
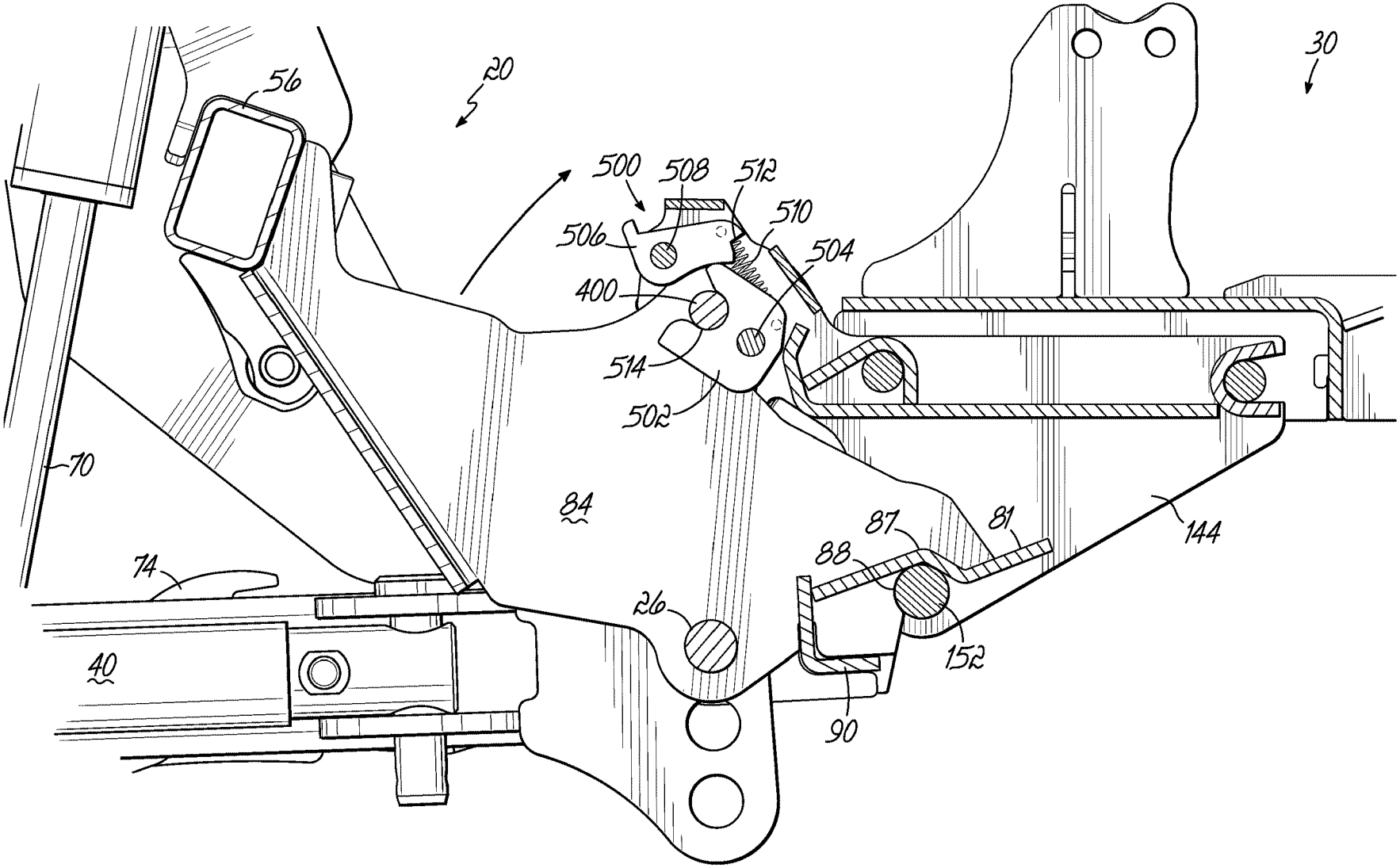
Figure 18E:
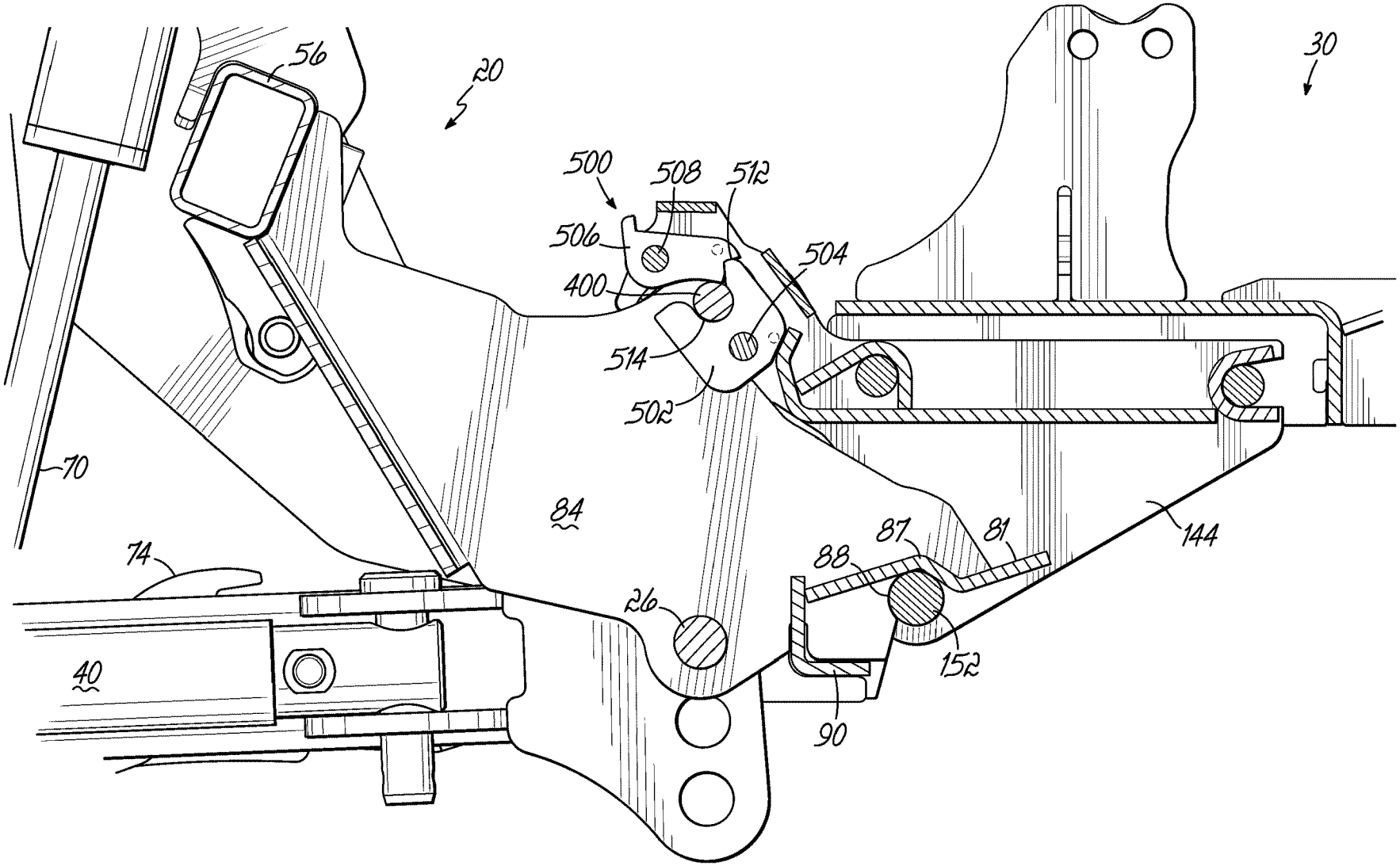
Figure 18F:
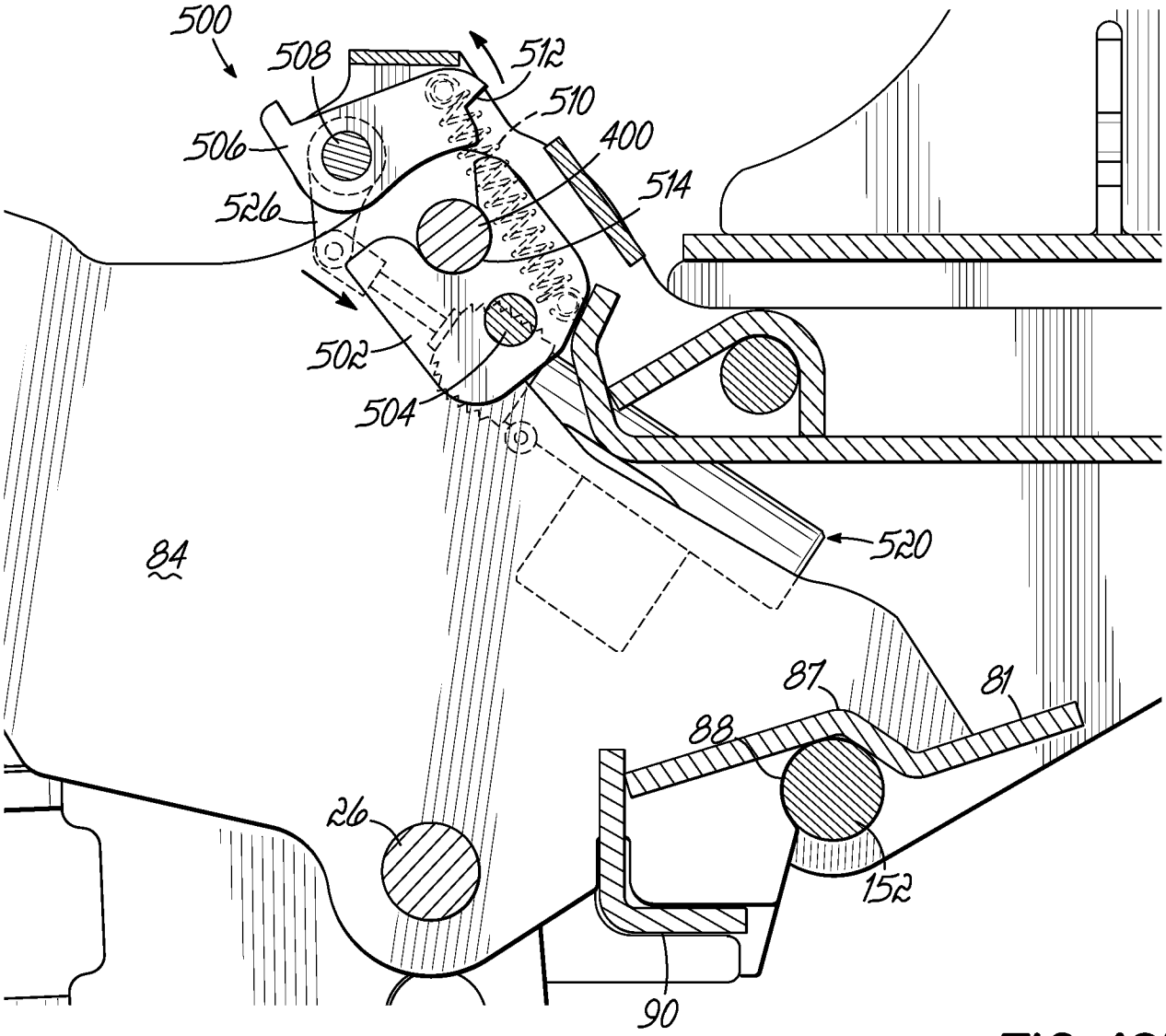
Figure 18G:
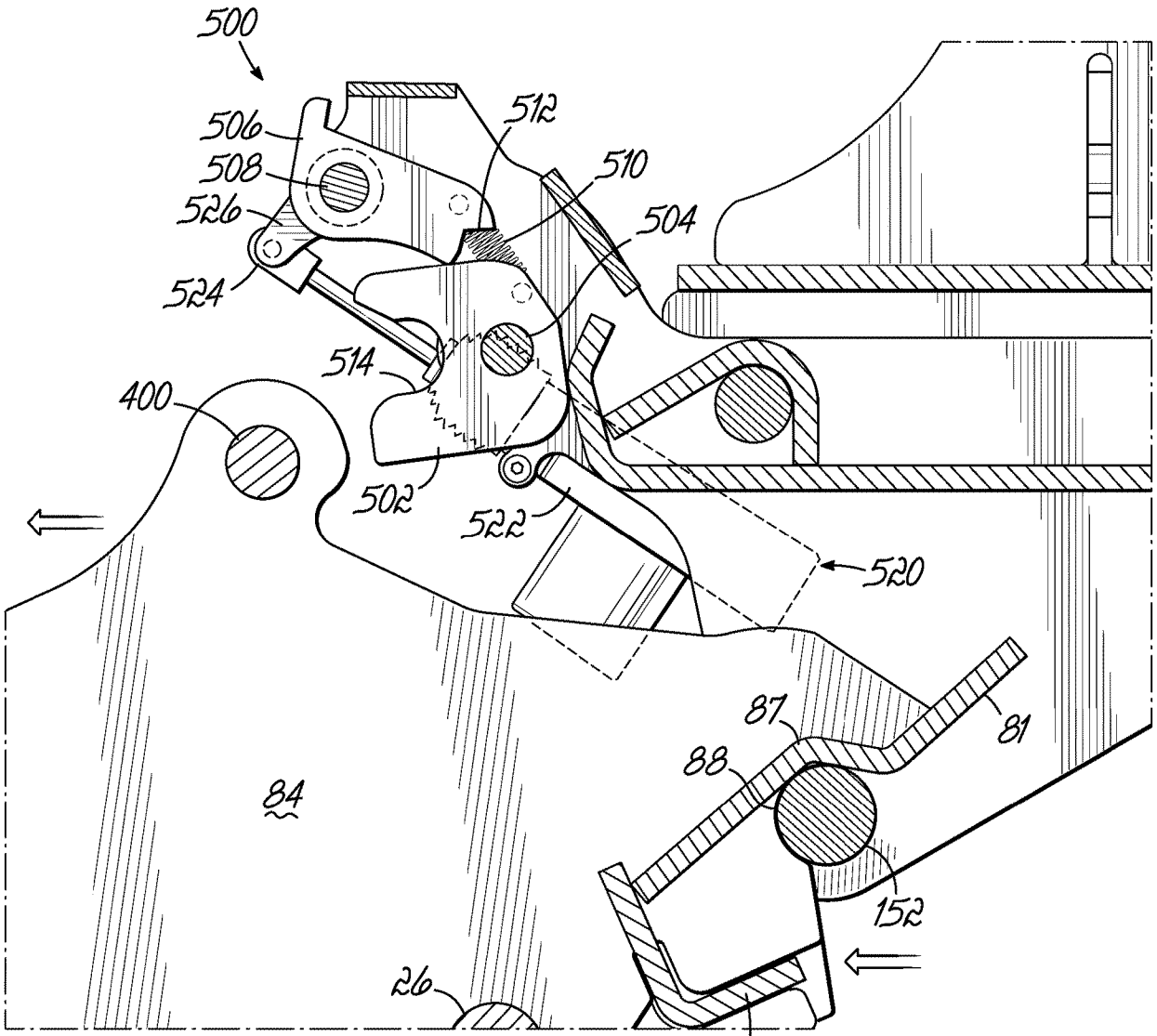
Figure 19A:
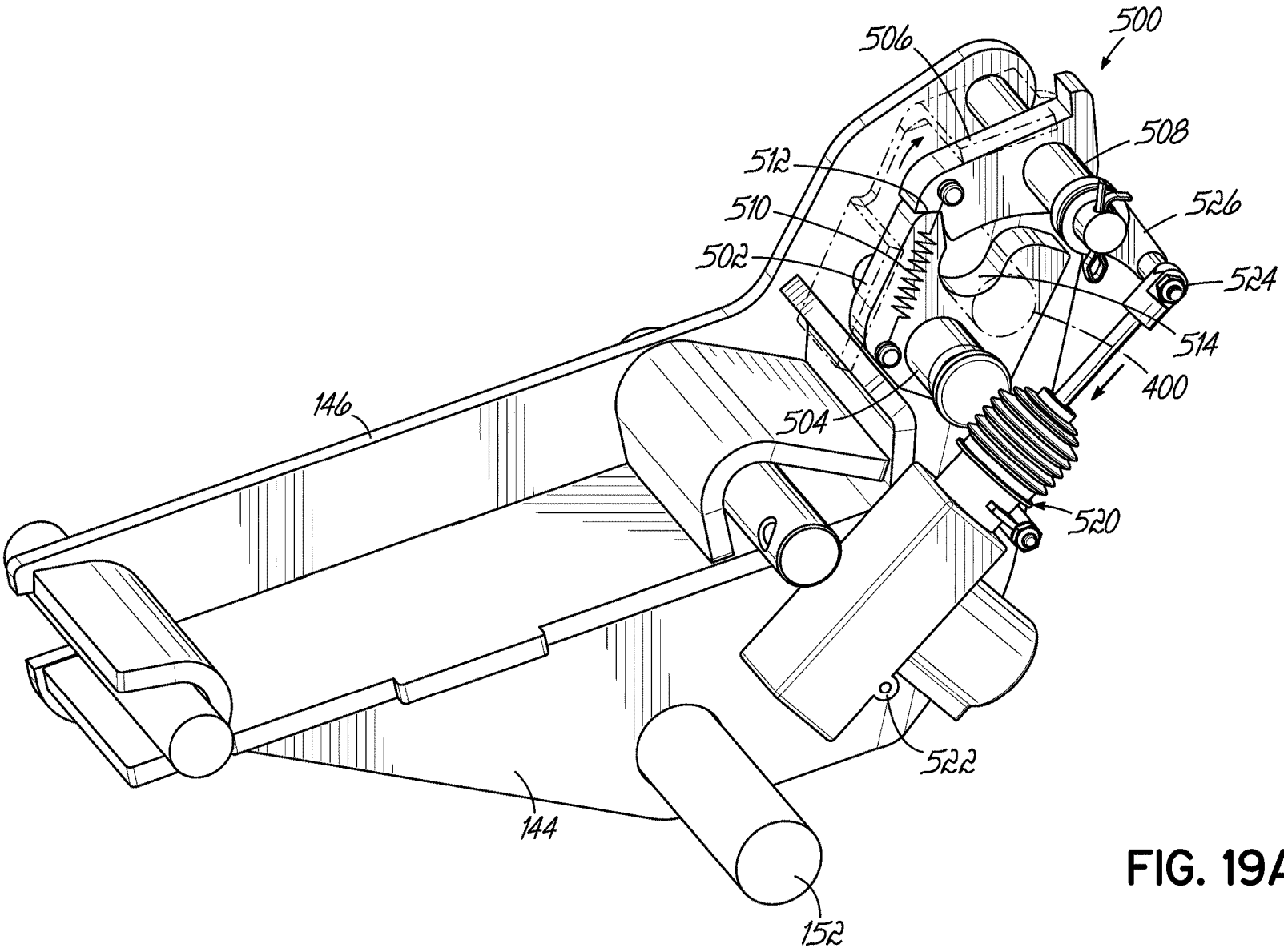
FIGS. 19A-19C are rear left top enlarged perspective views of the latch mechanism.
Figure 19B:
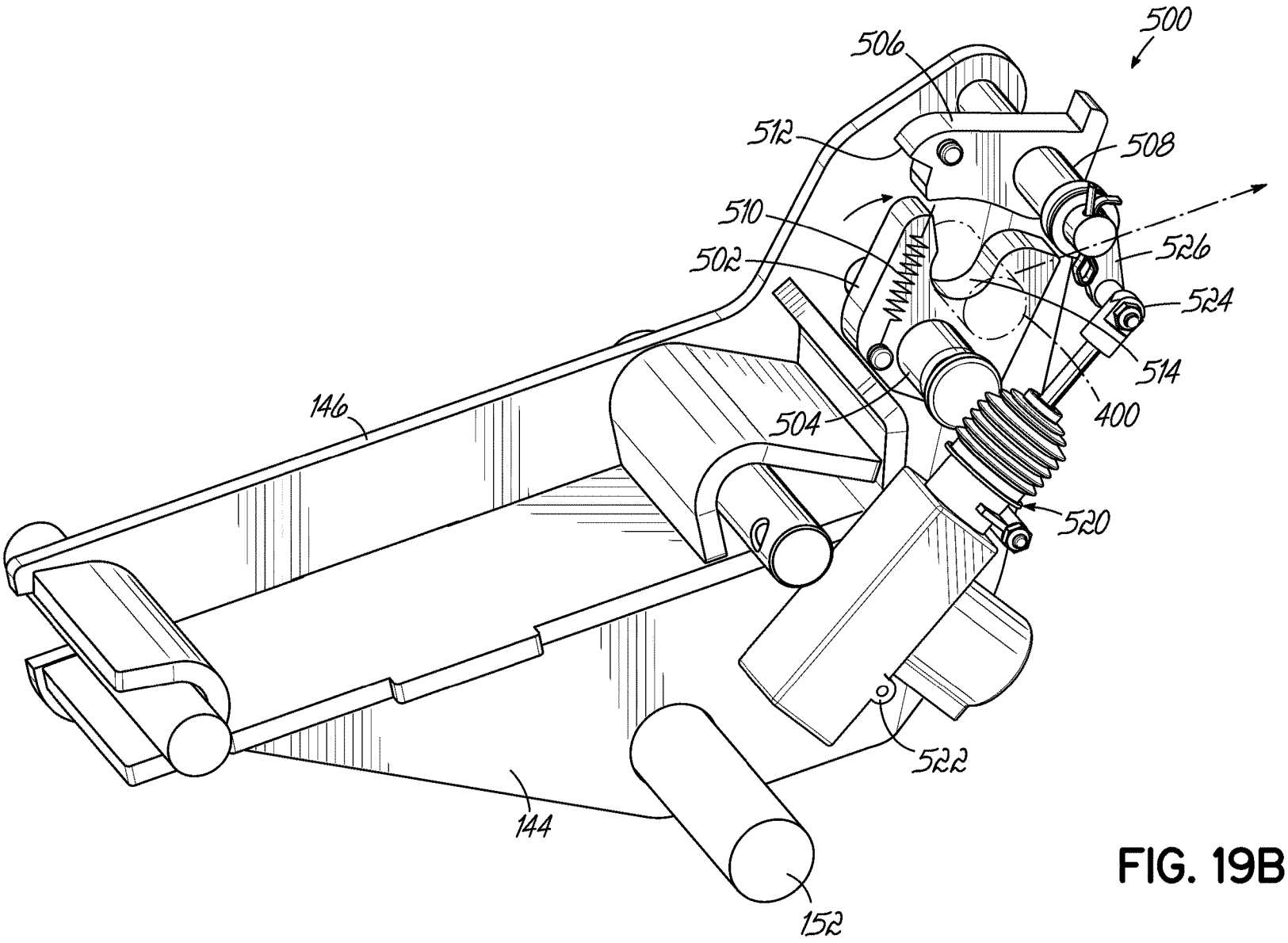
Figure 19C:
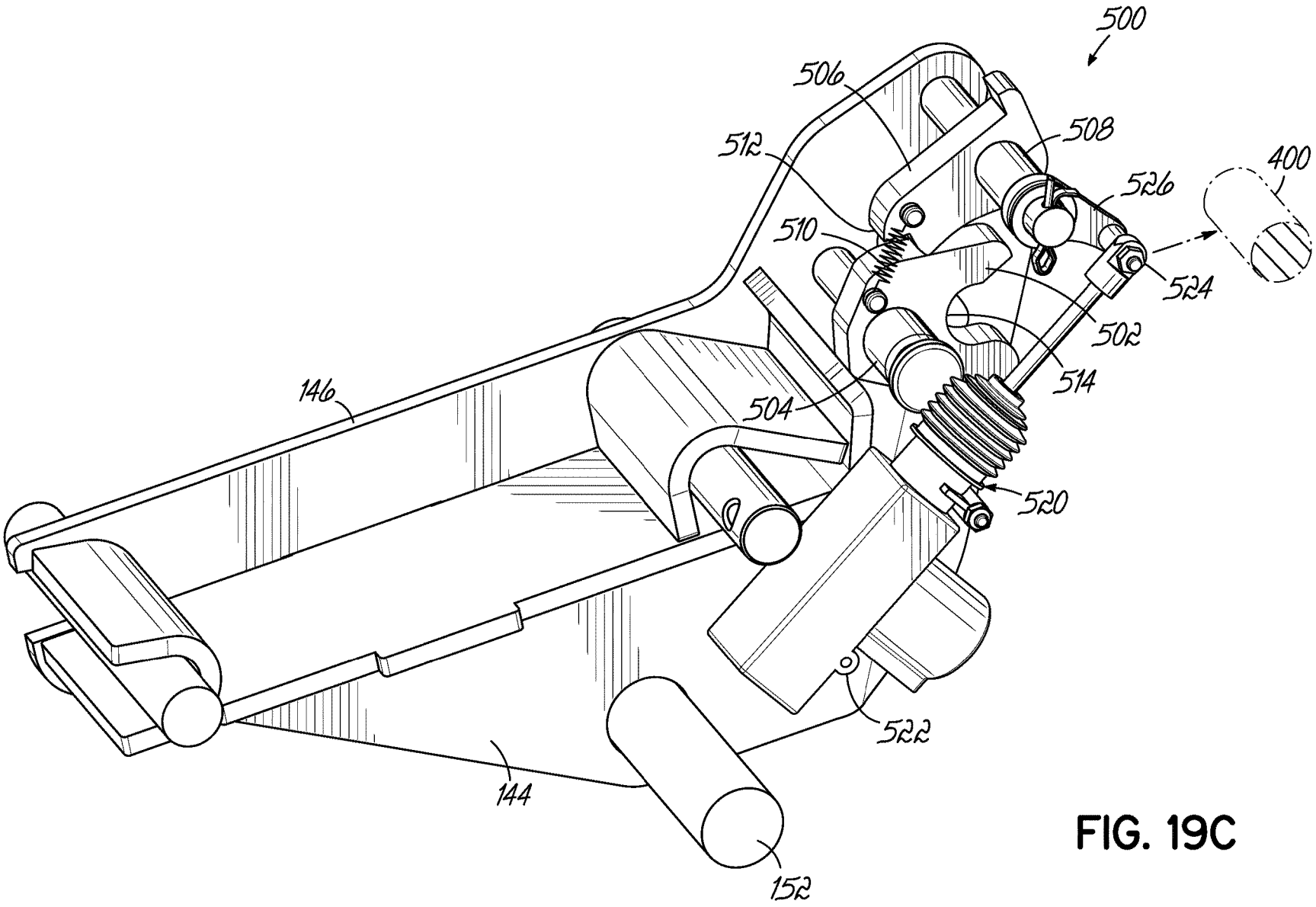

More particularly, and referring now to FIG. 12, a control system 200 for the assembly includes a controller 202, a first actuator 204 (hydraulic cylinder 70 for example), a second actuator 206 (electric linear actuator 102 for example), a first sensor 208 and a second sensor 210. The first sensor 208 senses misalignment of the holes 92, 94 relative to the holes 156, 158, and the second sensor 210 senses whether the latch pins 100 are in their fully extended and latched position.

The second sensor 210 can be a linear encoder or a potentiometer associated with (i.e. either made as a part of, or made separate from but electrically connected to) electric linear actuator 102, supplying a signal to the controller 202 that the linear actuator 102 is fully extended and hence the latch pins 100 are in their fully extended and latched position.

The first sensor 208 can sense a resistance force on at least one of the latch pins 100 indicating that the holes 92, 94 are misaligned relative to the holes 156, 158. Upon receiving a signal from the first sensor 208 that the holes 92, 94 and 156, 158 are misaligned, the controller 202 is configured to energize the hydraulic cylinder 70 (to either extend or retract or extend and retract the hydraulic cylinder 70) so as to align the holes 92, 94 and 156, 158. Once the holes 92, 94 and 156, 158 are aligned, the controller 202 de-energizes the hydraulic cylinder 70 and re-energizes the linear actuator 102 to completely extend the linear actuator 102 and hence completely extend the latch pins 100 to their fully extended and latched position.

Referring now to FIGS. 9A-11C, the first sensor 208 can take the form of a telescoping link assembly 300. The assembly 300 includes a bracket 302 mounted to the rod end of the linear actuator 102. The bracket 302 has first 304 and second 306 spaced apart ends and first 308 and second 310 limit switches mounted to the first 304 and second 306 ends, respectively. The bracket 302 further includes a cylinder 312 having first 314 and second 316 spring stops at opposite ends thereof. The cylinder 312 includes an elongated slot 318 therein. A telescoping link 320 is connected to one of the pins 100 and resides within the cylinder 312. The link 320 and cylinder 312 of the bracket 302 are operable to telescope into and out of one another so as to shorten and lengthen, respectively.

A collar 326 encircles the cylinder 312 and is pinned to the end of the telescoping link 320 via a bolt or pin 328 which is oriented perpendicularly to and extends through the slot 318 in the cylinder 312. A first compression spring 330 is positioned between the first spring stop 314 of cylinder 312 and the collar 326. A second compression spring 332 is positioned between the second spring stop 316 of cylinder 312 and the collar 326. A first washer 334 is positioned between the collar 326 and the first compression spring 330 and a second washer 336 is positioned between the collar 326 and the second compression spring 332.

The compression springs 330, 332 normally bias the collar 326 to a nominal centered position between the first 314 and second 316 spring stops of the bracket 302. The bracket 302 further includes an arm 340 having an end 342. The end 342 has a width approximately the same width as the collar 328, and maintains the springs 314 and 316 in their nominally centered position.

Figure 9A:
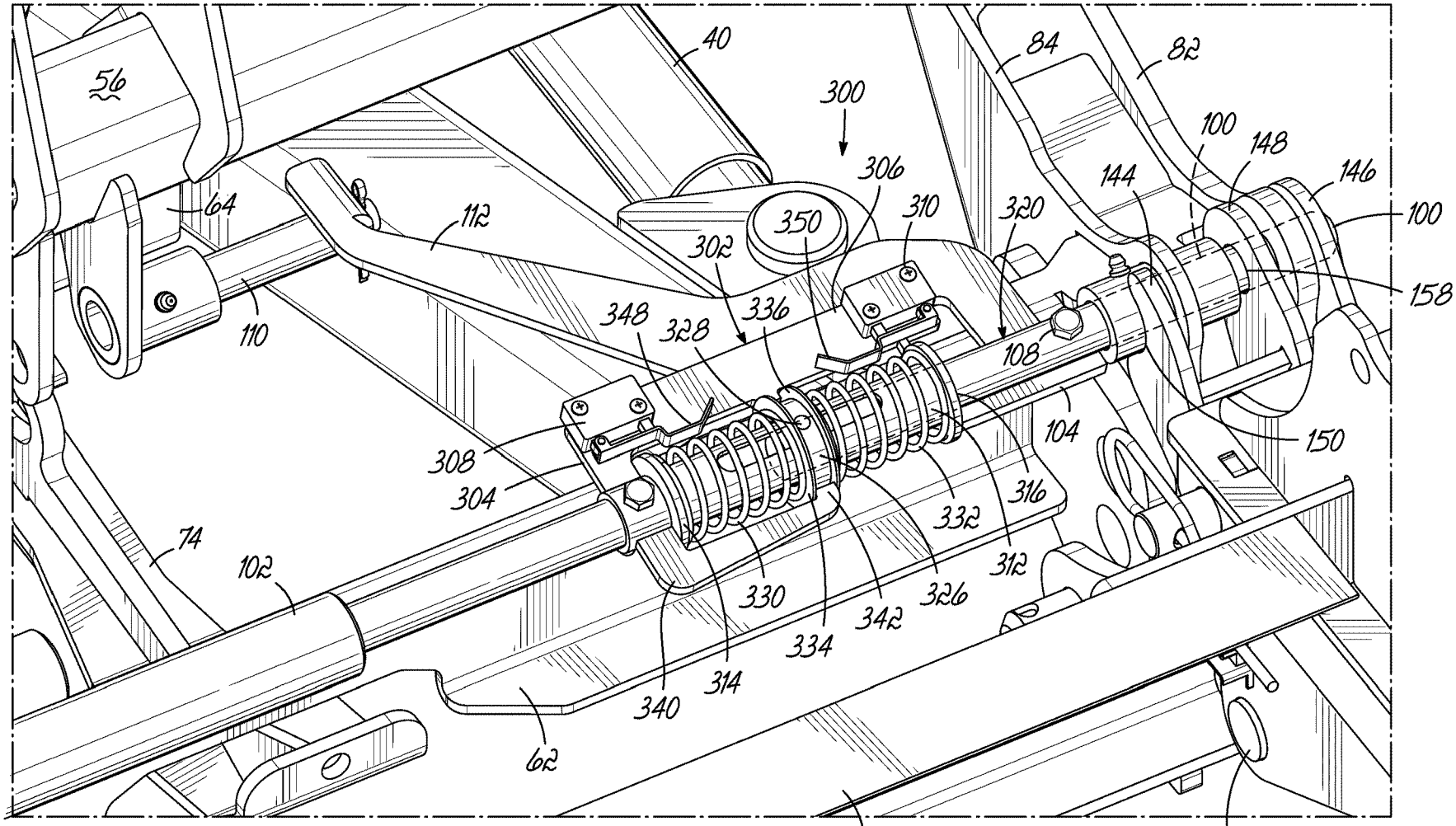
FIGS. 9A-9C are enlarged perspective views of the telescoping link assembly of the latch pin linear actuator.

As shown in FIG. 9A, the linear actuator 102 is in its extended position and both latch pins 100 are in their fully extended and latched position. The telescoping link assembly 300 is at its nominal length, with neither of the compression springs 330 or 332 being compressed due to binding of the latch pins 100 in holes 92, 94 and 156, 158.

Figure 9B:
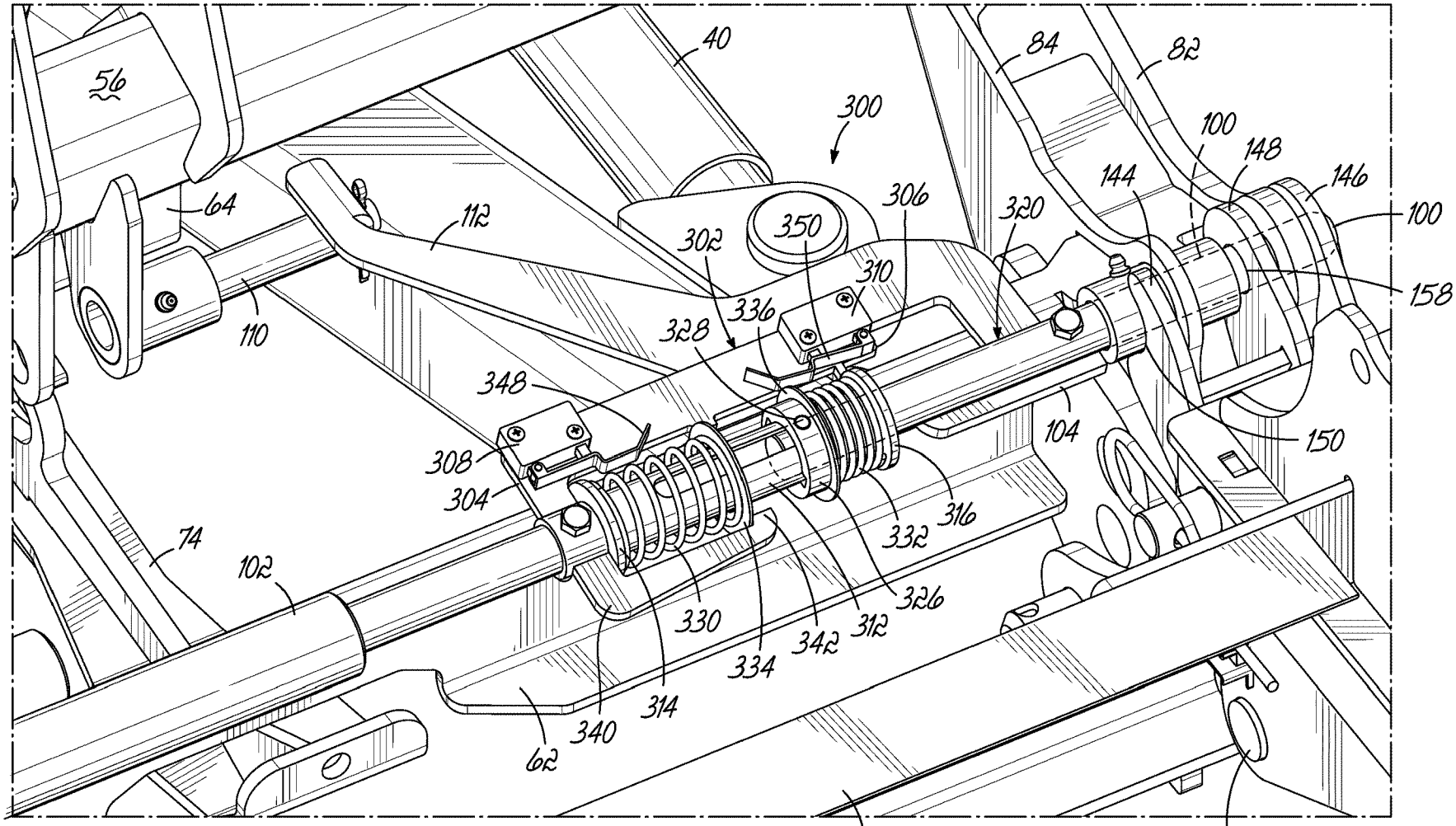

As shown in FIG. 9B, the linear actuator 102 has been retracted as if to retract the latch pins 100 from their latched position to their unlatched position. However, the right hand (passenger side) pin 100 was not able to be retracted due to the pin 100 being loaded because of misalignment of the holes 92, 94 and 156, 158. Consequently, during retraction of the linear actuator 102, bracket 302 moves to the left relative to collar 326, compressing second compression spring 332, until such time as second washer 336 contacts the lever 350 of second limit switch 310, activating limit switch 310 to send a signal to the controller 202 to de-energize actuator 102. The controller 202 then sends a signal to energize the hydraulic cylinder 70 to extend or retract or extend and retract, causing pivoting of the lift frame 24 relative to the A-frame 22, so as to align the misaligned holes 92, 94 and 156, 158 and thereby de-load the right hand latch pin 100. Once de-loaded, the compressed second compression spring 332 will partially extract the right hand latch pin 100 from the holes 92, 94 and 156, 158. In doing so, the second washer 336 moves out of contact with the lever 350 of the second limit switch 310, deactivating limit switch 310 to send a signal to the controller 202 to de-energize hydraulic cylinder 70 and to re-energize linear actuator 102 to completely withdraw the latch pins from the holes 92, 94 and 156, 158.

Figure 9C:
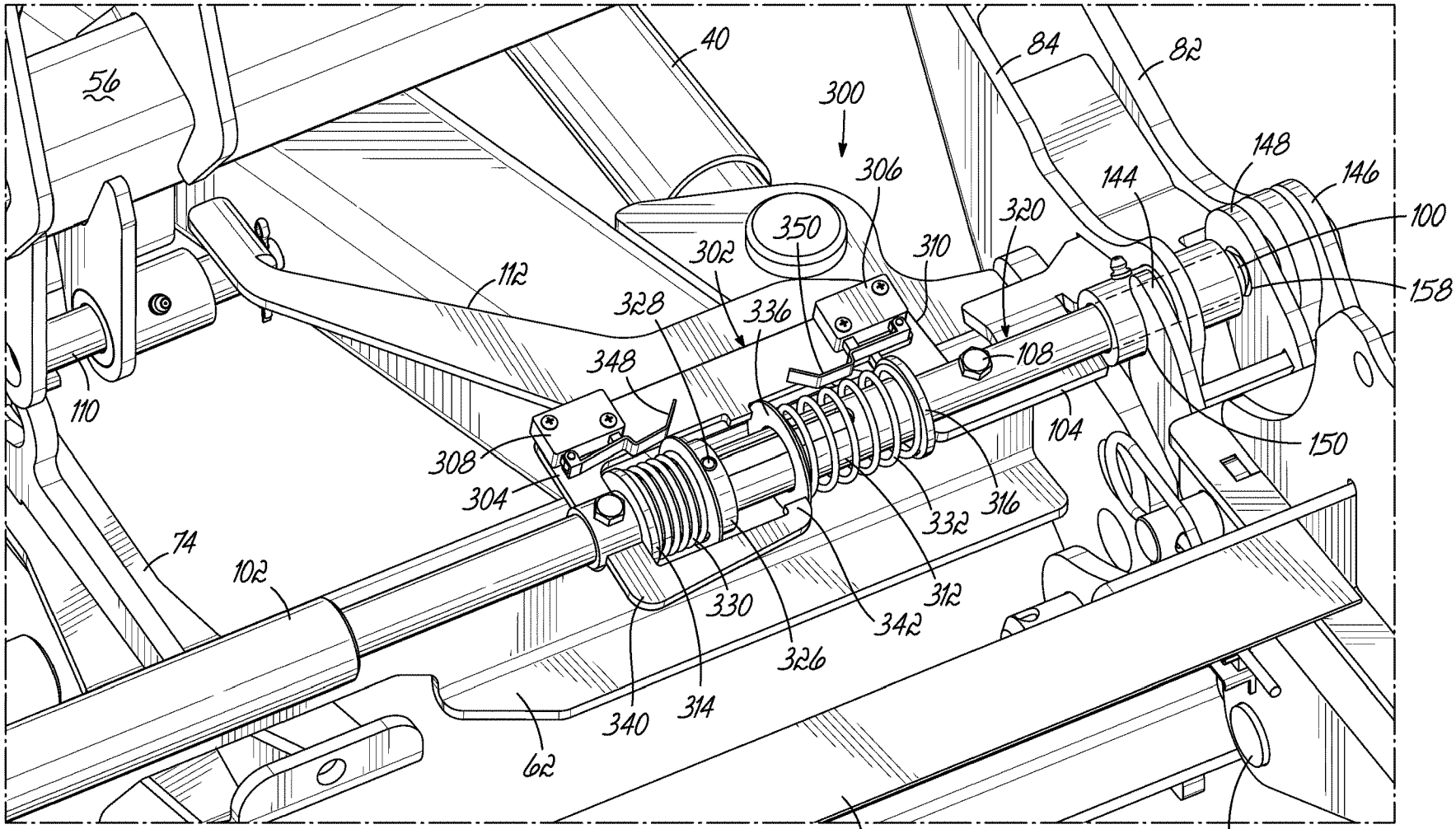

As shown in FIG. 9C, the linear actuator 102 has been extended as if to extend the latch pins 100 from their unlatched position to their latched position. However, in this instance, the right hand (passenger side) pin 100 was not able to be extended due to the pin 100 being loaded because of misalignment of the holes 92, 94 and 156, 158. Consequently, during extension of the linear actuator 102, bracket 302 moves to the right relative to collar 326, compressing first compression spring 330, until such time as first washer 334 contacts the lever 348 of first limit switch 308, activating limit switch 308 to send a signal to the controller 202 to de-energize the actuator 102. The controller 202 then sends a signal to energize the hydraulic cylinder 70 to extend or retract or extend and retract, causing pivoting of the lift frame 24 relative to the A-frame 22, so as to align the misaligned holes 92, 94 and 156, 158 and thereby de-load the right hand latch pin 100. Once de-loaded, the compressed first compression spring 330 will partially extend the right hand latch pin 100 into the holes 92, 94 and 156, 158. In doing so, the first washer 334 moves out of contact with the lever 348 of the first limit switch 308, deactivating limit switch 308 to send a signal to the controller 202 to de-energize hydraulic cylinder 70 and to re-energize linear actuator 102 to completely extend the latch pins into the holes 92, 94 and 156, 158.

Note that whether the linear actuator 102 is energized so as to extend and hence extend the latch pins 100 to their latched position and one of the pins 100 fails to move to the fully extended and latched position due to misalignment of the holes 92, 94 and 156, 158, or whether the linear actuator 102 is energized so as to retract and hence retract the latch pins 100 from their latched position and one of the pins 100 fails to move to the fully retracted and unlatched position due to misalignment of the holes 92, 94 and 156, 158, the telescoping link assembly 300, linear actuator 102, hydraulic cylinder 70, and controller 202 work in a similar manner in both instances to detect and alleviate misalignment of the holes 92, 94 and 156, 158. In the case of the former, the energy of the compressed compression spring will partially extend the latch pin 100 through the holes 92, 94 and 156, 158 (once aligned), and the linear actuator 102 will be re-energized so as to completely extend the latch pins through the holes 92, 94 and 156, 158 to their latched position. In the case of the latter, the energy of the compressed compression spring will partially retract the latch pin 100 from the holes 92, 94 and 156, 158 (once aligned), and the linear actuator 102 will be re-energized so as to completely retract the latch pins from the holes 92, 94 and 156, 158 to their unlatched position.

In order to better visualize operation of the telescoping link 300, when either the left hand (driver side) or the right hand (passenger side) latch pin 100 binds up during extension of the linear actuator 102 to move the latch pins 100 to the latched position, the left hand (first) compression spring 330 is compressed (telescoping link assembly 300 telescopes inwardly), and when either the left hand (driver side) or the right hand (passenger side) latch pin 100 binds up during retraction of the linear actuator 102 to move the latch pins 100 to the unlatched position, the right hand (second) compression spring 332 is compressed (telescoping link assembly 300 telescopes outwardly).

The latch pins 100 can be confirmed to both be in their fully engaged or latched position when the linear actuator 102 is fully extended as indicated by second sensor 210, the first limit switch 308 is not activated by the first washer 334, and the second limit switch 310 is not activated by the second washer 336. When this state is communicated to the controller 202 by the first 208 and second 210 sensors, the controller 202 permits plowing to commence by permitting the hydraulic cylinder 70 to raise and lower the A-frame 22 and hence plow blade 34 relative to the lift frame 24 in response to activation of the in-cab lift switch by the operator.

Alternatively, the first sensor 208 could sense a velocity or a current of the linear actuator 102 to determine that the arm holes 92, 94 and the receiver holes 156, 158 are not aligned.

Figure 10A:
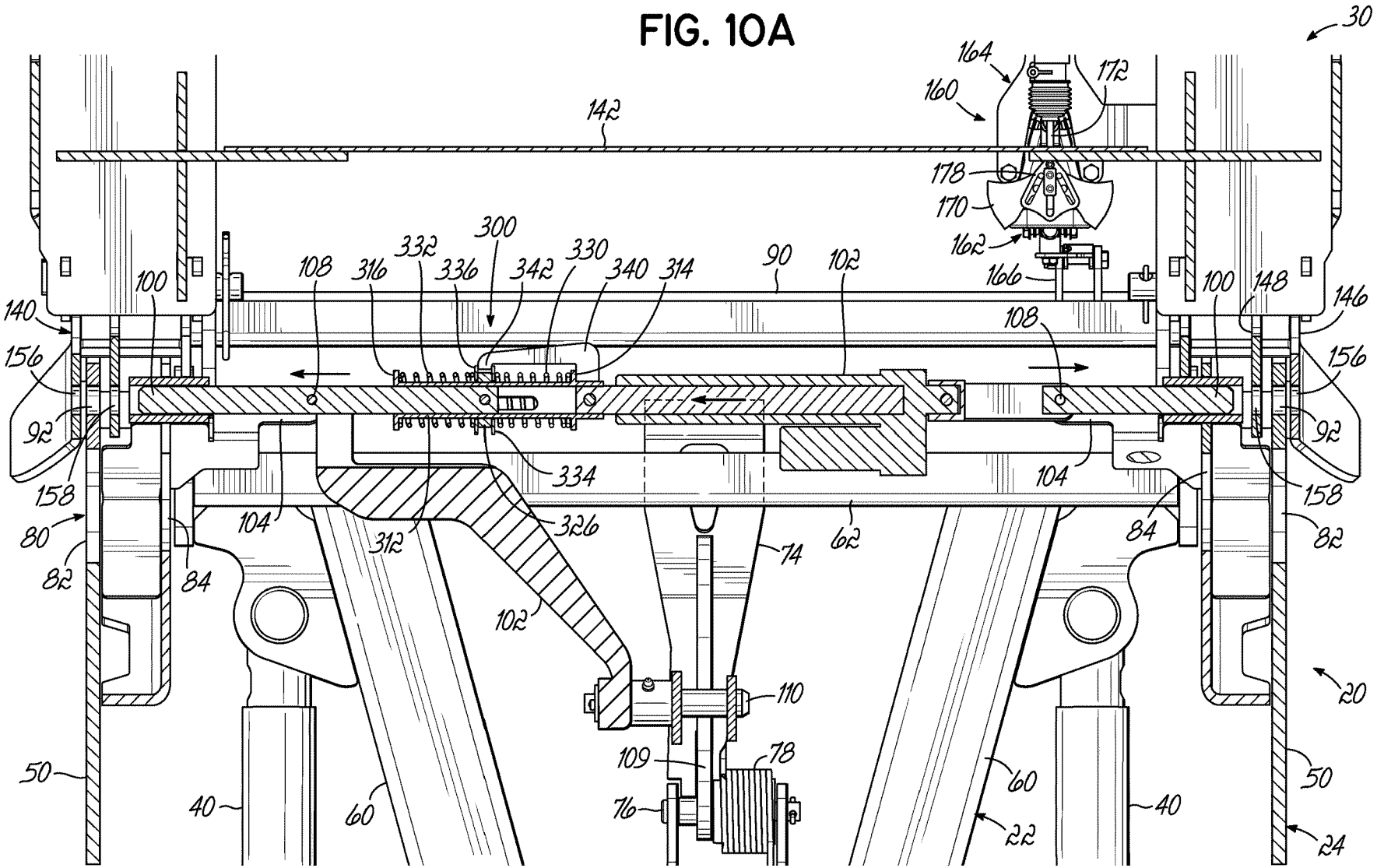
Figure 10B:
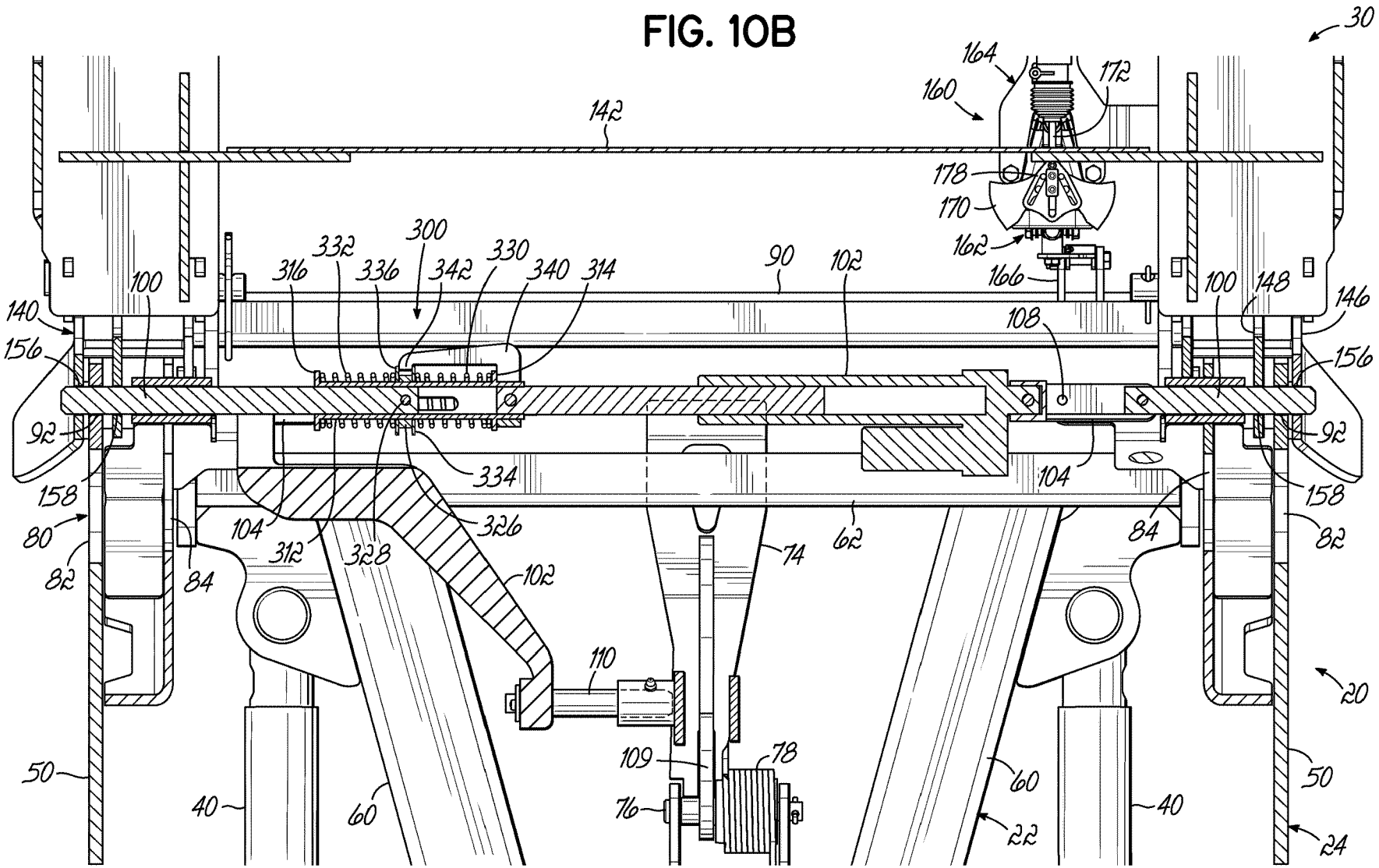
Figure 10C:
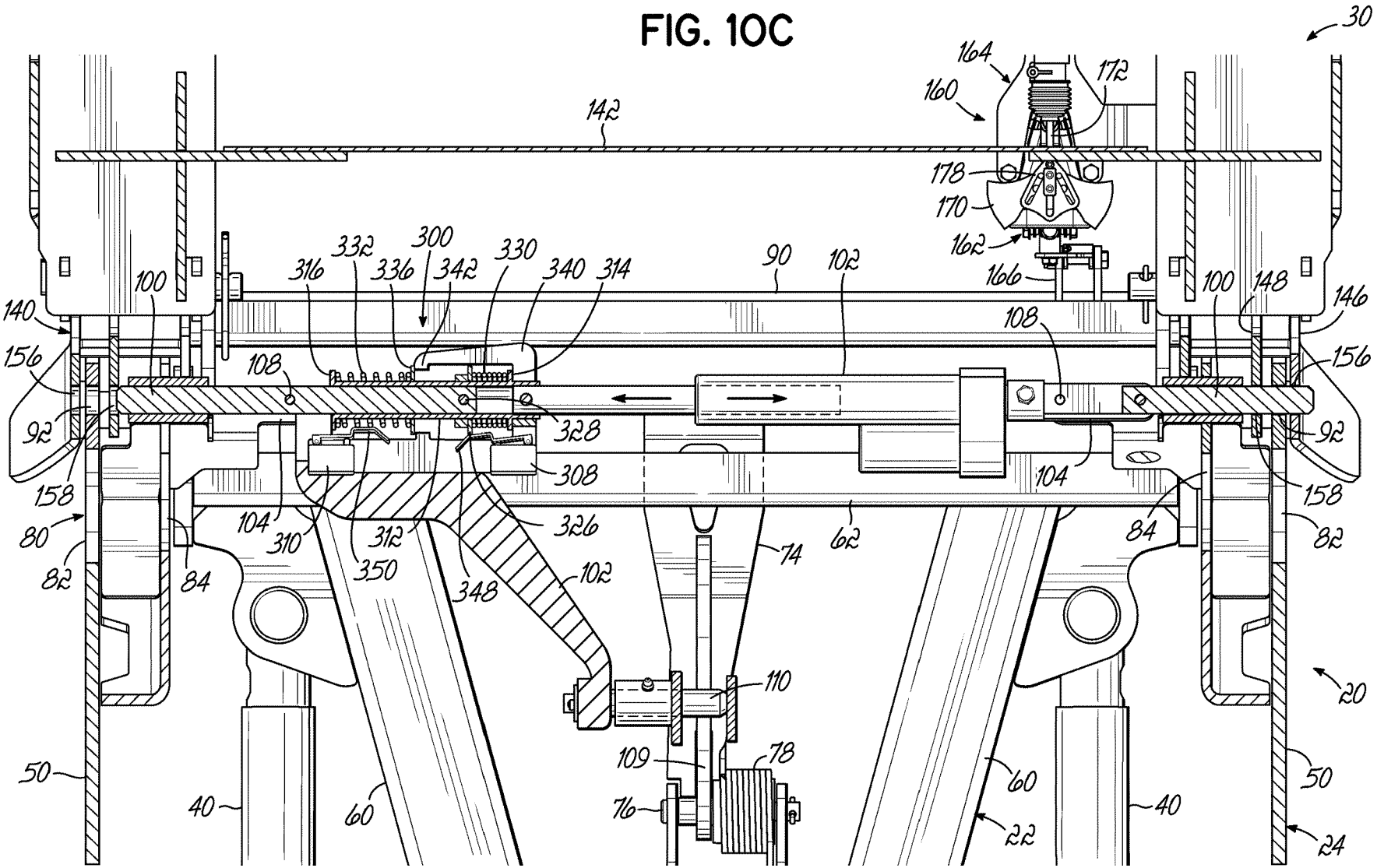
Figure 10D:
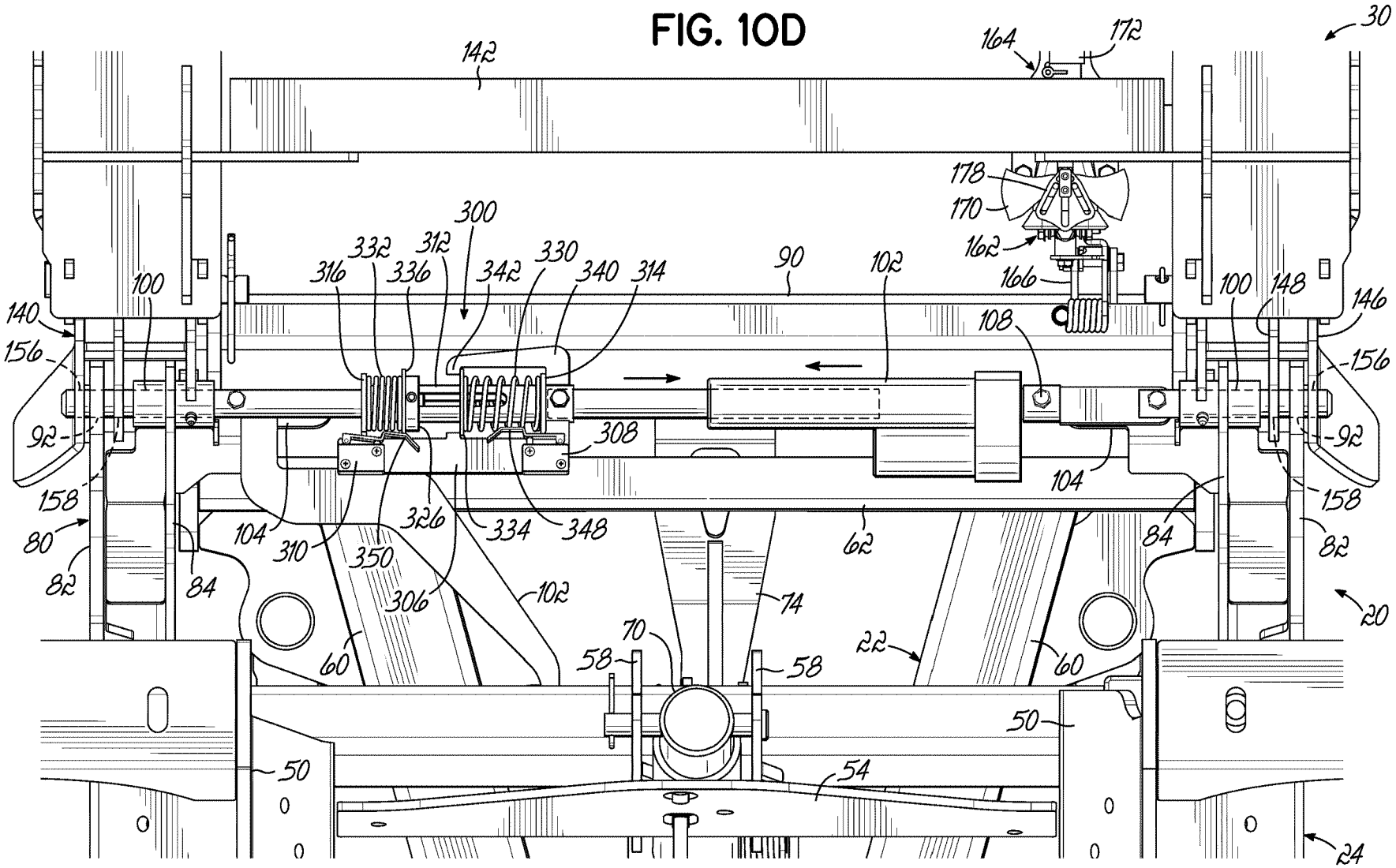
Figure 11A:
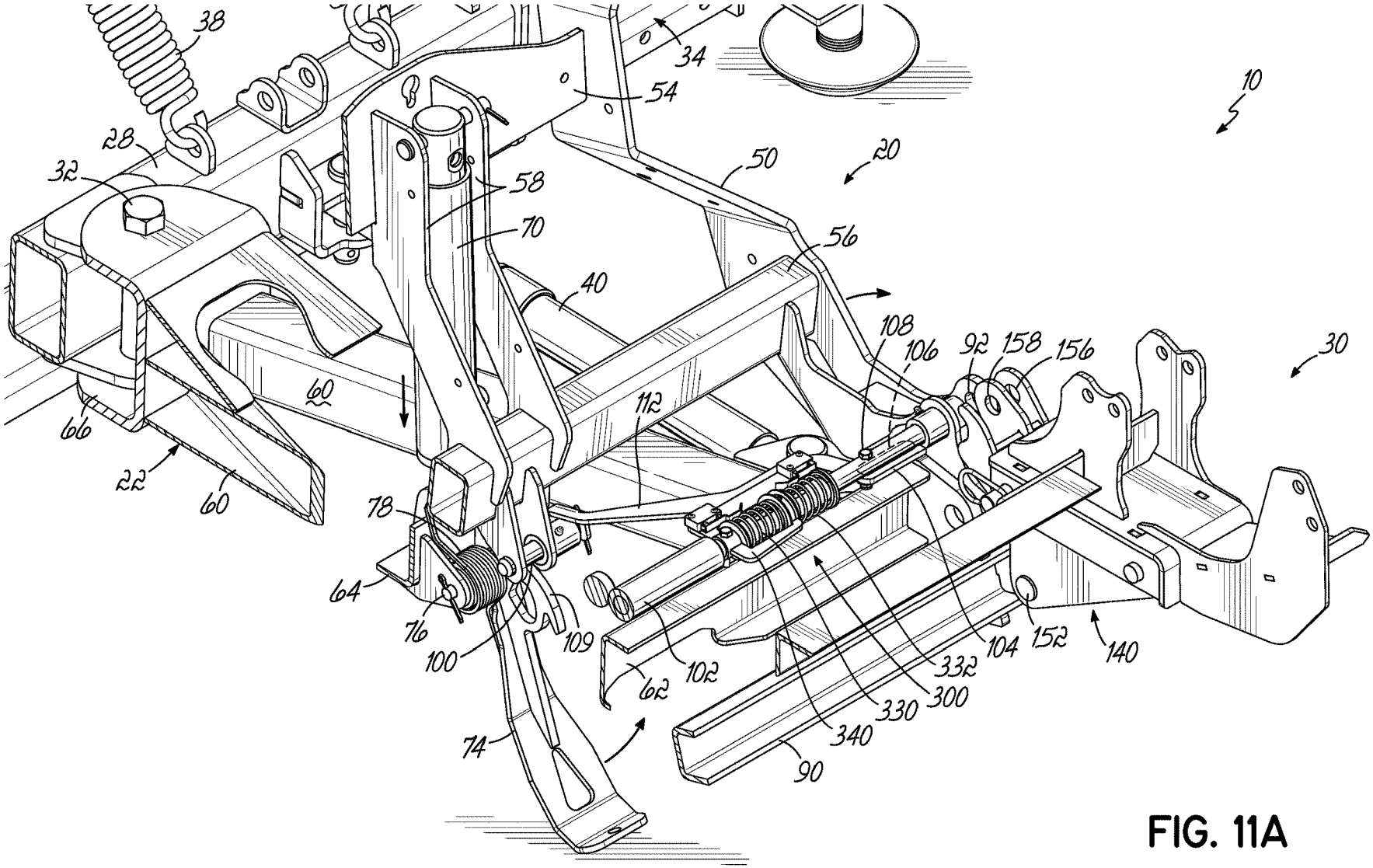
FIGS. 11A-11C are rear left top perspective views, partially broken away, of the assembly of FIG. 1 in various stages of hitching the snow plow frame to the mount frame.
Figure 11B:
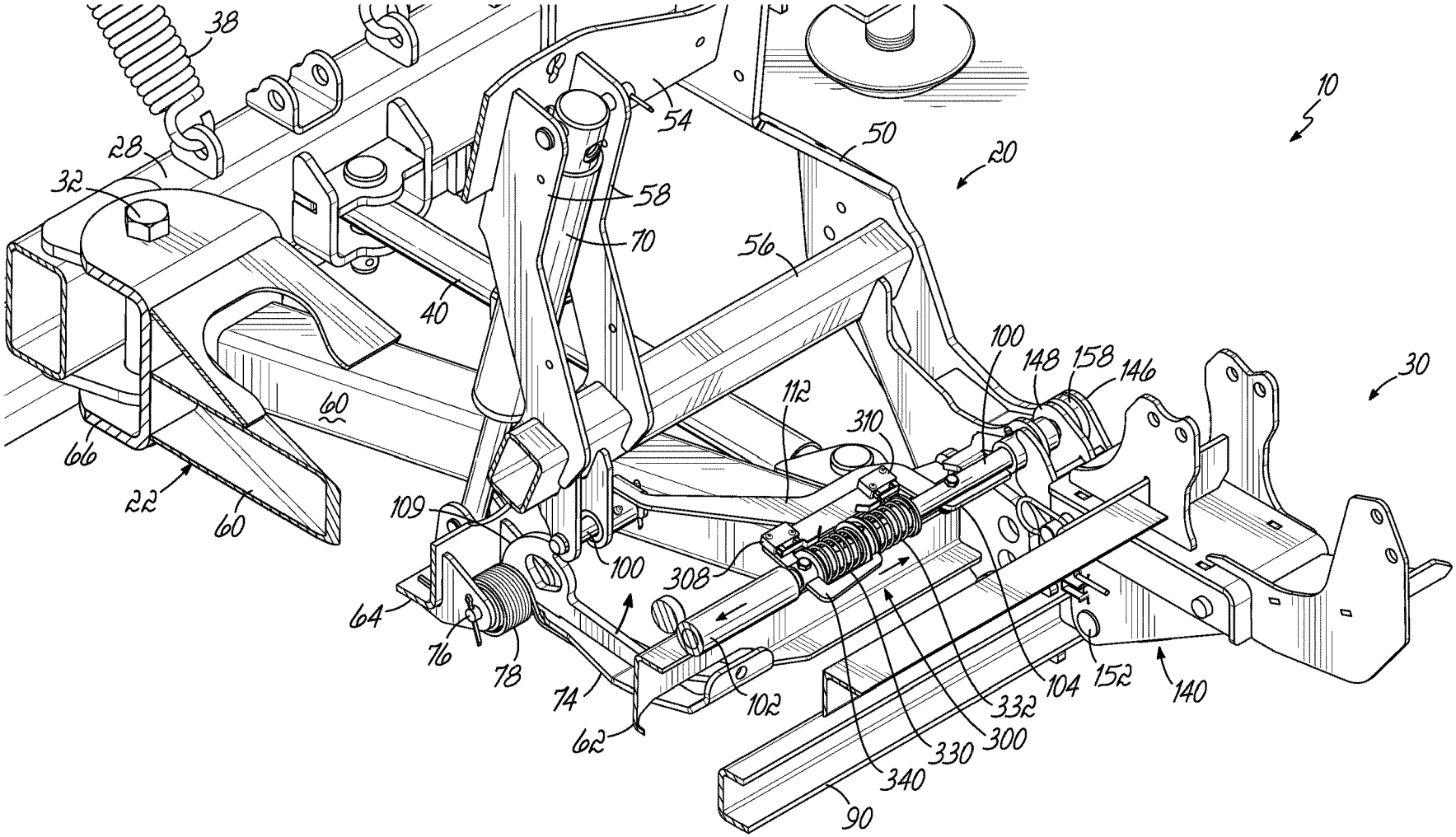
Figure 11C:
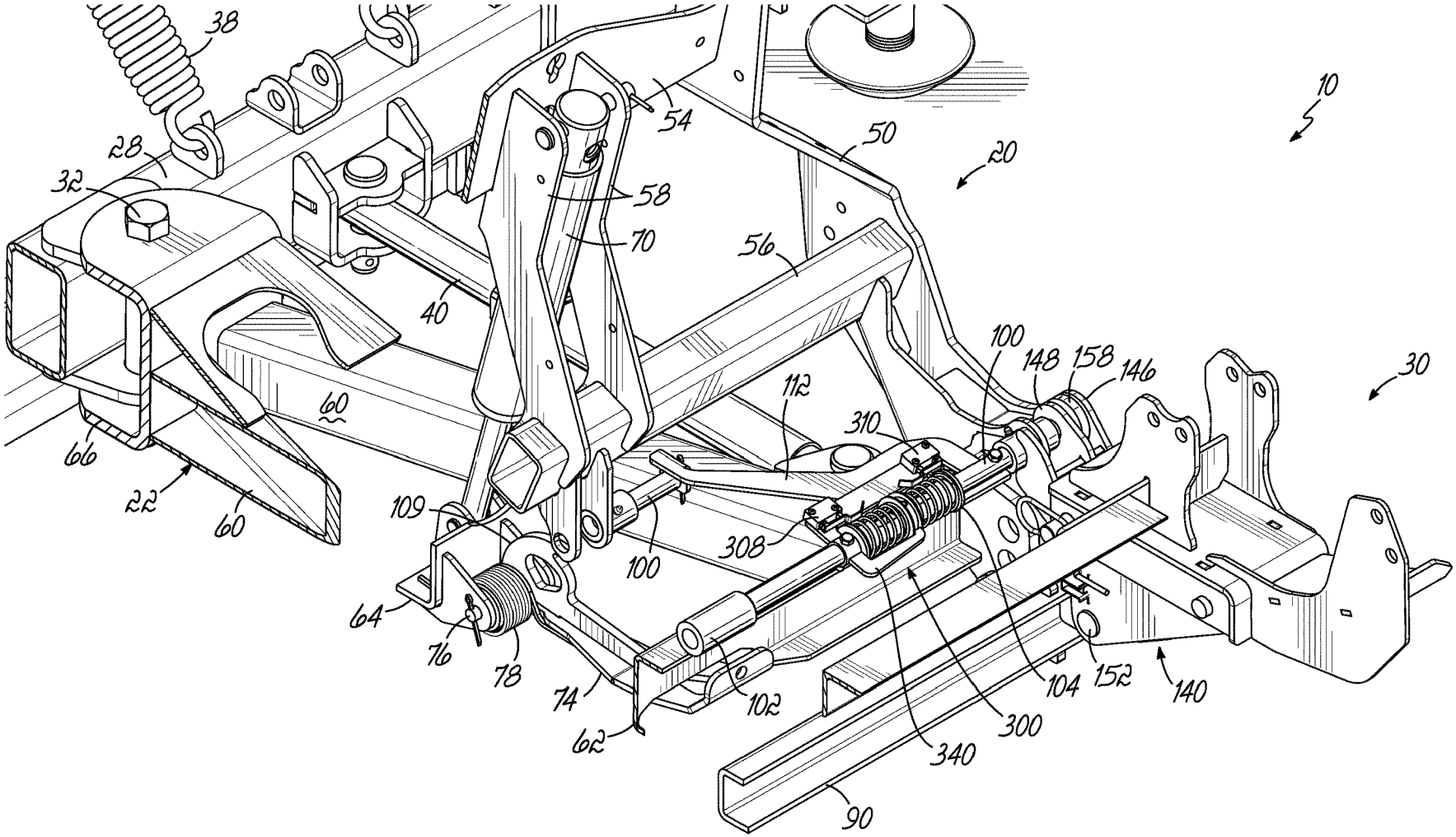

Referring to FIGS. 10A and 10B, the arm holes 92, 94 and the receiver holes 156, 158 are aligned during extension of linear actuator 102 and hence extension of latch pins 100 to their extended latched position. In FIG. 10C, the right hand (passenger side) pin 100 has failed to extend during extension of the actuator 102 due to misalignment of the arm holes 92, 94 and the receiver holes 156, 158, compressing the left hand (first) compression spring 330. In FIG. 10D, both the left hand (driver side) and right hand (passenger side) latch pins 100 have failed to retract during retraction of the actuator 102 due to misalignment of the arm holes 92, 94 and the receiver holes 156, 158 on both sides, compressing the right hand (second) compression spring 332. Note that in the event that both latch pins 100 fail to fully retract (or fully extend), the telescoping link assembly 300, linear actuator 102, hydraulic cylinder 70, and controller 202 work essentially in the same manner described above to detect and alleviate misalignment of the holes 92, 94 and 156, 158.

Note that while a single linear actuator 102 has been shown which extends and retracts both latch pins 100, the invention could also be practiced with a pair of linear actuators, each associated with a respective one of the latch pins 100. The pair of linear actuators could move the latch pins 100 simultaneously or in seriatim.

Note also that while the position of the latch pins 100 has been described as being sensed indirectly via the telescoping link assembly 300, the position of the latch pins 100 could also be sensed directly. For example, non-contact sensors such as "Hall effect" sensors or magnetic reed switches could be utilized. As another example, contact sensors such as proximity switches or limit switches could be utilized.

Note further that while the operation of the snow plow assembly has been described in the context of the operator activating one or more switches inside the cab of the vehicle during various stages of latching and unlatching, the control system 200 could be configured to automatically perform all the steps required to latch the lift frame 24 to the mount frame 30 upon a single activation of a switch, and perform all the steps required to unlatch the lift frame 24 from the mount frame 30 upon a single activation of a switch. For that matter, the control system 200 could be configured to automatically perform all the steps required to latch the lift frame 24 to the mount frame 30 upon an electrical connection being made between the male portion 162 and the female portion 164 of the connector 160, without an operator activating any switch.

Note still further that while the assembly has been described as having the lift frame 24 of the plow frame 20 connected to the mount frame 30, the invention can also be practiced with the A-frame 22 of the plow frame 20 connected to the mount frame 30. Such a configuration is shown in the assignee's U.S. Pat. No. RE35,700, hereby incorporated by reference herein as if fully set forth in its entirety, wherein it will be seen that the A-frame is pinned to the mount frame and the lift frame is pinned to the A-frame.

The improved snowplow and mount assembly provides drive-in alignment, establishes the electrical connection between the vehicle and snow plow, provides remote actuated hitch pins, and provides automatic stand operation, all controlled from inside the vehicle. These functions eliminate operator error in the attachment/detachment process, insure correct attachment/detachment, reduce operator exposure to hazards, and generally provide quicker and easier operation, all the while permitting the operator to remain inside the vehicle.

Referring now to FIGS. 13-19C, and with like numbers representing like elements, an alternative embodiment of a snow plow and mount assembly 10 of the present invention is illustrated. In this embodiment, the basic structures such as the A-frame 22, the lift frame 24, the first actuator (hydraulic cylinder 70) for imparting relative pivoting movement between the A-frame 22 and the lift frame 24, and the mount frame 30 are substantially the same as in the prior described embodiment. Also in this embodiment, the electrical connection is made between the vehicle electrical system and the snow plow frame 20 substantially the same as in the prior described embodiment, but the same has not been shown for clarity. The primary differences between this embodiment and the prior embodiment are in the latch mechanism and support stand actuation, which will now be described.

Referring generally to all of the FIGS. 13-19C, each rearwardly extending arm 80 of the lift frame has a fixed latch pin 400 extending between the pair of spaced apart plates 82, 84 that make up each arm 80. Each receiver 140 includes a latch mechanism 500 mounted between the inner plate 144 and outer plate 146. Each latch mechanism 500 has a latch hook 502 pivotally mounted with a pin 504 between the receiver plates 144, 146, and a latch pawl 506 pivotally mounted with a pin 508 between the receiver plates 144, 146. The latch hook 502 is spring biased to an open (unlatched) position via a tension spring 510 connected to the latch hook 502 and latch pawl 506. The latch pawl 506 is spring biased to an engaged position via the tension spring 510. The latch pawl 506 has a notch 512 to engage the latch hook 502 when the latch pawl 506 is rotated to an engaged position, preventing rotation of the latch hook 502. The latch hook 502 has a recess 514 to accept the latch pin 400 on the lift frame 24, such that when the lift frame 24 is in an upright position it is secured to the receivers 140. Each latch mechanism 500 also includes a second actuator, for example a linear actuator, 520 having one end 522 connected to inner receiver plate 144 and another end 524 connected to a link 526 which itself is connected to latch pawl pin 508, to move the latch pawl 506 from an engaged position to a disengaged position. The support stand cam actuating pin 110 is moved between its deployed position in contact with the cam surface 109 on the stand 74 and its retracted position out of contact with the stand 74 by a third actuator, for example a linear actuator, 540 having one end 542 connected to lower transverse frame member 56 of lift frame 24 and another end 544 connected to the stand actuating pin 110.

The snowplow frame 20 is attached to the mount frame 30 in the following manner. Referring now to FIGS. 15A-18E, rotational motion of the lift frame 24 towards an upright position via energizing actuator 70 to extend results in the latch pins 400 on the lift frame 24 contacting the latch hooks 502. This causes rotation of the latch hooks 502 towards the engaged position. The rotation of the latch hooks 502 causes rotation of the latch pawls 506 due to contact between them resulting from the bias of spring 510. As the lift frame 24 reaches an upright position, the hitch pins 152 in the receivers 140 contact the arc-shaped recesses 88 in the arms 80 to stop further rotation. The latch hook 502 has rotated to a position which allows the spring 510 to move the latch pawl 506 to an engaged position with respect to the latch hook 502. When the latch pawl 506 is engaged with the latch hook 502, the latch hook 502 cannot rotate in either direction. The lift frame 24 is thereby retained to the receivers 140 for plowing operation. At this point the stand 74 has retracted to its stored position off of the ground or pavement. The third actuator 540 is then energized to move the stand actuator pin 110 to its retracted position.

The snowplow frame 20 is detached from the mount frame 30 in the following manner. Referring now to FIGS. 18F-19C, first actuator 70 is energized to extend to rotate the lift frame 24 away from the A-frame 22 to a full upright position, unloading the latch hooks 502. Second actuators 520 are energized to move the latch pawls 506 to a disengaged position. Third actuator 540 is energized to move the stand actuator pin 110 to its extended position. First actuator 70 is energized to retract to rotate the lift frame 24 towards the A-frame 22. The rotation of the lift frame 24 moves the latch pins 400 out of the latch hooks 502, rotating the latch hooks 502 to an open position, ready for re-attaching the plow. Rotational motion of the lift frame 24 towards the A-frame 22 also deploys the stand 74 to the extended ground or pavement contacting position.

Note that while the latch mechanisms 500 have been described such that the second actuators 520 are energized to unlatch and are otherwise free to move, the latch mechanisms 500 could also be designed such that the second actuators 520 are energized to latch and are otherwise free to move, and the latch mechanisms 500 could also be designed such that the second actuators 520 are energized in both opposite directions to both latch and unlatch.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A snow plow and mount assembly comprising:

a mount frame adapted to be secured to a vehicle, a snow plow frame having an A-frame and a lift frame pivotally connected relative to one another for pivoting movement about a generally transverse horizontal axis, a plow blade pivotally connected relative to said A-frame for pivoting movement about a generally vertical axis, a first actuator operably associated with said A-frame and said lift frame for imparting relative pivoting movement between said A-frame and said lift frame, said first actuator powered by an electrical system of the vehicle, and one of said lift frame and said mount frame having a latch mechanism and a second actuator for at least one of moving said latch mechanism to a latched position for securing said snow plow frame to said mount frame and moving said latch mechanism to an unlatched position freeing said snow plow frame to move away from said mount frame, said second actuator powered by the electrical system of the vehicle, said assembly operable such that when the vehicle is driven toward said snow plow said snow plow frame mates with said mount frame and an electrical connection is made between the vehicle electrical system and at least said first actuator without manual manipulation, and when said second actuator is energized said latch mechanism is either moved to the latched position thereby removably securing said snow plow frame to said mount frame or is moved to the unlatched position thereby freeing said snow plow frame from said mount frame, wherein one of said lift frame and said mount frame has a latch pin and the other of said lift frame and said mount frame has said latch mechanism, said latch mechanism including a pivoting latch hook and a pivoting latch pawl, whereby when said lift frame is moved to a raised position by said first actuator said latch pin is received by said latch hook, and wherein actuation of said second actuator is operable to either rotate said latch pawl to an engaged position with said latch hook to prevent rotation of said latch hook thereby removably securing said snow plow frame to said mount frame, or rotate said latch pawl to a disengaged position with said latch hook thereby permitting said latch pin to move out of said latch hook when said lift frame is moved to a lowered position by said first actuator thereby freeing said snow plow frame from said mount frame.

2. The assembly of claim 1 wherein said lift frame of said snow plow frame mates with said mount frame.

3. The assembly of claim 2 wherein said latch mechanism and said second actuator are on said mount frame.

4. The assembly of claim 3 wherein one of said lift frame and said mount frame has at least a first arm and the other of said lift frame and said mount frame has at least a first receiver, and wherein said at least a first arm is received in said at least a first receiver upon relative movement therebetween towards one another.

5. The assembly of claim 4 wherein said lift frame includes first and second said arms and said mount frame includes first and second said receivers, said first and second arms received in respective ones of said first and second receivers upon relative movement therebetween towards one another.

6. The assembly of claim 5 wherein each said receiver includes a said latch mechanism and a said second actuator.

7. The assembly of claim 1 wherein said latch pawl is biased to an engaged position with said latch hook to prevent rotation of said latch hook thereby removably securing said snow plow frame to said mount frame, and wherein actuation of said second actuator is operable to rotate said latch pawl against the bias to a disengaged position with said latch hook thereby permitting said latch pin to move out of said latch hook when said lift frame is moved to a lowered position by said first actuator thereby freeing said snow plow frame from said mount frame.

8. A snow plow and mount assembly comprising:

a mount frame adapted to be secured to a vehicle, a snow plow frame having an A-frame and a lift frame pivotally connected relative to one another for pivoting movement about a generally transverse horizontal axis, a plow blade pivotally connected relative to said A-frame for pivoting movement about a generally vertical axis, a first actuator operably associated with said A-frame and said lift frame for imparting relative pivoting movement between said A-frame and said lift frame, said first actuator powered by an electrical system of the vehicle, and one of said lift frame and said mount frame having a latch mechanism and a second actuator for at least one of moving said latch mechanism to a latched position for securing said snow plow frame to said mount frame and moving said latch mechanism to an unlatched position freeing said snow plow frame to move away from said mount frame, said second actuator powered by the electrical system of the vehicle, said assembly operable such that when the vehicle is driven toward said snow plow said snow plow frame mates with said mount frame and an electrical connection is made between the vehicle electrical system and at least said first actuator without manual manipulation, and when said second actuator is energized said latch mechanism is either moved to the latched position thereby removably securing said snow plow frame to said mount frame or is moved to the unlatched position thereby freeing said snow plow frame from said mount frame, wherein said lift frame of said snow plow frame mates with said mount frame, wherein said latch mechanism and said second actuator are on said mount frame, wherein one of said lift frame and said mount frame has at least a first arm and the other of said lift frame and said mount frame has at least a first receiver, and wherein said at least a first arm is received in said at least a first receiver upon relative movement therebetween towards one another, wherein said lift frame includes first and second said arms and said mount frame includes first and second said receivers, said first and second arms received in respective ones of said first and second receivers upon relative movement therebetween towards one another, wherein each said receiver includes a said latch mechanism and a said second actuator, each said arm includes a latch pin, each said receiver includes a pair of side plates, and each said latch mechanism includes a latch hook pivotally connected between said side plates and a latch pawl pivotally connected between said side plates, said latch hook being spring biased to an unlatched position, said latch pawl being spring biased to an engaged position, said latch pawl having a notch that engages said latch hook when rotated to the engaged position to prevent rotation of said latch hook, said latch hook having a recess adapted to receive a respective latch pin, whereby when said lift frame is moved to a raised position by said first actuator said latch pins are received in respective ones of said latch hook recesses and said latch pawl notches engage with respective ones of said latch hooks to prevent rotation of said latch hooks thereby removably securing said snow plow frame to said mount frame, and whereby when said second actuators are energized said latch pawls are rotated to a disengaged position, and said latch pins move out of said respective ones of said latch hook recesses when said lift frame is moved to a lowered position by said first actuator thereby freeing said snow plow frame from said mount frame.

9. The assembly of claim 8 wherein each said arm has a recess therein and each said receiver has a hitch pin therein, said hitch pins received in respective ones of said recesses upon relative movement therebetween towards one another.

10. A snow plow and mount assembly comprising:

a mount frame adapted to be secured to a vehicle, a snow plow frame having an A-frame and a lift frame pivotally connected relative to one another for pivoting movement about a generally transverse horizontal axis, a plow blade pivotally connected relative to said A-frame for pivoting movement about a generally vertical axis, a first actuator operably associated with said A-frame and said lift frame for imparting relative pivoting movement between said A-frame and said lift frame, said first actuator powered by an electrical system of the vehicle, and one of said lift frame and said mount frame having a latch mechanism and a second actuator for at least one of moving said latch mechanism to a latched position for securing said snow plow frame to said mount frame and moving said latch mechanism to an unlatched position freeing said snow plow frame to move away from said mount frame, said second actuator powered by the electrical system of the vehicle, said assembly operable such that when the vehicle is driven toward said snow plow said snow plow frame mates with said mount frame and an electrical connection is made between the vehicle electrical system and at least said first actuator without manual manipulation, and when said second actuator is energized said latch mechanism is either moved to the latched position thereby removably securing said snow plow frame to said mount frame or is moved to the unlatched position thereby freeing said snow plow frame from said mount frame, a support stand pivotally connected to said A-frame for pivoting movement to an extended ground contacting and snow plow frame supporting position and to a retracted position at which said support stand does not contact the ground and does not support said snow plow frame, said support stand biased toward the retracted position, a third actuator operably associated with said support stand and powered by the electrical system of the vehicle, said assembly operable such that when the vehicle is driven toward said snow plow said snow plow frame mates with said mount frame and an electrical connection is made between the vehicle electrical system and said third actuator without manual manipulation, such that when said third actuator is energized in a first direction, and when said first actuator is energized to pivot said lift frame relative to said A-frame in a downward direction, pivoting of said lift frame relative to said A-frame in the downward direction moves said support stand from the retracted position to the extended position, and when said first actuator is energized to pivot said lift frame relative to said A-frame in an upward direction, said support stand returns to the retracted position, and when said third actuator is energized in a second opposite direction pivoting of the A-frame relative to the lift frame in the upward direction does not cause said support stand to move from the retracted position to the extended position.

11. The assembly of claim 10 wherein said mount frame has one of a male connector and a female connector in electrical communication with the vehicle electrical system, and said lift frame has the other of said male connector and said female connector in operable electrical communication with said first actuator and said third actuator, and wherein when said snow plow frame mates with said mount frame said male and female connectors connect to make electrical contact.

12. A snow plow and mount assembly comprising:

a mount frame adapted to be secured to a vehicle, a snow plow frame having an A-frame and a lift frame pivotally connected relative to one another for pivoting movement about a generally transverse horizontal axis, a plow blade pivotally connected relative to said A-frame for pivoting movement about a generally vertical axis, a first actuator operably associated with said A-frame and said lift frame for imparting relative pivoting movement between said A-frame and said lift frame, said first actuator powered by an electrical system of the vehicle, and one of said lift frame and said mount frame having a latch mechanism and a second actuator for at least one of moving said latch mechanism to a latched position for securing said snow plow frame to said mount frame and moving said latch mechanism to an unlatched position freeing said snow plow frame to move away from said mount frame, said second actuator powered by the electrical system of the vehicle, said assembly operable such that when the vehicle is driven toward said snow plow said snow plow frame mates with said mount frame and an electrical connection is made between the vehicle electrical system and at least said first actuator without manual manipulation, and when said second actuator is energized said latch mechanism is either moved to the latched position thereby removably securing said snow plow frame to said mount frame or is moved to the unlatched position thereby freeing said snow plow frame from said mount frame, a support stand pivotally connected to said A-frame for pivoting movement to an extended ground contacting and snow plow frame supporting position and to a retracted position at which said support stand does not contact the ground and does not support said snow plow frame, said support stand biased toward the retracted position, said support stand having a cam surface thereon, a cam actuating pin connected to said lift frame for translational movement between an extended position and a retracted position, a third actuator for moving said cam actuating pin between the extended and retracted positions, said third actuator powered by the electrical system of the vehicle, said assembly operable such that when the vehicle is driven toward said snow plow said snow plow frame mates with said mount frame and an electrical connection is made between the vehicle electrical system and said third actuator without manual manipulation, said cam actuating pin operably associated with said support stand cam surface such that when said third actuator is energized in a first direction said cam actuating pin moves to the extended position, and when said first actuator is energized to pivot said lift frame relative to said A-frame in a downward direction, said cam actuating pin contacts said support stand cam surface whereupon further pivoting of said lift frame relative to said A-frame in the downward direction moves said support stand from the retracted position to the extended position, and when said first actuator is energized to pivot said lift frame relative to said A-frame in an upward direction said support stand returns to the retracted position, and when said third actuator is energized in a second opposite direction said cam actuating pin moves to the retracted position where said cam actuating pin cannot contact said support stand cam surface during relative pivoting of said lift frame and A-frame.

13. The assembly of claim 12 wherein said first actuator is a hydraulic cylinder operably connected to said A-frame and to said lift frame, said second actuators are electric linear actuators operably connected to said latch pawls and said mount frame, and said third actuator is an electric linear actuator operably connected to said cam actuating pin and said lift frame.

14. A snow plow and mount assembly comprising:

a mount frame adapted to be secured to a vehicle, a snow plow frame having an A-frame and a lift frame pivotally connected relative to one another for pivoting movement about a generally transverse horizontal axis, a plow blade pivotally connected relative to said A-frame for pivoting movement about a generally vertical axis, a first actuator operably associated with said A-frame and said lift frame for imparting relative pivoting movement between said A-frame and said lift frame, said first actuator powered by an electrical system of the vehicle, one of said mount frame and said lift frame having first and second arms and the other of said mount frame and said lift frame having first and second receivers, said first and second arms received in respective ones of said first and second receivers upon relative movement therebetween towards one another, and said mount frame having at least one latch mechanism and at least one second actuator for either moving said latch mechanism to a latched position for securing said snow plow frame to said mount frame or for moving said latch mechanism to an unlatched position freeing said snow plow frame to move away from said mount frame, said second actuator powered by the electrical system of the vehicle, said assembly operable such that when the vehicle is driven toward said snow plow, said first and second arms are received in respective ones of said first and second receivers and an electrical connection is made between the vehicle electrical system and said first actuator without manual manipulation, and when said second actuator is energized said latch mechanism is either moved to the latched position thereby removably securing said snow plow frame to said mount frame or is moved to the unlatched position thereby freeing said snow plow frame from said mount frame, said lift frame having a latch pin and said latch mechanism including a pivoting latch hook and a pivoting latch pawl, said latch pin received by said latch hook, and wherein actuation of said second actuator is operable to either rotate said latch pawl to an engaged position with said latch hook to prevent rotation of said latch hook thereby removably securing said snow plow frame to said mount frame, or rotate said latch pawl to a disengaged position with said latch hook thereby permitting said latch pin to move out of said latch hook thereby freeing said snow plow frame from said mount frame.

15. The assembly of claim 14 wherein said first and second arms are on said lift frame and said first and second receivers are on said mount frame.

16. The assembly of claim 15 wherein each said receiver has a said latch mechanism and a said second actuator.

17. The assembly of claim 14 wherein said latch pawl is biased to an engaged position with said latch hook to prevent rotation of said latch hook thereby removably securing said snow plow frame to said mount frame, and wherein actuation of said second actuator is operable to rotate said latch pawl against the bias to a disengaged position with said latch hook thereby freeing said snow plow frame from said mount frame.

18. A snow plow and mount assembly comprising:

a mount frame adapted to be secured to a vehicle, a snow plow frame having an A-frame and a lift frame pivotally connected relative to one another for pivoting movement about a generally transverse horizontal axis, a plow blade pivotally connected relative to said A-frame for pivoting movement about a generally vertical axis, a first actuator operably associated with said A-frame and said lift frame for imparting relative pivoting movement between said A-frame and said lift frame, said first actuator powered by an electrical system of the vehicle, one of said mount frame and said lift frame having first and second arms and the other of said mount frame and said lift frame having first and second receivers, said first and second arms received in respective ones of said first and second receivers upon relative movement therebetween towards one another, and said mount frame having at least one latch mechanism and at least one second actuator for either moving said latch mechanism to a latched position for securing said snow plow frame to said mount frame or for moving said latch mechanism to an unlatched position freeing said snow plow frame to move away from said mount frame, said second actuator powered by the electrical system of the vehicle, said assembly operable such that when the vehicle is driven toward said snow plow, said first and second arms are received in respective ones of said first and second receivers and an electrical connection is made between the vehicle electrical system and said first actuator without manual manipulation, and when said second actuator is energized said latch mechanism is either moved to the latched position thereby removably securing said snow plow frame to said mount frame or is moved to the unlatched position thereby freeing said snow plow frame from said mount frame, wherein said first and second arms are on said lift frame and said first and second receivers are on said mount frame, wherein each said receiver has a said latch mechanism and a said second actuator, each said arm includes a latch pin, each said receiver includes a pair of side plates, and each said latch mechanism includes a latch hook pivotally connected between said side plates and a latch pawl pivotally connected between said side plates, said latch hook being spring biased to an unlatched position, said latch pawl being spring biased to an engaged position, said latch pawl having a notch that engages said latch hook when rotated to the engaged position to prevent rotation of said latch hook, said latch hook having a recess adapted to receive a respective latch pin, whereby when said lift frame is moved to a raised position by said first actuator said latch pins are received in respective ones of said latch hook recesses and said latch pawl notches engage with respective ones of said latch hooks to prevent rotation of said latch hooks thereby removably securing said snow plow frame to said mount frame, and whereby when said second actuators are energized said latch pawls are rotated to a disengaged position, and said latch pins move out of said respective ones of said latch hook recesses when said lift frame is moved to a lowered position by said first actuator thereby freeing said snow plow frame from said mount frame.

19. The assembly of claim 18 wherein each said arm has a recess therein and each said receiver has a hitch pin therein, said hitch pins received in respective ones of said recesses upon relative movement therebetween towards one another.

20. A snow plow and mount assembly comprising:

a mount frame adapted to be secured to a vehicle, a snow plow frame having an A-frame and a lift frame pivotally connected relative to one another for pivoting movement about a generally transverse horizontal axis, a plow blade pivotally connected relative to said A-frame for pivoting movement about a generally vertical axis, a first actuator operably associated with said A-frame and said lift frame for imparting relative pivoting movement between said A-frame and said lift frame, said first actuator powered by an electrical system of the vehicle, one of said mount frame and said lift frame having first and second arms and the other of said mount frame and said lift frame having first and second receivers, said first and second arms received in respective ones of said first and second receivers upon relative movement therebetween towards one another, and said mount frame having at least one latch mechanism and at least one second actuator for either moving said latch mechanism to a latched position for securing said snow plow frame to said mount frame or for moving said latch mechanism to an unlatched position freeing said snow plow frame to move away from said mount frame, said second actuator powered by the electrical system of the vehicle, said assembly operable such that when the vehicle is driven toward said snow plow, said first and second arms are received in respective ones of said first and second receivers and an electrical connection is made between the vehicle electrical system and said first actuator without manual manipulation, and when said second actuator is energized said latch mechanism is either moved to the latched position thereby removably securing said snow plow frame to said mount frame or is moved to the unlatched position thereby freeing said snow plow frame from said mount frame, a support stand pivotally connected to said A-frame for pivoting movement to an extended ground contacting and snow plow frame supporting position and to a retracted position at which said support stand does not contact the ground and does not support said snow plow frame, said support stand biased toward the retracted position, a third actuator operably associated with said support stand and powered by the electrical system of the vehicle, said assembly operable such that when the vehicle is driven toward said snow plow said first and second arms are received in respective ones of said first and second receivers and an electrical connection is made between the vehicle electrical system and said third actuator without manual manipulation, such that when said third actuator is energized in a first direction, and when said first actuator is energized to pivot said lift frame relative to said A-frame in a downward direction, pivoting of said lift frame relative to said A-frame in the downward direction moves said support stand from the retracted position to the extended position, and when said first actuator is energized to pivot said lift frame relative to said A-frame in an upward direction, said support stand returns to the retracted position, and when said third actuator is energized in a second opposite direction pivoting of the A-frame relative to the lift frame in the upward direction does not cause said support stand to move from the retracted position to the extended position.

21. The assembly of claim 20 further including a controller that sends signals to said first, second, and third actuators in response to inputs received by said controller.

22. A snow plow and mount assembly comprising:

a mount frame adapted to be secured to a vehicle, a snow plow frame having an A-frame and a lift frame pivotally connected relative to one another for pivoting movement about a generally transverse horizontal axis, a plow blade pivotally connected relative to said A-frame for pivoting movement about a generally vertical axis, a first actuator operably associated with said A-frame and said lift frame for imparting relative pivoting movement between said A-frame and said lift frame, said first actuator powered by an electrical system of the vehicle, one of said mount frame and said lift frame having first and second arms and the other of said mount frame and said lift frame having first and second receivers, said first and second arms received in respective ones of said first and second receivers upon relative movement therebetween towards one another, and said mount frame having at least one latch mechanism and at least one second actuator for either moving said latch mechanism to a latched position for securing said snow plow frame to said mount frame or for moving said latch mechanism to an unlatched position freeing said snow plow frame to move away from said mount frame, said second actuator powered by the electrical system of the vehicle, said assembly operable such that when the vehicle is driven toward said snow plow, said first and second arms are received in respective ones of said first and second receivers and an electrical connection is made between the vehicle electrical system and said first actuator without manual manipulation, and when said second actuator is energized said latch mechanism is either moved to the latched position thereby removably securing said snow plow frame to said mount frame or is moved to the unlatched position thereby freeing said snow plow frame from said mount frame, a support stand pivotally connected to said A-frame for pivoting movement to an extended ground contacting and snow plow frame supporting position and to a retracted position at which said support stand does not contact the ground and does not support said snow plow frame, said support stand biased toward the retracted position, said support stand having a cam surface thereon, a cam actuating pin connected to said lift frame for translational movement between an extended position and a retracted position, a third actuator for moving said cam actuating pin between the extended and retracted positions, said third actuator powered by the electrical system of the vehicle, said assembly operable such that when the vehicle is driven toward said snow plow said first and second arms are received in respective ones of said first and second receivers and an electrical connection is made between the vehicle electrical system and said third actuator without manual manipulation, said cam actuating pin operably associated with said support stand cam surface such that when said third actuator is energized in a first direction said cam actuating pin moves to the extended position, and when said first actuator is energized to pivot said lift frame relative to said A-frame in a downward direction, said cam actuating pin contacts said support stand cam surface whereupon further pivoting of said lift frame relative to said A-frame in the downward direction moves said support stand from the retracted position to the extended position, and when said first actuator is energized to pivot said lift frame relative to said A-frame in an upward direction said support stand returns to the retracted position, and when said third actuator is energized in a second opposite direction said cam actuating pin moves to the retracted position where said cam actuating pin cannot contact said support stand cam surface during relative pivoting of said lift frame and A-frame.

23. The assembly of claim 22 wherein said first actuator is a hydraulic cylinder operably connected to said A-frame and to said lift frame, said second actuators are electric linear actuators operably connected to said latch pawls and said mount frame, and said third actuator is an electric linear actuator operably connected to said cam actuating pin and said lift frame.

24. The assembly of claim 22 wherein said mount frame has one of a male connector and a female connector in electrical communication with the vehicle electrical system, and said lift frame has the other of said male connector and said female connector in operable electrical communication with said first actuator and said third actuator, and wherein when said first and second arms are received in respective ones of said first and second receivers said male and female connectors connect to make electrical contact.

25. A method permitting an operator to attach a snow plow frame to, and detach the snow plow frame from, a mount frame secured to a vehicle, without the operator exiting a cab of the vehicle, comprising:

driving the vehicle towards the snow plow frame to mate the mount frame with a lift frame of the snow plow frame, establishing an electrical connection between an electrical system of the vehicle and the snow plow frame upon mating the mount frame with the lift frame, energizing a first actuator mounted on the snow plow frame and powered by the vehicle electrical system to pivot the lift frame upwardly relative to the A-frame to engage the lift frame with a latch mechanism on the mount frame and to latch the latch mechanism thereby removably securing the snow plow frame to the mount frame, energizing a second actuator mounted on the mount frame and powered by the vehicle electrical system to unlatch the latch mechanism, and energizing the first actuator to pivot the lift frame downwardly relative to the A-frame to disengage the lift frame from the latch mechanism thereby freeing the snow plow frame from the mount frame, wherein the lift frame has a latch pin and the latch mechanism includes a pivoting latch hook and a pivoting latch pawl, whereby when the lift frame is moved to a raised position by the first actuator the latch pin is received by the latch hook, and wherein actuation of the second actuator is operable to rotate the latch pawl to a disengaged position with the latch hook thereby permitting the latch pin to move out of the latch hook when the lift frame is moved to a lowered position by the first actuator thereby freeing the snow plow frame from the mount frame.

26. The method of claim 25 further comprising:

coupling movement of a snow plow frame support stand to relative pivoting movement between the lift frame and the A-frame to raise the support stand from an extended position to a retracted position during energization of the first actuator to pivot the lift frame upwardly relative to the A-frame and to lower the support stand from the retracted position to the extended position during energization of the first actuator to pivot the lift frame downwardly relative to the A-frame.

27. The method of claim 25 wherein the latch pawl is biased to an engaged position with the latch hook to prevent rotation of the latch hook thereby removably securing the snow plow frame to the mount frame, and wherein actuation of the second actuator is operable to rotate the latch pawl against the bias to a disengaged position with the latch hook thereby permitting the latch pin to move out of the latch hook when the lift frame is moved to a lowered position by the first actuator thereby freeing the snow plow frame from the mount frame.

28. A method permitting an operator to attach a snow plow frame to, and detach the snow plow frame from, a mount frame secured to a vehicle, without the operator exiting a cab of the vehicle, comprising:

driving the vehicle towards the snow plow frame to mate the mount frame with a lift frame of the snow plow frame, establishing an electrical connection between an electrical system of the vehicle and the snow plow frame upon mating the mount frame with the lift frame, energizing a first actuator mounted on the snow plow frame and powered by the vehicle electrical system to pivot the lift frame upwardly relative to the A-frame to engage the lift frame with a latch mechanism on the mount frame and to latch the latch mechanism thereby removably securing the snow plow frame to the mount frame, energizing a second actuator mounted on the mount frame and powered by the vehicle electrical system to unlatch the latch mechanism, and energizing the first actuator to pivot the lift frame downwardly relative to the A-frame to disengage the lift frame from the latch mechanism thereby freeing the snow plow frame from the mount frame, further comprising coupling movement of a snow plow frame support stand to relative pivoting movement between the lift frame and the A-frame to raise the support stand from an extended position to a retracted position during energization of the first actuator to pivot the lift frame upwardly relative to the A-frame and to lower the support stand from the retracted position to the extended position during energization of the first actuator to pivot the lift frame downwardly relative to the A-frame, further comprising decoupling support stand movement from relative pivoting movement between the lift frame and the A-frame such that the support stand remains in the retracted position during energization of the first actuator to pivot the A-frame upwardly relative to the lift frame and to pivot the A-frame downwardly relative to the lift frame.

29. The method of claim 28 further comprising energizing a third actuator mounted on the snow plow frame and powered by the vehicle electrical system to couple support stand movement to and decouple support stand movement from relative pivoting movement between the lift frame and the A-frame.

30. A snow plow and mount frame assembly that permits an operator to attach and detach a snow plow to and from a mount frame secured to a vehicle, without the operator exiting a cab of the vehicle, comprising:

a mount frame adapted to be secured to the vehicle, a snow plow frame having an A-frame and a lift frame pivotally connected to one another, a plow blade on said A-frame, a first actuator on said snow plow frame for pivoting said A-frame and said lift frame relative to one another, said first actuator adapted to be powered by an electrical system of the vehicle, a latch mechanism on either said mount frame or said snow plow frame for latching said snow plow frame to said mount frame, and a second actuator on either said mount frame or said snow plow frame to either latch or unlatch said latch mechanism, said second actuator adapted to be powered by the electrical system of the vehicle, whereby when the vehicle is driven toward said snow plow said snow plow frame mates with said mount frame and an electrical connection is made between the vehicle electrical system and at least said first actuator without manual manipulation, and when said second actuator is energized said latch mechanism either latches thereby securing said snow plow frame to said mount frame or unlatches thereby freeing said snow plow frame from said mount frame, wherein one of said lift frame and said mount frame has a latch pin and the other of said lift frame and said mount frame has said latch mechanism, said latch mechanism including a pivoting latch hook and a pivoting latch pawl, whereby when said lift frame is moved to a raised position by said first actuator said latch pin is received by said latch hook, and wherein actuation of said second actuator is operable to either rotate said latch pawl to an engaged position with said latch hook to prevent rotation of said latch hook thereby removably securing said snow plow frame to said mount frame, or rotate said latch pawl to a disengaged position with said latch hook thereby permitting said latch pin to move out of said latch hook when said lift frame is moved to a lowered position by said first actuator thereby freeing said snow plow frame from said mount frame.

31. The assembly of claim 30 wherein said latch mechanism and said second actuator are on said mount frame, and when said second actuator is energized said latch mechanism unlatches.

32. The assembly of claim 30 wherein said latch pawl is biased to an engaged position with said latch hook to prevent rotation of said latch hook thereby removably securing said snow plow frame to said mount frame, and wherein actuation of said second actuator is operable to rotate said latch pawl against the bias to a disengaged position with said latch hook thereby permitting said latch pin to move out of said latch hook when said lift frame is moved to a lowered position by said first actuator thereby freeing said snow plow frame from said mount frame.

33. A snow plow and mount frame assembly that permits an operator to attach and detach a snow plow to and from a mount frame secured to a vehicle, without the operator exiting a cab of the vehicle, comprising:

a mount frame adapted to be secured to the vehicle, a snow plow frame having an A-frame and a lift frame pivotally connected to one another, a plow blade on said A-frame, a first actuator on said snow plow frame for pivoting said A-frame and said lift frame relative to one another, said first actuator adapted to be powered by an electrical system of the vehicle, a latch mechanism on either said mount frame or said snow plow frame for latching said snow plow frame to said mount frame, and a second actuator on either said mount frame or said snow plow frame to either latch or unlatch said latch mechanism, said second actuator adapted to be powered by the electrical system of the vehicle, whereby when the vehicle is driven toward said snow plow said snow plow frame mates with said mount frame and an electrical connection is made between the vehicle electrical system and at least said first actuator without manual manipulation, and when said second actuator is energized said latch mechanism either latches thereby securing said snow plow frame to said mount frame or unlatches thereby freeing said snow plow frame from said mount frame, wherein said latch mechanism and said second actuator are on said mount frame, and when said second actuator is energized said latch mechanism unlatches, wherein said snow plow frame includes a support stand and a third actuator adapted to be powered by the electrical system of the vehicle, said third actuator operable to couple and decouple upward and downward movement of said support stand with and from relative pivoting movement of said A-frame and said lift frame, and when the vehicle is driven toward said snow plow said snow plow frame mates with said mount frame and an electrical connection is made between the vehicle electrical system and said first and third actuators without manual manipulation.

* * * * *